US007380907B2

(12) United States Patent
Nunokawa

(10) Patent No.: US 7,380,907 B2
(45) Date of Patent: Jun. 3, 2008

(54) LIQUID EJECTION APPARATUS AND LIQUID EJECTION METHOD

(75) Inventor: Hirokazu Nunokawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/544,838

(22) PCT Filed: May 20, 2004

(86) PCT No.: PCT/JP2004/007240

§ 371 (c)(1),
(2), (4) Date: Aug. 8, 2005

(87) PCT Pub. No.: WO2004/103709

PCT Pub. Date: Dec. 2, 2004

(65) Prior Publication Data

US 2006/0209112 A1 Sep. 21, 2006

(30) Foreign Application Priority Data

May 22, 2003 (JP) ..... 2003-144315

(51) Int. Cl.
*B41J 2/15* (2006.01)
*B41J 2/145* (2006.01)

(52) U.S. Cl. ..... 347/41; 347/15; 347/42

(58) Field of Classification Search ..... 347/15, 347/96, 102, 9, 12, 40, 41, 42
See application file for complete search history.

(56) References Cited

U.S. PATENT DOCUMENTS

| | | | | |
|---|---|---|---|---|
| 6,866,358 | B2 | 3/2005 | Masuyama | |
| 2003/0035021 | A1 | 2/2003 | Masuyama et al. | |
| 2003/0117453 | A1 * | 6/2003 | Goto et al. | 347/15 |
| 2005/0041050 | A1 | 2/2005 | Masuyama | |

FOREIGN PATENT DOCUMENTS

| | | | |
|---|---|---|---|
| EP | 0679518 | A1 | 3/1995 |
| EP | 1285767 | A1 | 2/2003 |
| JP | 2001-71481 | A | 3/2001 |
| JP | 2002-103586 | A | 4/2002 |
| JP | 2003-127341 | A | 5/2003 |

* cited by examiner

*Primary Examiner*—Lam Son Nguyen
(74) *Attorney, Agent, or Firm*—Sughrue Mion, PLLC

(57) ABSTRACT

The number of liquid droplets ejected toward a region outside a medium, which becomes a necessary evil when forming dots all the way to the edges of the medium by ejecting liquid droplets, can be decreased without greatly impairing the formation of dots at the edges. A liquid ejection apparatus for ejecting a liquid, includes: a liquid ejection section for ejecting liquid droplets toward a medium in order to form dots on the medium; wherein the liquid ejection section ejects, toward a vicinity of an edge of the medium, the liquid droplets of a number that has been thinned out by a suitable number; and wherein at least a portion of the liquid droplets ejected after thinning does not land on the medium.

27 Claims, 36 Drawing Sheets

[change pattern 3]

[change pattern 4]

[change pattern 5]

LIQUID EJECTION APPARATUS AND LIQUID EJECTION METHOD

TECHNICAL FIELD

The present invention relates to liquid ejection apparatuses and liquid ejection methods forming dots on a medium by ejecting liquid droplets onto that medium.

BACKGROUND ART

Inkjet printers are known as one type of liquid ejection apparatus for ejecting droplets of a liquid toward a medium. Such inkjet printers eject droplets of ink, as the liquid droplets, toward print paper (hereinafter also referred to as paper) serving as a medium to form a multitude dots on the print paper, thereby printing a macroscopic image with these dots.

Such inkjet printers are provided with a print function known as "borderless printing." This is the function of printing an image on paper without forming margins by forming dots over the entire paper up to its edges. Ordinarily, by using image data that is larger in size than the paper, liquid droplets are ejected toward regions outside the paper so that there are no areas at the edges in which, unintentionally, no dots are formed due to, for example, the position of the paper being misaligned during carrying.

However, almost all of the liquid droplets that are ejected to this outside area are abandoned without forming dots on the paper, leading to an increased amount of ink that is used.

In view of these circumstances, it is an object of the present invention to achieve a liquid ejection apparatus and a liquid ejection method with which the number of liquid droplets ejected toward the region outside the medium, which becomes a necessary evil when trying to form dots all the way to the edges of the medium by ejecting liquid droplets, can be decreased without greatly impairing the formation of dots at the edges.

DISCLOSURE OF INVENTION

In order to address the above issue, a primary aspect of the present invention is a liquid ejection apparatus for ejecting a liquid, comprising: a liquid ejection section for ejecting liquid droplets toward a medium in order to form dots on the medium; wherein the liquid ejection section ejects, toward a vicinity of an edge of the medium, the liquid droplets of a number that has been thinned out by a suitable number; and wherein at least a portion of the liquid droplets ejected after thinning does not land on the medium.

Another primary aspect of the present invention is a liquid ejection method for ejecting liquid droplets toward a medium in order to form dots on the medium, comprising: a step of thinning out a suitable number of liquid droplets to be ejected; and a step of ejecting, toward a vicinity of an edge of the medium, the liquid droplets of a number that has been thinned out by the suitable number; wherein at least a portion of the liquid droplets ejected after thinning does not land on the medium.

Features and objects of the present invention other than the above will become clear through the present specification with reference to the accompanying drawings.

Figure 1:
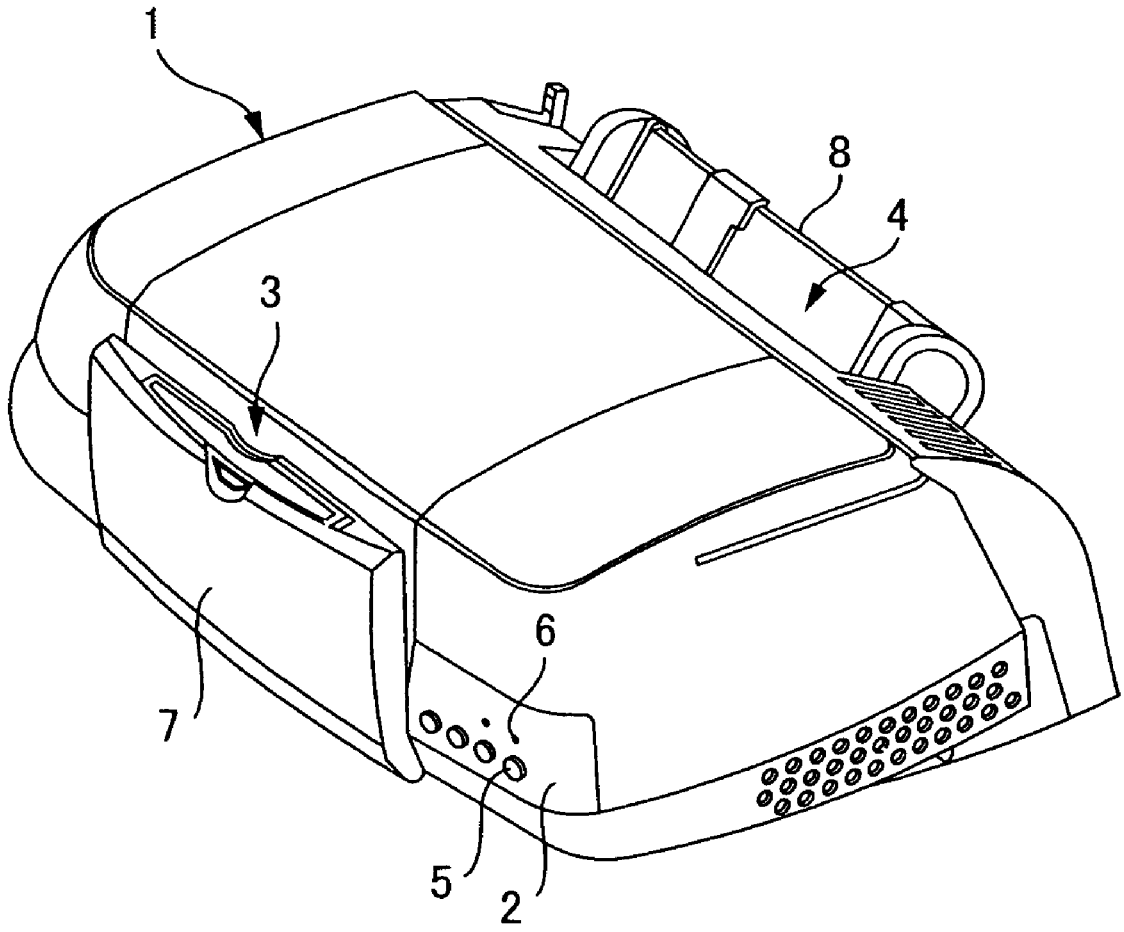
FIG. 1 is a perspective view showing an embodiment of an inkjet printer 1.

A legend of the main reference numerals used in the drawings is shown below.

1 . . . inkjet printer/2 . . . control panel/3 . . . paper discharge section/4 . . . paper supply section/5 . . . control buttons/6 . . . display lamps/7 . . . paper discharge tray/8 . . . paper supply tray/10 . . . paper carry unit/13 . . . paper supply roller/14 . . . platen/15 . . . paper carry motor (PF motor)/16 . . . paper carry motor driver (PF motor driver)/17A . . . carry roller/17B . . . paper discharge roller/18A . . . free roller/
18B . . . free roller/20 . . . ink ejection unit/21 . . . ejection head/211 . . . nozzle row/22 . . . head driver/221 . . . original drive signal generation section/222 . . . mask circuits/223 . . . drive signal correction section/224 . . . thinning processing section/30 . . . cleaning unit/31 . . . pump device/32 . . . pump motor/33 . . . pump motor driver/35 . . . capping device/40 . . . carriage unit/41 . . . carriage/42 . . . carriage motor (CR motor)/43 . . . carriage motor driver (CR motor driver)/44 . . . pulley/45 . . . timing belt/46 . . . guide rail 150 . . . measuring instrument group/51 . . . linear encoder/511 . . . linear scale/512 . . . detection section/512A . . . light-emitting diode/512B . . . collimator lens/512C . . . detection processing section/512D . . . photodiode/512E . . . signal processing circuit/512F . . . comparator/52 . . . rotary encoder/53 . . . paper detection sensor 54 . . . paper width sensor/60 . . . control unit/61 . . . CPU/62 . . . timer/63 . . . interface section/64 . . . ASIC/65 . . . memory/66 . . . DC controller/67 . . . host computer/80 . . . ink collection section/82 . . . first ink collection section/83 . . . second ink collection section/84 . . . absorbing material/90 . . . computer/91 . . . video driver/93 . . . display device/95 . . . application program/96 . . . printer driver/97 . . . resolution conversion module/98 . . . color conversion module/99 . . . halftone module/100 . . . rasterizer/101 . . . user interface display module/102 . . . UI printer interface module/A . . . print region/As . . . reference region/Aa . . . abandonment region/S . . . medium (paper)/R . . . raster line.

BEST MODE FOR CARRYING OUT THE INVENTION

At least the following matters will be made clear by the present specification and the accompanying drawings.

A liquid ejection apparatus for ejecting a liquid, comprises: a liquid ejection section for ejecting liquid droplets toward a medium in order to form dots on the medium; wherein the liquid ejection section ejects, toward a vicinity of an edge of the medium, the liquid droplets of a number that has been thinned out by a suitable number; and wherein at least a portion of the liquid droplets ejected after thinning does not land on the medium.

With this liquid ejection apparatus, a suitable number of the liquid droplets are thinned out when ejecting those liquid droplets toward the vicinity of an edge of the medium. Consequently, it becomes possible to reduce the number of liquid droplets that do not land on the medium, which becomes a necessary evil when forming dots all the way to the edges of the medium, while substantially ensuring that the formation of dots in the vicinity of the edges is not impaired.

In the liquid ejection apparatus, when ejecting the liquid droplets from the liquid ejection section toward a region that is determined to be outside the medium, the liquid droplets may be ejected after thinning a suitable number of the liquid droplets that are to be ejected toward that region.

With this liquid ejection apparatus, a suitable number of liquid droplets are thinned out from the liquid droplets to be ejected toward the region that is determined to be outside the medium. Consequently, it becomes possible to reduce the number of liquid droplets ejected onto the region outside the medium, which becomes a necessary evil when forming dots all the way to the edges of the medium, while substantially ensuring that the formation of dots at the edges is not impaired.

In the liquid ejection apparatus, the liquid droplets may be ejected based on image data formed to a size that is larger than the medium, and a reference region corresponding to the size of the medium may be stored; and the region that is determined to be outside the medium may be a region that is outside the reference region.

With this liquid ejection apparatus, it is possible to form an image up to the edges of the medium. That is to say, it is possible to form a borderless image.

In the liquid ejection apparatus, the liquid ejection section may comprise nozzles ejecting the liquid droplets; an image formed on the medium based on the image data may be constituted by raster lines that are arranged in parallel to one another at a predetermined interval in a direction intersecting the direction of the raster lines, each of the raster lines being made of a multitude of dots arranged on a straight line; and the raster lines may be formed by ejecting the liquid droplets while moving the nozzles in the raster line direction.

With this liquid ejection apparatus, an image can be easily formed.

In the liquid ejection apparatus, a ratio at which the liquid droplets are thinned out in the region that is determined to be outside the medium may be increased toward the edge in the raster line direction.

With this liquid ejection apparatus, less liquid droplets are ejected when approaching the edge of the region in the raster line direction. The reason for this is that the chances that liquid droplets land on the medium become lower toward the edges, so that the influence of thinning the liquid droplets ejected in the vicinity of the edges is less prone to show up as empty portions in the image. Consequently, it is possible to reduce the number of liquid droplets while effectively preventing a drop in the image quality due to thinning.

In the liquid ejection apparatus, the nozzles may constitute a nozzle row in which the nozzles are arranged at a predetermined nozzle pitch in a direction intersecting with the raster line direction; the medium may be intermittently carried by a predetermined carry amount in the intersecting direction; and in between the intermittent carries, the nozzle row may form the raster lines while moving in the raster line direction.

With this liquid ejection apparatus, it is possible to form an image on the medium across a plane that is defined by the raster line direction and a direction intersecting with this direction.

In the liquid ejection apparatus, for a single movement operation of the nozzle row in the raster line direction, the liquid droplets may be thinned out by a predetermined thin-out number consecutively from the edge in the raster line direction and the thin-out number may be the same number for all of the nozzles constituting the nozzle row; and the thin-out number may be changed for every movement operation of the nozzle row.

With this liquid ejection apparatus, the thin-out number of the liquid droplets is changed for every movement operation of the nozzle row, so that the thinned-out state of the liquid droplets at the edge of the medium can be dispersed. Thus, it can be ensured that empty portions in the image that may become conspicuous at the edges of the medium do not become readily apparent.

In the liquid ejection apparatus, the thin-out number of the liquid droplets may be changed for every movement operation based on a predetermined change pattern, and the thin-out numbers based on this change pattern may form a cycle that makes a round every time a predetermined number Cm of the movement operations are repeated.

With this liquid ejection apparatus, the thin-out numbers are changed for each movement operation based on a predetermined change pattern whose unit period is the predetermined number Cm of movement operations. Consequently, it is possible to disperse the thinned-out state of the liquid droplets at the edges, and thus empty portions in the image that may become conspicuous at the edges of the medium can be made not to be readily apparent.

In the liquid ejection apparatus, the nozzle pitch of the nozzle row may be wider than the interval between the raster lines formed on the medium; and there may be an unformed raster line between raster lines that are formed by the nozzle row in a single movement operation in the raster line direction.

With this liquid ejection apparatus, it is possible to carry out so-called interlaced printing, which is a print mode in which an unformed raster line is sandwiched between raster lines that are formed by the nozzle row in a single movement operation.

In the liquid ejection apparatus, when the interval between the raster lines formed on the medium is D, the nozzle pitch is k-D, the number of the nozzles ejecting the liquid is N, and the carry amount is F, then: N may be coprime with k; and F may be N·D.

With this liquid ejection apparatus, it is possible to reliably perform interlaced printing.

In the liquid ejection apparatus, each of the raster lines formed on the medium may be formed using a plurality of nozzles.

With this liquid ejection apparatus, it is possible to carry out so-called overlap printing, which is a print mode in which the multitude of dots of a single raster line is formed by a plurality of nozzles.

In the liquid ejection apparatus, the raster line may include an intermittently-ejected portion that is formed by ejecting the liquid droplets after performing intermittent thinning.

With this liquid ejection apparatus, the raster lines include intermittently-ejected portions in which the liquid droplets are intermittently thinned out, so that empty portions in the image which may become conspicuous at the edges of the medium can be dispersed without being continuous in the raster line direction, and can be made not to be readily apparent.

In the liquid ejection apparatus, a predetermined number Co of movement operations of the nozzle row may be required to form raster lines at the interval D on the medium; and the predetermined number Co may be coprime to the predetermined number Cm regarding the change pattern of the thin-out numbers.

With this liquid ejection apparatus, the predetermined number Co is coprime to the predetermined number Cm, which is the period of the change pattern of the thin-out number, thus ensuring that an intermittently-ejected portion is formed.

Moreover, the predetermined number Co, which is the period of the movement operation, is coprime to the predetermined Cm, which is the period of the change pattern of the thin-out number, so that those periods can be ensured to be different. Consequently, the periodicity of the thinning in the direction of the intermittent carrying can be made more intricate, and thus empty portions in the image, which may become conspicuous at the edges of the medium, can be made less readily apparent.

In the liquid ejection apparatus, when each raster line is formed by M nozzles, and when the interval between the raster lines formed on the medium and the interval between the dots in the raster line direction are both D, the nozzle pitch is k·D, the number of the nozzles ejecting the liquid droplets is N, and the carry amount is F, then: N/M may be an integer; N/M may be coprime to k; and F may be (N/M)·D.

With this liquid ejection apparatus, overlap printing can be performed reliably.

In the liquid ejection apparatus, k does not have to be a multiple (an integer multiple other than 1) of the predetermined number Cm.

With this liquid ejection apparatus, k is not a multiple (an integer multiple other than 1) of the predetermined number Cm, so that it can be ensured that an intermittently-ejected portion is formed.

In the liquid ejection apparatus, the shape of the dots may be substantially the shape of an ellipse whose major axis is oriented in the raster line direction.

With this liquid ejection apparatus, the shape of the dots is substantially oblong with the major axis oriented in the raster line direction, so that blanks in the intermittently-ejected portion of the raster lines can be effectively covered, and thus empty portions in the image can be made less conspicuous.

Further, the liquid ejection apparatus may further comprise an input section into which a command is input that indicates whether or not to eject the liquid droplets after thinning; and if a command to eject the liquid droplets after thinning is input, then the liquid droplets may be ejected after thinning a suitable number of the liquid droplets that are to be ejected toward the region.

With this liquid ejection apparatus, the user can select whether or not to perform ejection with thinning, thus improving usability.

Furthermore, a liquid ejection apparatus for ejecting a liquid, comprises: a liquid ejection section for ejecting liquid droplets toward a medium in order to form dots on the medium; wherein a mode for ejecting the liquid droplets without forming a margin at an edge of the medium can be set; and wherein, if the mode has been set, then: the liquid ejection section ejects, toward a vicinity of the edge of the medium, the liquid droplets of a number that has been thinned out by a suitable number; and at least a portion of the liquid droplets ejected after thinning does not land on the medium.

With such a liquid ejection apparatus, an image can be formed up to the edges of the medium. That is to say, it is possible to form a borderless image.

Furthermore, a liquid ejection apparatus for ejecting a liquid, comprises: a liquid ejection section for ejecting liquid droplets toward a medium in order to form dots on the medium; and an input section into which a command is input that indicates whether or not to eject the liquid droplets after thinning; wherein, if a command to eject the liquid droplets after thinning is input, then when ejecting the liquid droplets from the liquid ejection section toward a region that is determined to be outside the medium, the liquid droplets are ejected after thinning a suitable number of the liquid droplets that are to be ejected toward that region; wherein the liquid droplets are ejected based on image data formed to a size that is larger than the medium, a reference region corresponding to the size of the medium is stored, and the region that is determined to be outside the medium is a region that is outside the reference region; wherein the liquid ejection section comprises nozzles ejecting the liquid droplets; wherein an image formed on the medium based on the image data is constituted by raster lines that are arranged in parallel to one another at a predetermined interval in a direction intersecting the direction of the raster lines, each of the raster lines being made of a multitude of dots arranged on a straight line; wherein the raster lines are formed by ejecting the liquid droplets while moving the nozzles in the raster line direction; wherein a ratio at which the liquid droplets are thinned out in the region that is determined to be outside the medium increases away from the edge in the raster line direction; wherein the nozzles constitute a nozzle row in which the nozzles are arranged at a predetermined nozzle pitch in a direction intersecting with the raster line direction; wherein the medium is intermittently carried by a predetermined carry amount in the intersecting direction; wherein, in between the intermittent carries, the nozzle row forms the raster lines while moving in the raster line direction; wherein the nozzle pitch of the nozzle row is wider than the interval between the raster lines formed on the medium; wherein there is an unformed raster line between raster lines that are formed by the nozzle row in a single movement operation in the raster line direction; wherein each of the raster lines formed on the medium is formed using a plurality of nozzles; wherein, for a single movement operation of the nozzle row in the raster line direction, the liquid droplets are thinned out by a predetermined thin-out number consecutively from the edge in the raster line direction and the thin-out number is the same number for all of the nozzles constituting the nozzle row; wherein the thin-out number is changed for every movement operation of the nozzle row; wherein the thin-out number of the liquid droplets is changed for every movement operation based on a predetermined change pattern, and the thin-out numbers based on this change pattern form a cycle that makes a round every time a predetermined number Cm of the movement operations are repeated; wherein a predetermined number Co of movement operations of the nozzle row is required to form raster lines at the interval D on the medium; and wherein the predetermined number Co is coprime to the predetermined number Cm regarding the change pattern of the thin-out numbers.

With this liquid ejection apparatus, substantially all of the above-described effects can be attained, so that the object of the present invention can be attained most effectively.

It is also possible to achieve a liquid ejection method for ejecting liquid droplets toward a medium in order to form dots on the medium, comprising: a step of thinning out a suitable number of liquid droplets to be ejected; and a step of ejecting, toward a vicinity of an edge of the medium, the liquid droplets of a number that has been thinned out by the suitable number; wherein at least a portion of the liquid droplets ejected after thinning does not land on the medium.

Overview of Liquid Ejection Apparatus

Figure 2:
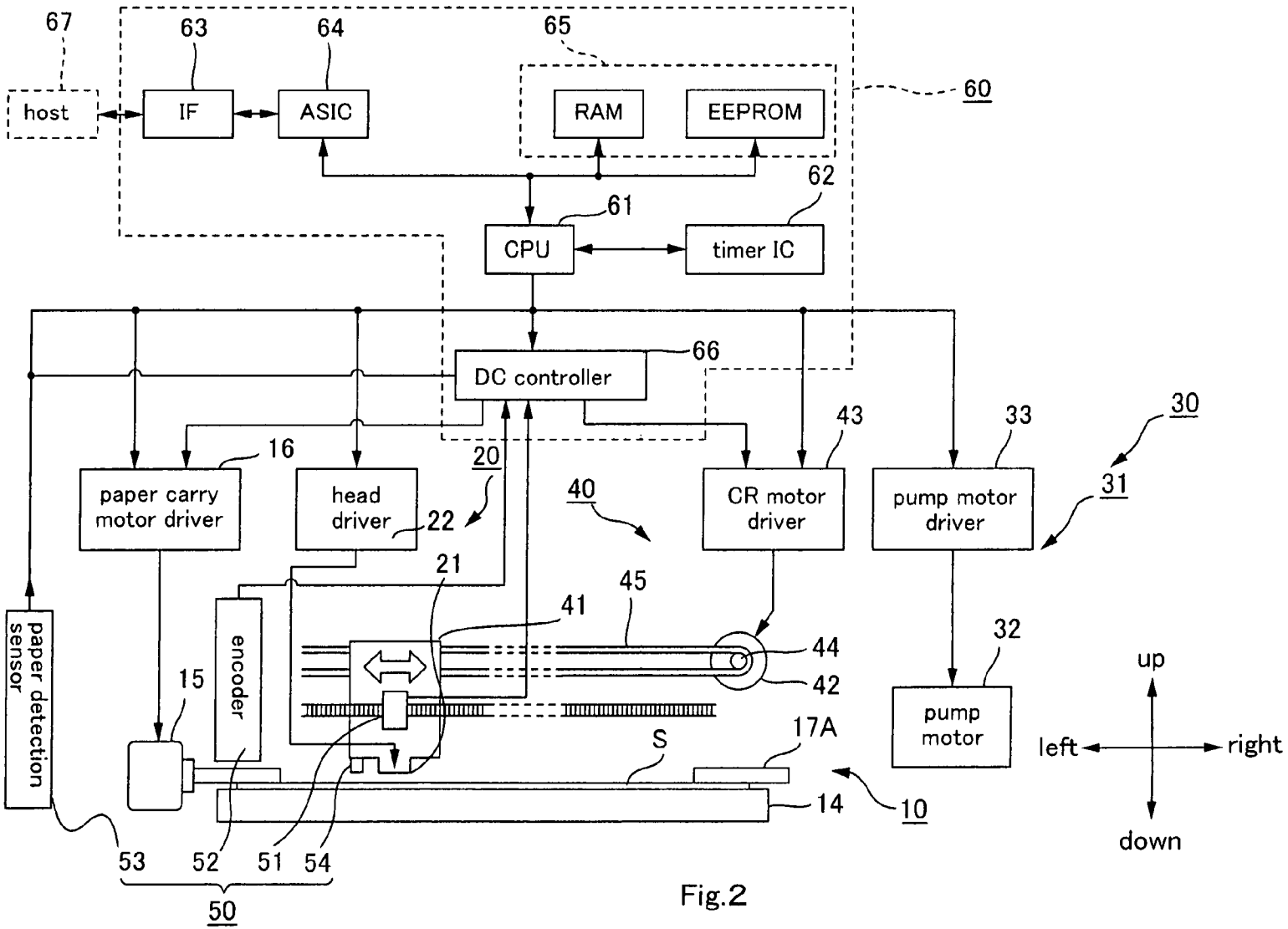
FIG. 2 is an explanatory diagram of the overall configuration of the inkjet printer 1.
Figure 3:
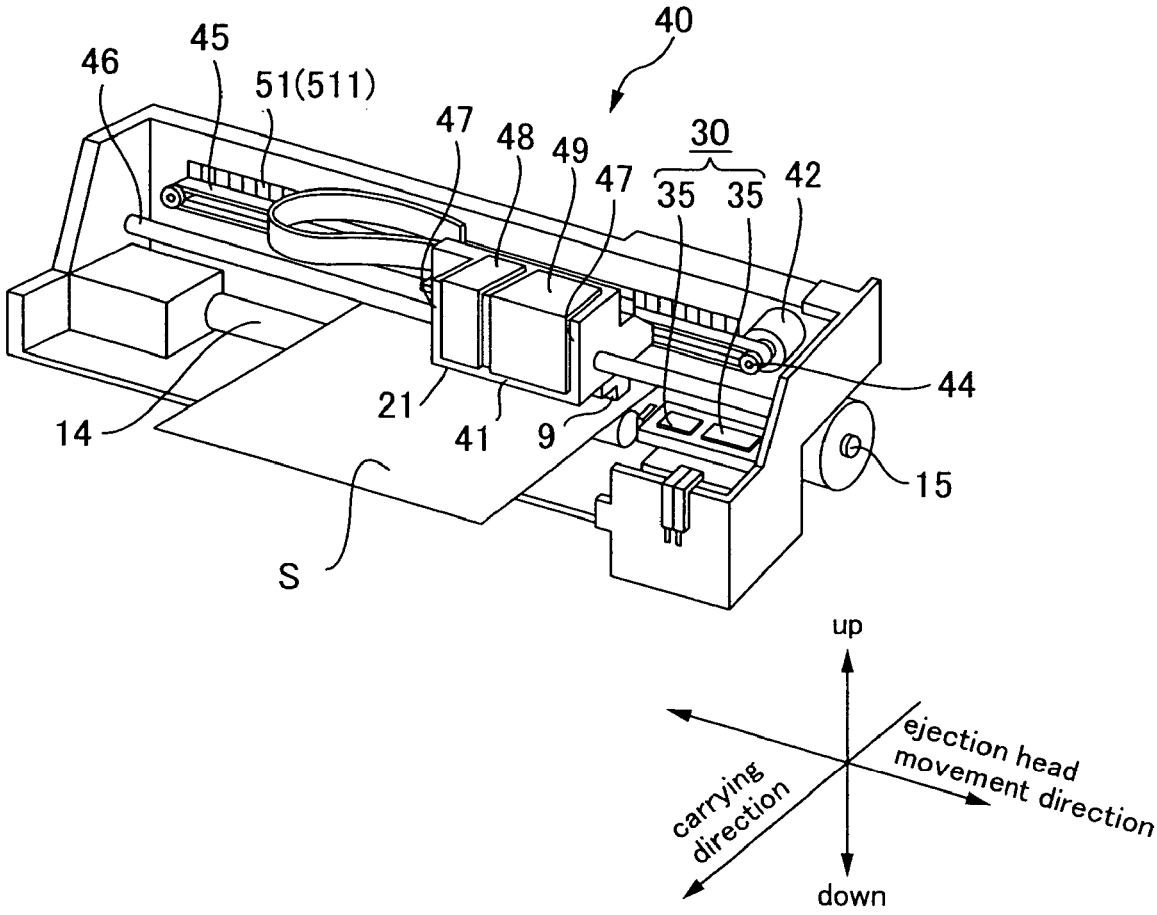
FIG. 3 is a diagram showing a carriage 41 etc. of the inkjet printer 1.
Figure 4:
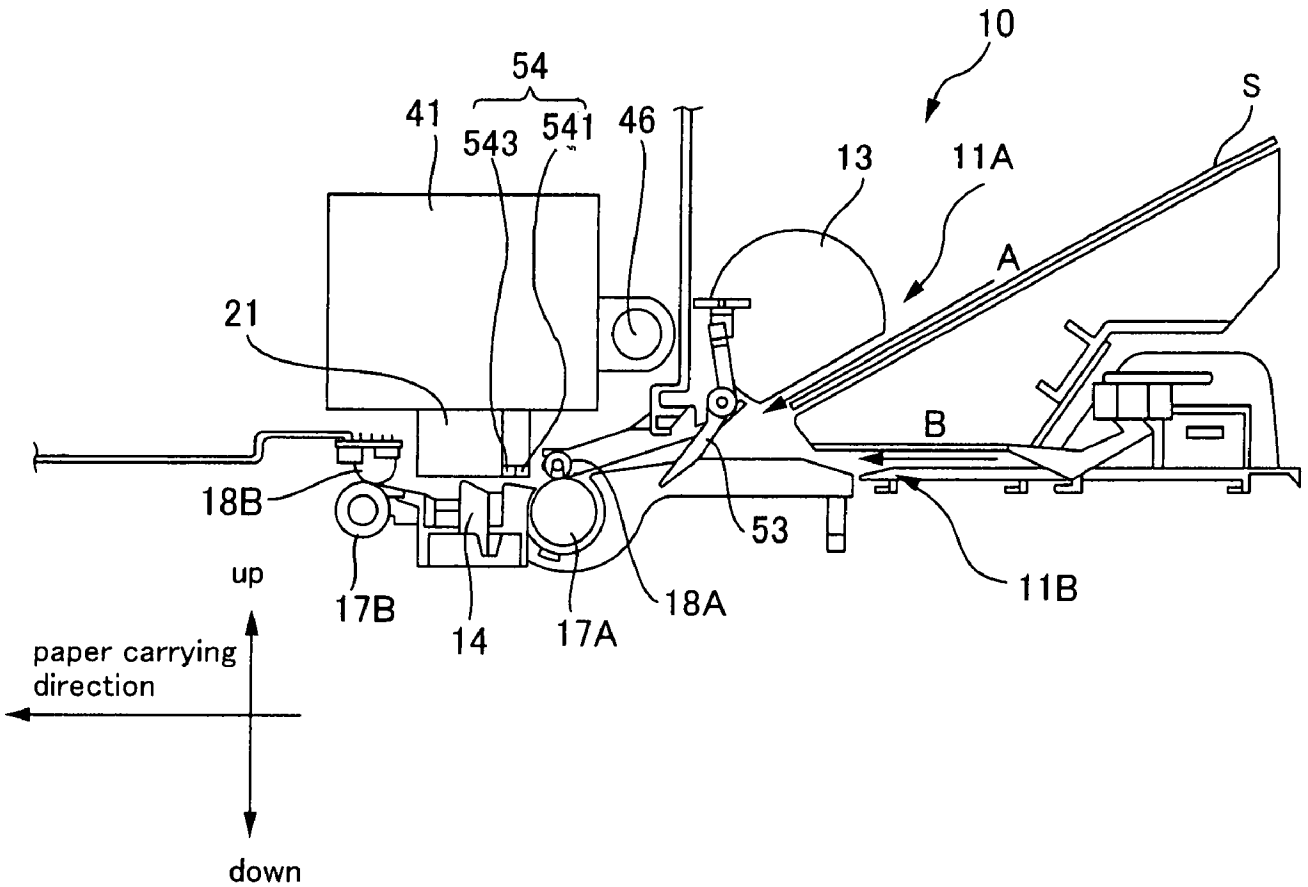
FIG. 4 is a diagram showing the carrying mechanism of the inkjet printer 1.

An overview of an inkjet printer serving as an example of a liquid ejection apparatus according to the present invention is described in the following. FIG. 1 to FIG. 4 are diagrams illustrating an overview of one embodiment of an inkjet printer 1. FIG. 1 shows the external appearance of this embodiment of the inkjet printer 1. FIG. 2 shows the block configuration of the inkjet printer 1, and FIG. 3 shows a carriage and a surrounding portion of the inkjet printer 1. FIG. 4 shows the carrying section of the inkjet printer 1 and its surroundings.

As shown in FIG. 1, the inkjet printer 1 is provided with a structure for discharging from its front side a print paper S serving as a medium that is supplied from its rear side. On its front side, the inkjet printer 1 is provided with a control panel 2 and a paper discharge section 3, and on its rear side it is provided with a paper supply section 4. The control panel 2 is provided with various types of control buttons 5 and display lamps 6. The paper discharge section 3 is provided with a paper discharge tray 7 that blocks the paper discharge opening when the inkjet printer is not used. The paper supply section 4 is provided with a paper supply tray 8 for holding cut paper (not shown). It should be noted that the inkjet printer 1 can also be provided with a paper supply structure with which it is possible to print not only single sheets of the paper S, such as cut paper, but also a continuous medium such as roll paper.

As shown in FIG. 2, the inkjet printer 1 is provided with a paper carry unit 10, an ink ejection unit 20, a cleaning unit 30, a carriage unit 40, a measuring instrument group 50, and a control unit 60, as its primary components.

The paper carry unit 10 is for feeding the paper S to a printable position and moving the paper S in a predetermined direction (the direction perpendicular to the paper face in FIG. 2 (hereinafter, referred to as the paper carrying direction)) by a predetermined movement amount during printing. In other words, the paper carry unit 10 functions as a carrying mechanism for carrying the paper S. As shown in FIG. 4, the paper carry unit 10 has a paper insert opening 11A, a roll paper insert opening 11B, a paper supply motor (not shown), a paper supply roller 13, a platen 14, a paper carry motor (hereinafter, referred to as PF motor) 15, a paper carry motor driver (hereinafter, referred to as PF motor driver) 16, a carry roller 17A, paper discharge rollers 17B, and free rollers 18A and free rollers 18B. However, the paper carry unit 10 does not necessarily have to include all of these structural elements in order to function as a carrying mechanism.

The paper insert opening 11A is where the paper S is inserted. The paper supply motor (not shown) is a motor for carrying the paper S, which has been inserted into the paper insert opening 11A, into the printer 1, and is constituted by a pulse motor. The paper supply roller 13 is a roller for automatically carrying the paper S, which has been inserted into the paper insert opening 11, into the printer 1, and is driven by the paper supply motor 12. The paper supply roller 13 has a transverse cross-sectional shape that is substantially the shape of the letter D. The length of the circumference of the paper supply roller 13 is set longer than the carrying distance to the PF motor 15, so that using this circumference the paper S can be carried up to the PF motor 15. It should be noted that a plurality of media are kept from being supplied at one time by the rotational drive force of the paper supply roller 13 and the friction resistance of separating pads (not shown).

The platen 14 is a support means that supports the paper S during printing. The PF motor 15 is a motor for feeding the paper S in the paper carrying direction, as shown in FIGS. 2 and 4, and is constituted by a DC motor. The PF motor driver 16 is for driving the PF motor 15. The carry roller 17A is a roller for feeding the paper S, which has been carried into the printer by the paper supply roller 13, to a printable region, and is driven by the PF motor 15. The free rollers 18A (see FIG. 4) are provided in a position that is in opposition to the carry roller 17A, and push the paper S toward the carry roller 17A by sandwiching the paper S between them and the carry roller 17A.

The paper discharge rollers 17B (see FIG. 4) are rollers for discharging the paper S for which printing has finished out of the printer. The paper discharge rollers 17B are driven by the PF motor 15 through a gear wheel that is not shown in the drawings. The free rollers 18B are provided in a position that is in opposition to the paper discharge rollers 17B, and push the paper S toward the paper discharge rollers 17B by sandwiching the paper S between them and the paper discharge rollers 17B.

The ink ejection unit 20 is for ejecting ink onto the paper S. As shown in FIG. 2, the ink ejection unit 20 has an ejection head 21 serving as a liquid ejection section, and a head driver 22. The ejection head 21 has a plurality of nozzles, and ejects ink droplets intermittently from the nozzles. The head driver 22 is for driving the ejection head 21, causing ink droplets to be ejected intermittently from the ejection head 21.

The cleaning unit 30 is for preventing the nozzles of the ejection head 21 from becoming clogged, as shown in FIG. 3. The cleaning unit 30 includes a pump device 31 and a capping device 35. The pump device 31 is for extracting ink from the nozzles in order to prevent the nozzles from becoming clogged, and includes a pump motor 32 and a pump motor driver 33. The pump motor 32 sucks out ink from the nozzles of the ejection head 21. The pump motor driver 33 drives the pump motor 32. The capping device 35 is for sealing the nozzles of the ejection head 21 during standby, that is, when printing is not being performed, so that the nozzles of the ejection head 21 are kept from becoming clogged.

The carriage unit 40 is for moving the ejection head 21 in a predetermined direction (in FIG. 2, the left-right direction of the paper face (hereinafter, this is referred to as the ejection head movement direction)), as shown in FIGS. 2 and 3. It should be noted that the ejection head movement direction is perpendicular to the paper carrying direction.

The carriage unit 40 has a carriage 41, a carriage motor (hereinafter, referred to as CR motor) 42, a carriage motor driver (hereinafter, referred to as CR motor driver) 43, a pulley 44, a timing belt 45, and a guide rail 46. The carriage 41 can be moved in the ejection head movement direction, and the ejection head 21 is fastened to it. Thus, the nozzles of the ejection head 21 intermittently eject ink as they are moved in the ejection head movement direction. The carriage 41 also detachably holds ink cartridges 48 and 49, which contain ink. The CR motor 42 is a motor for moving the carriage 41 in the ejection head movement direction, and is constituted by a DC motor. The CR motor driver 43 is for driving the CR motor 42. The pulley 44 is attached to the rotation shaft of the CR motor 42. The timing belt 45 is driven by the pulley 44. The guide rail 46 is for guiding the carriage 41 in the ejection head movement direction.

The measuring instrument group 50 includes a linear encoder 51, a rotary encoder 52, a paper detection sensor 53, and a paper width sensor 54. The linear encoder 51 is for detecting the position of the carriage 41. The rotary encoder 52 is for detecting the amount of rotation of the carry roller 17A. The paper detection sensor 53 is for detecting the position of the front edge of the paper S to be printed. As shown in FIG. 4, the paper detection sensor 53 is provided in a position where it can detect the position of the front edge of the paper S as the paper S is being carried toward the carry roller 17A by the paper supply roller 13. It should be noted that the paper detection sensor 53 is a mechanical sensor that detects the front edge of the paper S through a mechanical mechanism. More specifically, the paper detection sensor 53 has a lever that can be rotated in the paper carrying direction, and this lever is disposed so that it protrudes into the path over which the paper S is carried. Thus, the front edge of the paper S comes into contact with the lever and the lever is rotated, and thus the paper detection sensor 53 detects the position of the front edge of the paper S by detecting the movement of the lever. The paper width sensor 54 is attached to the carriage 41. The paper width sensor 54 is an optical sensor having a light-emitting section 541 and a light-receiving section 543, and detects whether the paper S is in the position of the paper width sensor 54 by detecting light that is reflected by the paper S. The paper width sensor 54 detects the positions of the edges of the paper S while being moved by the carriage 41, so as to detect the width of the paper S. Depending on the position of the carriage 41, the paper width sensor 54 can also detect the front edge of the paper S. The paper width sensor 54 is an optical sensor, and thus detects positions with higher precision than the paper detection sensor 53.

The control unit 60 is for carrying out control of the printer. As shown in FIG. 2, the control unit 60 includes a CPU 61, a timer 62, an interface section 63, an ASIC 64, a memory 65, and a DC controller 66. The CPU 61 is for carrying out the overall control of the printer, and sends control commands to the DC controller 66, the PF motor driver 16, the CR motor driver 43, the pump motor driver 32, and the head driver 22. The timer 62 periodically generates interrupt signals for the CPU 61. The interface section 63 exchanges data with a host computer 67 provided outside the printer. The ASIC 64 controls, for example, the printing resolution and the drive waveforms of the ejection head based on printing information sent from the host computer 67 through the interface section 63. The memory 65 is for reserving an area for storing the programs for the ASIC 64 and the CPU 61 and a working area, for instance, and includes a storage means such as a RAM or an EEPROM. The DC controller 66 controls the PF motor driver 16 and the CR motor driver 43 based on control commands sent from the CPU 61 and the output from the measuring instrument group 50.

In such an inkjet printer 1, when printing, the paper S is carried intermittently by the carry roller 17A by a predetermined carry amount, and when stopped, that is, between these intermittent carries, ink droplets are ejected toward the paper S from the ejection head 21 while the carriage 41 moves in the direction perpendicular to the carrying direction of the carry roller 17A, that is, in the ejection head movement direction. The ink droplets that have been ejected form dots on the paper S, and a multitude of dots are formed to produce a macroscopic image on the paper S.

Ejection Mechanism of the Ejection Head 21

Figure 5:
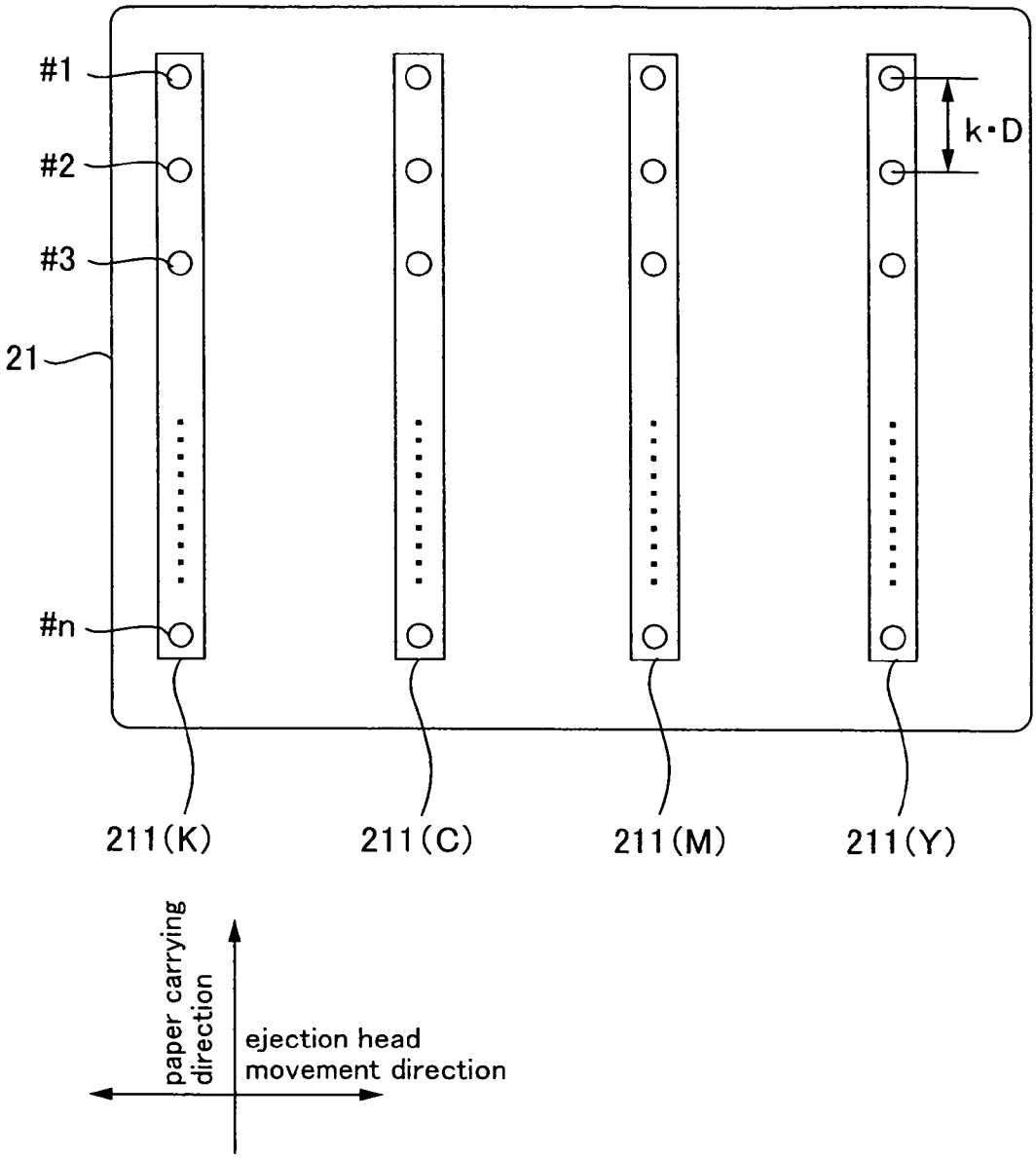
FIG. 5 is an explanatory diagram showing the arrangement of the nozzles in the head 21.

FIG. 5 is a diagram showing the arrangement of the nozzles for ejecting ink droplets that are provided in the lower surface of the ejection head 21. As shown in the figure, nozzle rows 211 for the colors black (K), cyan (C), magenta (M), and yellow (Y) are provided in the lower surface of the ejection head 21.

Each nozzle row 211 is constituted by a plurality of nozzles #1 to #n. The plurality of nozzles #1 to #n are arranged at a constant interval (nozzle pitch k·D) on a straight line extending in the carrying direction of the paper S. Here, D is the minimum dot pitch in the carrying direction (that is, the interval of the dots formed on the paper S at the highest resolution). Also, k is an integer of 1 or greater. It should be noted that the nozzles of the nozzle rows are assigned numbers (#1 to #n) that become smaller toward the downstream side. The nozzle rows 211 are positioned in parallel to one another in the ejection head movement direction with spaces between them.

It should be noted that in the following description, there are some explanations given for a single nozzle row of he nozzle rows 211, but this is because the ejection of ink droplets by the other nozzle rows 211 is the same, so that explanations are provided for one row as a representative example.

Each of the nozzles #1 to #n is provided with a piezo element (not shown) as a drive element that is used to eject ink droplets. When a voltage of a predetermined duration is applied between electrodes provided on both ends of the piezo element, the piezo element expands in accordance with the voltage application time and deforms the lateral walls of the ink channel. Thus, the volume of the ink channel is constricted in correspondence with the expansion of the piezo element, causing an amount of ink that corresponds to the amount of the constriction to be ejected as ink droplets from each of the nozzles #1 to #n for each color.

Figure 6:
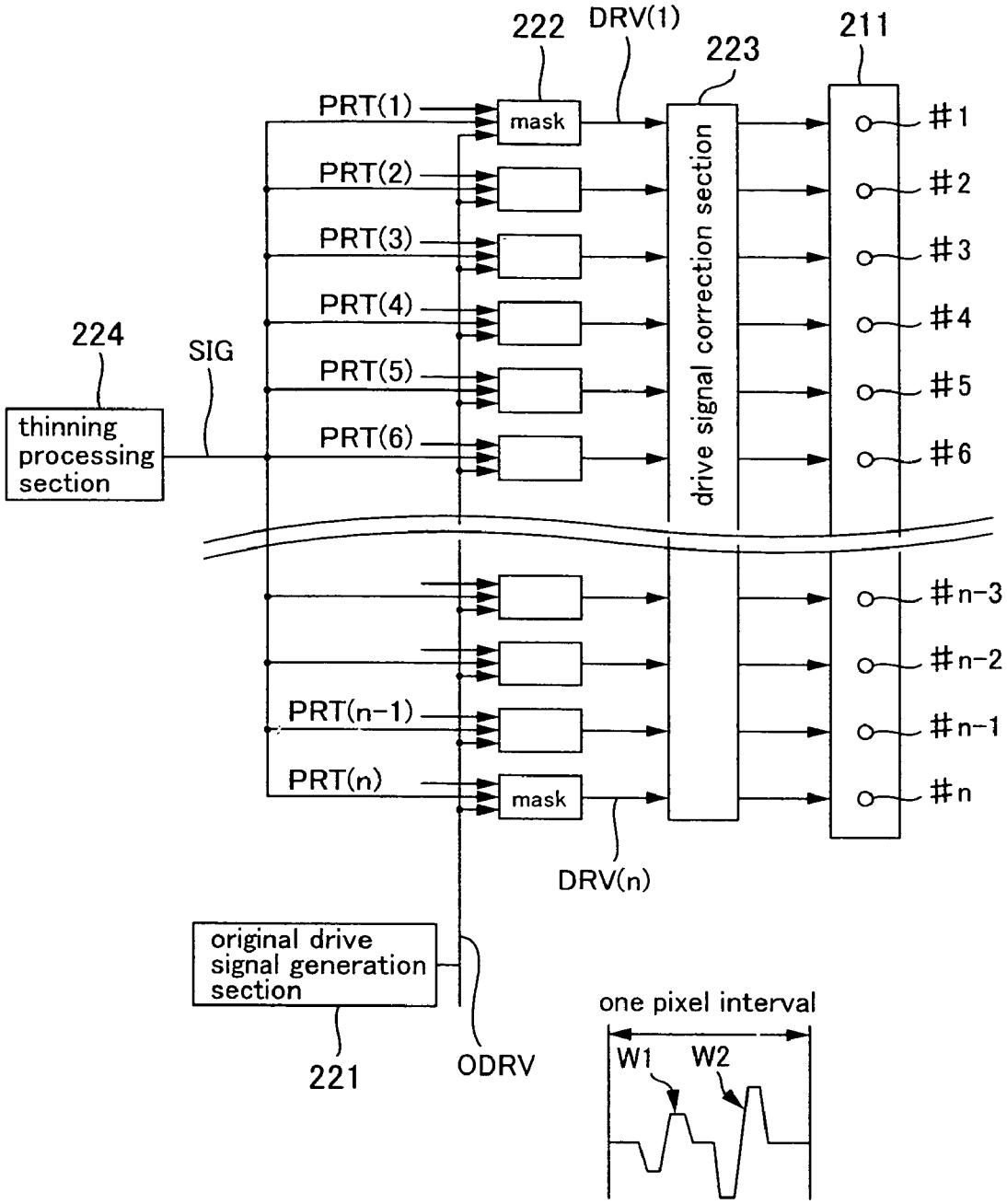
FIG. 6 is a block diagram showing the configuration within the drive circuit.

FIG. 6 is a block diagram of a drive circuit for driving the nozzles #1 to #n. It should be noted that in FIG. 6 the numbers in parentheses following each signal name indicate the number of the nozzle to which that signal is supplied.

This drive circuit is provided in the head driver 22 shown in FIG. 2 for each of the four nozzle rows. As shown in FIG. 6, this drive circuit is provided with an original drive signal generation section 221, a plurality of mask circuits 222, a thinning processing section 224, and a drive signal correction circuit 223.

The original drive signal generation section 221 generates an original drive signal ODRV that is used in common by the nozzles #1 to #n. As shown at the bottom of FIG. 6, the original drive signal ODRV is a signal that includes two pulses, a first pulse W1 and a second pulse W2, during the movement period of a single pixel (during the period that the carriage 41 moves across the length of a single pixel). The original drive signal ODRV that is thus generated is output to each mask circuit 222.

The mask circuits 222 are provided in correspondence to the plurality of piezo elements that drive the nozzles #1 to #n of the ejection head 21. Each of the mask circuits 222 receives the original signal ODRV from the original signal generation section 221 and also receives print signals PRT (i), based on the print data PD, which is described below. The print signals PRT(i) are pixel data corresponding to pixels, and are serial signals each including the information of two bits for one pixel. These two bits respectively correspond to the first pulse W1 and the second pulse W2. The mask circuits 222*a* block the original drive signal ODRV or allow it to pass, depending on the level of the print signal PRT(i). That is to say, when the print signal PRT(i) is at level 0, the pulse of the original drive signal ODRV is blocked and no ink droplet is ejected, whereas when the print signal PRT(i) is at level 1, the corresponding pulse of the original drive signal ODRV is passed unchanged, so that it is output via the driving signal correction section 223 to the piezo element as a drive signal DRV(i), and thus an ink droplet is ejected from the nozzle.

It should be noted that in this embodiment, a thinning signal SIG is input from the thinning processing section 224 into the mask circuits 224, in addition to the print signal PRT(i). This thinning signal SIG is used for a thinning process when performing borderless printing as described below, and is a signal that is either at level 0 or level 1. Whether the drive signal DRV(i) that has passed the mask circuit 224 becomes a signal that causes ejection of an ink droplet is determined by the calculation of the logical product (so-called "AND" operation) of the print signal PNT(i) and the thinning signal SIG.

As shown in FIG. 6, in the present embodiment, the same thinning signal SIG is input into all nozzles of a nozzle row 211. Consequently, the position in the ejection head movement direction when no ink droplet is to be ejected based on this thinning signal SIG is the same for all nozzles. This is related to the Rule 1 of the later-described thinning process.

The thinning signal SIG is generated for each pixel in the ejection head movement direction, in order to perform the later-described thinning process, and is input into the mask circuits 222 in correspondence with the print signals PRT(i). It should be noted that this thinning process is described further below.

The drive signal correction section 223 carries out a correction by shifting the timing of the drive signal waveforms shaped by the mask circuits 222 forward or backward for the entire return pass. By correcting the timing of the drive signal waveforms, misalignments in the locations where the ink droplets land in the forward pass and in the return pass are corrected. That is, the misalignment in the positions where dots are formed in the forward pass and the return pass is corrected.

Processing in the Host

Figure 7:
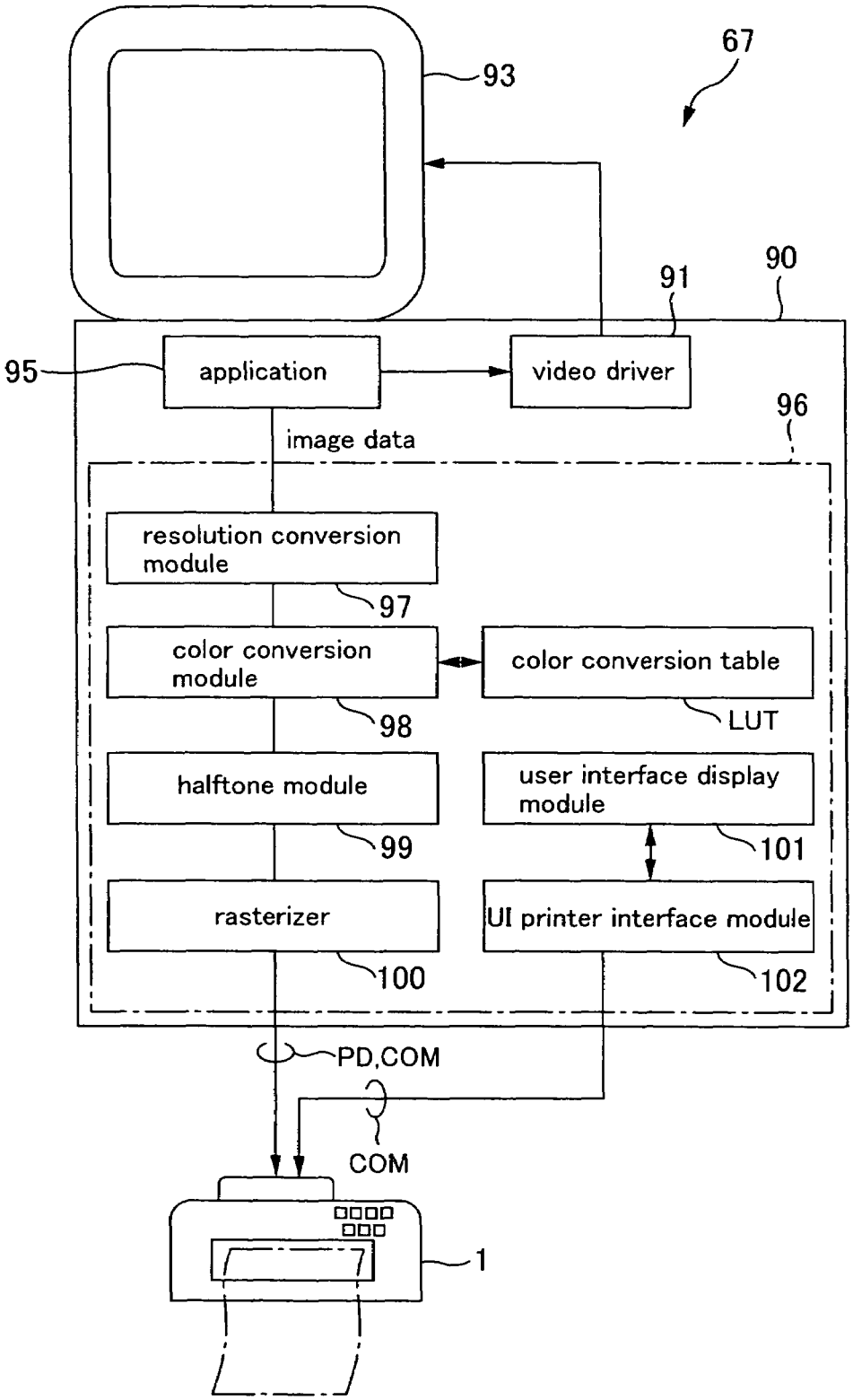
FIG. 7 is an explanatory diagram illustrating the processing on the host side.

FIG. 7 is a diagram for schematically describing the processing in the host 67. As shown in the diagram, the host 67 is provided with a main computer unit 90, which is connected to the printer 1, and a display device 93. A computer program 96 known as a "printer driver" for controlling operation of the printer 1 is installed in the computer 90. As shown in the diagram, the printer driver 96 operates under a predetermined operating system that is installed on the host 67 and under which an application program 95 also operates. The operating system includes a video driver 91 and a printer driver 96, and the application program 95 outputs print data PD for transfer to the inkjet printer 1 through these drivers. The application program 95, which carries out retouching of images, for example, performs desired processing with respect to an image to be processed, and also displays the image on the display device 93 via the video driver 91.

When the application program 95 issues a print command, the printer driver 96 of the main computer unit 90 receives image data from the application program 95 and converts the image data into print data PD to be supplied to the inkjet printer 1. The printer driver 96 is internally provided with a resolution conversion module 97, a color conversion module 98, a halftone module 99, a rasterizer 100, a user interface display module 101, a UI printer interface module 102, and a color conversion lookup table LUT.

The resolution conversion module 97 performs the function of converting the resolution of color image data formed by the application program 95 to the print resolution. The image data that is thus converted in resolution is still image information composed of the three color components RGB. The color conversion module 98 references the color conversion lookup table LUT as it converts the RGB image data for each pixel into multi-gradation data of a plurality of ink colors that can be used by the printer 1. The color-converted multi-gradation data has 256 gradation values, for example. The halftone module 99 carries out a so-called halftoning process, generating halftone image data. The halftone image data is rearranged by the rasterizer 100 into the data order in which it is to be transferred to the printer 1, and is output as the final print data PD to the printer 1. The print data PD includes raster data that indicates how dots are formed when the ejection head moves, and data indicating the carry amount of the paper S.

The user interface display module 101 has a function for displaying various types of user interface windows related to printing and a function for receiving user inputs through those windows.

The UI printer interface module 102 functions as an interface between the user interface (UI) and the printer 1. It interprets instructions given by users through the user interface and sends various commands COM to the printer 1, or conversely, it also interprets commands COM received from the printer 1 and performs various displays on the user interface.

It should be noted that the printer driver 96 executes, for example, a function for sending and receiving various types of commands COM and a function for supplying print data PD to the printer 1. A program for executing the functions of the printer driver 96 is supplied in a format in which it is stored on a computer-readable storage medium. Examples of this storage medium include various types of media from which the host 67 can read data, such as flexible disks, CD-ROMs, magneto optical disks, IC cards, ROM cartridges, punch cards, printed materials on which a code such as a bar code is printed, internal storage devices (memories such as a RAM or a ROM) and external storages devices of the host 67. The computer program can also be downloaded onto the main computer unit 90 via the Internet.

Print Modes

Here, print modes that can be executed by the printer 1 of the present embodiment are described using FIGS. 8A, 8B, 9A and 9B. Two print modes, namely interlaced printing and overlap printing can be executed. By using these print modes as appropriate, individual differences between the nozzles, such as in the nozzle pitch and the ink ejection properties, are lessened by spreading them out over the image to be printed, and thus an improvement in image quality can be attained.

Regarding Interlaced Printing

Figure 8A:
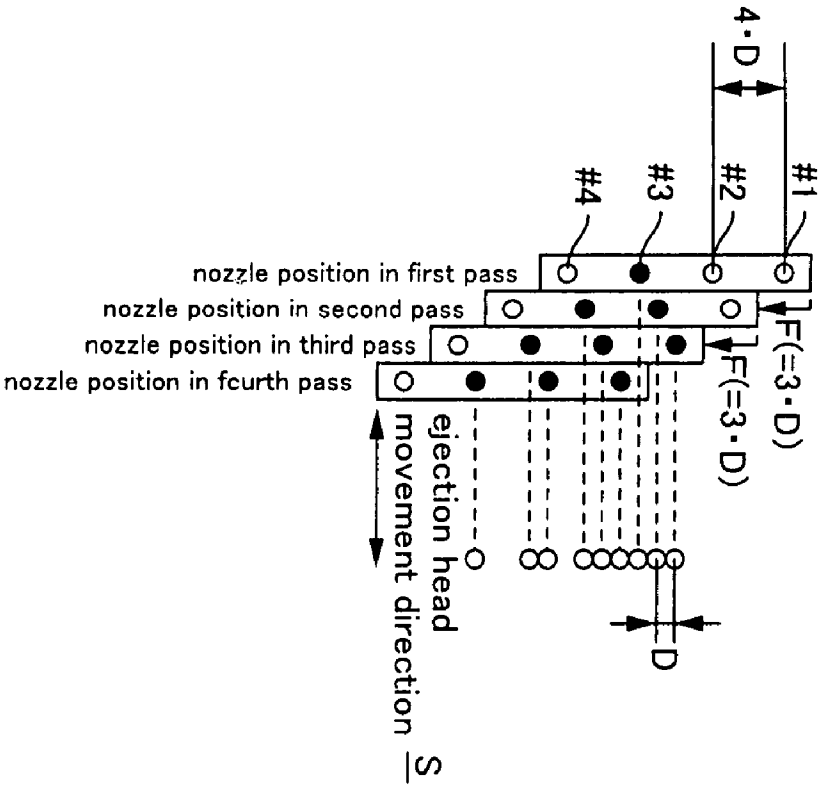
FIG. 8A is an explanatory diagram of ordinary interlaced printing.
Figure 8B:
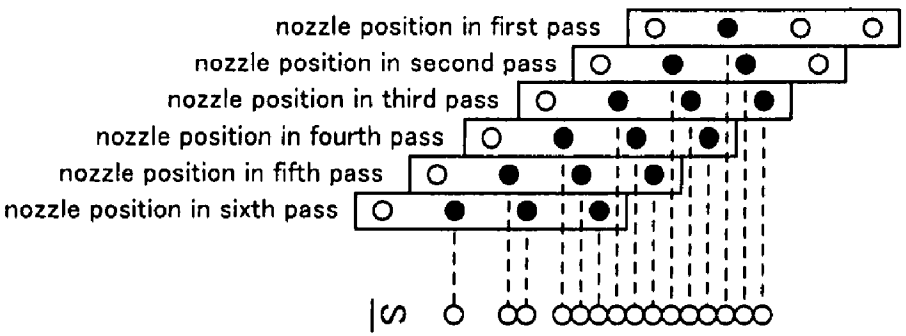
FIG. 8B is an explanatory diagram of ordinary interlaced printing.

FIGS. 8A and 8B are explanatory diagrams of ordinary interlaced printing. It should be noted that for the sake of simplifying the description, a nozzle row, which is shown in place of the ejection head 21, is illustrated to be moving with respect to the paper S, but the diagrams show the relative positional relationship between the nozzle row and the paper S, and in fact it is the paper S that moves in the carrying direction. In the diagrams, the nozzles represented by black circles are the nozzles that actually eject ink droplets, and the nozzles represented by white circles are nozzles that do not eject ink droplets. FIG. 8A shows the nozzle positions in the first through fourth passes and how the dots are formed by those nozzles. FIG. 8B shows the nozzle positions in the first through sixth passes and how the dots are formed.

Here, "interlaced printing" refers to a print mode in which k is at least 2 and a raster line that is not recorded is sandwiched between the raster lines that are recorded in a single pass. Also, "pass" refers to a single movement of the nozzle row in the ejection head movement direction. "Rasterline" refers to a row of pixels lined up in the ejection head movement direction. "Pixels" are the square boxes that are determined virtually on the print paper S in order to define the positions where ink droplets are caused to land so as to record dots.

Figure 15A:
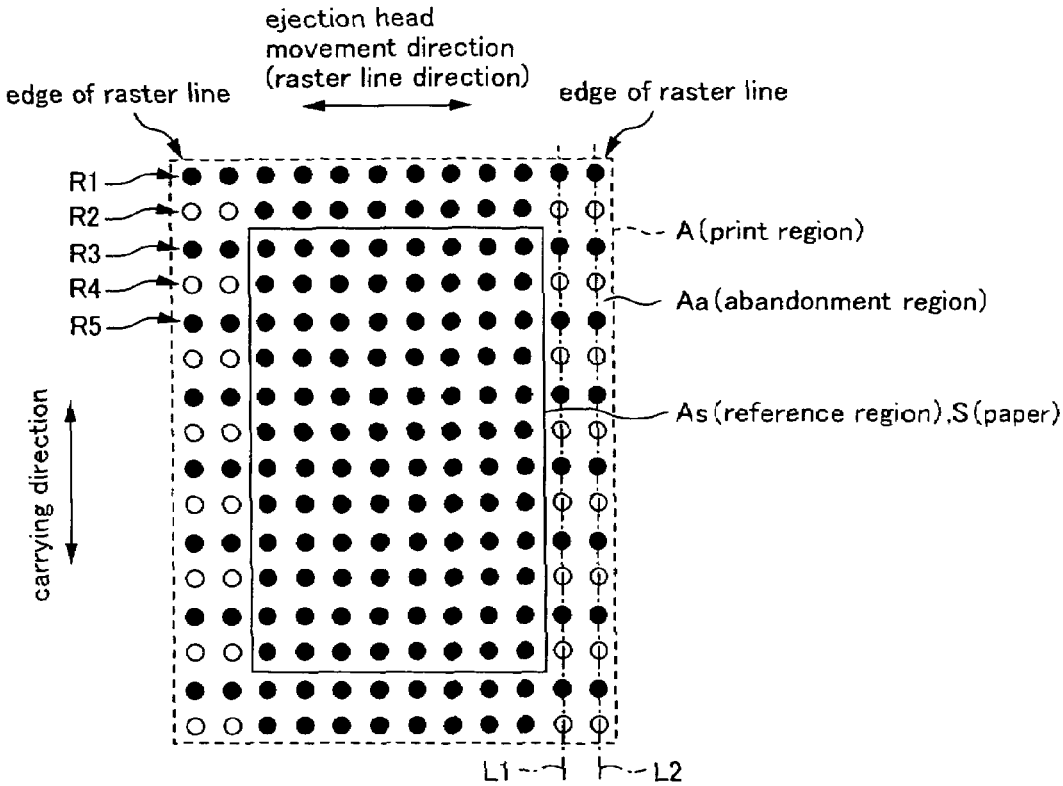
FIG. 15A is a plan view conceptually showing the thinned-out state.
Figure 15B:
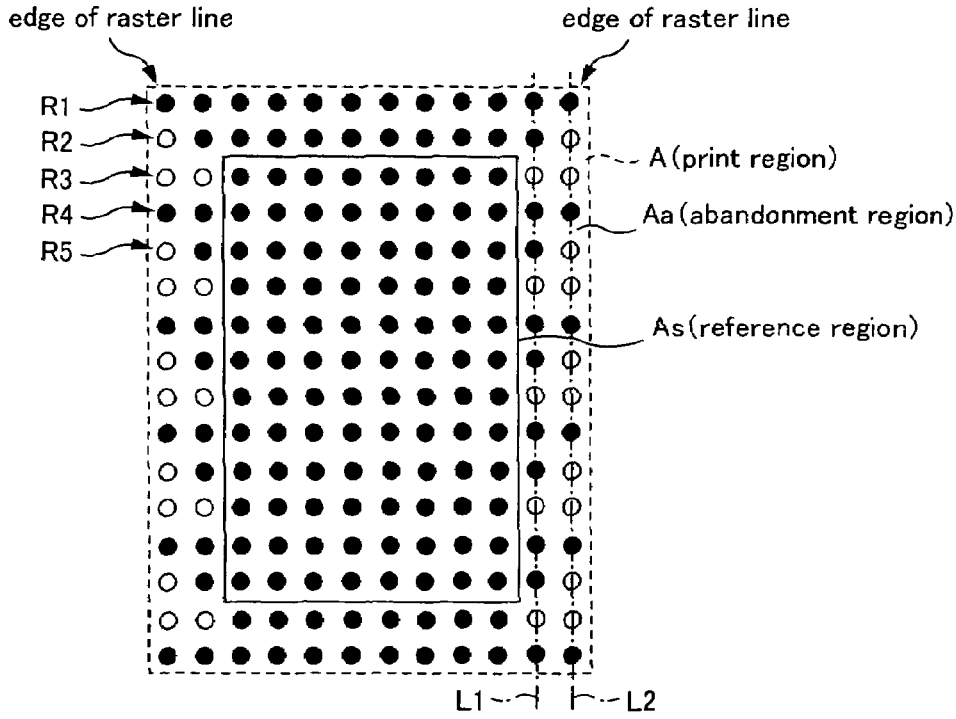
FIG. 15B is a plan view conceptually showing the thinned-out state.

Throughout this specification, to simplify explanations, the pixels are treated as being virtually present not only on the paper S, but also in the abandonment region Aa, which extends beyond the outer edges of the paper S, as shown in FIGS. 15A and 15B. Consequently, as shown in these figures, the "edge of the raster lines" mentioned below does not mean the edge of the paper S, but it means the lateral edge of the abandonment region Aa.

With the interlaced printing illustrated in FIG. 8A and FIG. 8B, each time the paper S is carried in the carrying direction by a constant carry amount F, each nozzle records a raster line immediately above the raster line that was recorded in the pass immediately before. In order to record the raster lines in this way using a constant carry amount, the number N (which is an integer) of nozzles that actually eject ink is set to be coprime to k, and the carry amount F is set to N·D.

In the figures, the nozzle row has four nozzles arranged in the carrying direction. However, since the nozzle pitch k of the nozzle row is 4, not all the nozzles can be used so that the condition for interlaced printing, that is, "N and k are coprime", is satisfied. Therefore, three of the four nozzles are used to perform interlaced printing. Furthermore, because three nozzles are used, the paper S is carried by a carry amount 3·D. As a result, for example a nozzle row with a nozzle pitch of 180 dpi (4·D) is used to form dots on the paper S at a dot pitch of 720 dpi (=D).

The figures show the manner in which consecutive raster lines are formed, with the first raster line being formed by the nozzle #1 of the third pass, the second raster line being formed by the nozzle #2 of the second pass, the third raster line being formed by the nozzle #3 of the the fourth pass. It should be noted that ink droplets are ejected only from the nozzle #3 in the first pass, and ink droplets are ejected only from the nozzle #2 and the nozzle #3 in the second pass. The reason for this is that if ink droplets were ejected from all of the nozzles in the first and second passes, it would not be possible to form consecutive raster lines on the paper S. From the third pass on, the three nozzles (#1 to #3) eject ink droplets and the paper S is carried by a constant carry amount F (=3-D), forming consecutive raster lines at the dot pitch D.

Regarding Overlap Printing

Figure 9A:
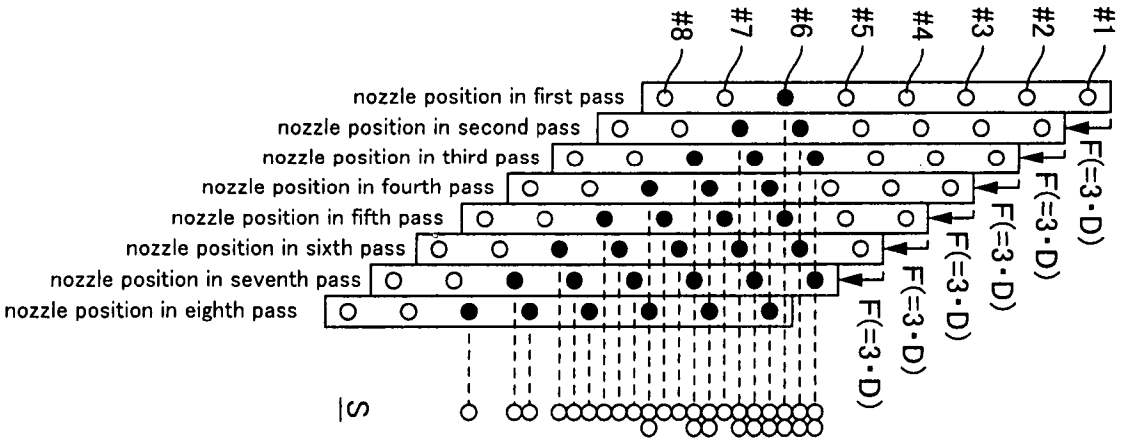
FIG. 9A is an explanatory diagram of ordinary overlap printing.
Figure 9B:
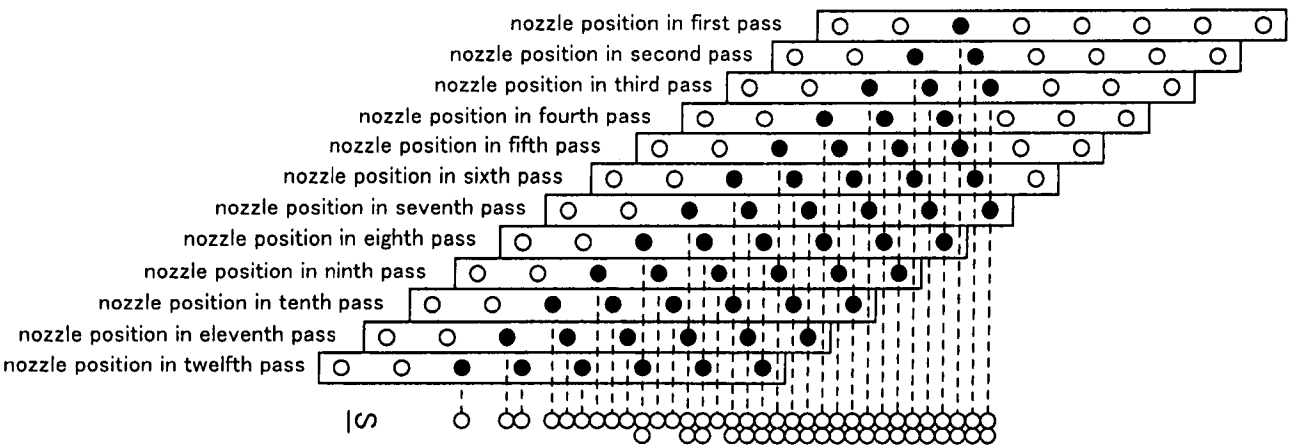
FIG. 9B is an explanatory diagram of ordinary overlap printing.

FIGS. 9A and 9B are explanatory diagrams of ordinary overlap printing. With the above-described interlaced printing, a single raster line is formed by a single nozzle, whereas with overlap printing, a single raster line is formed, for example, by two or more nozzles.

That is, with overlap printing, each time the paper S is carried by a constant carry amount F in the carrying direction, the nozzles, which move in the raster line direction, intermittently eject ink droplets every several dots, thereby intermittently forming dots in the raster line direction, which is the ejection head movement direction. Then, in another pass, dots are formed such that the intermittent dots already formed by other nozzles are completed in a complementary manner. Thus, a single raster line is completed by a plurality of nozzles. The number of passes M needed to complete a single raster line is defined as the "overlap number M". In the figure, since each nozzle forms dots intermittently at every other dot, dots are formed in every pass either at the odd-numbered pixels or at the even-numbered pixels. Since a single raster line is formed using two nozzles, the overlap number is M=2. It should be noted that the overlap number is M=1 in the case of interlaced printing described above.

In overlap printing, the following conditions are necessary in order to carry out recording with a constant carry amount: (1) N/M is an integer, (2) N/M and k are coprime, and (3) the carry amount F is set to (N/M)·D.

In the figures, the nozzle row has eight nozzles arranged in the carrying direction. However, since the nozzle pitch k of the nozzle row is 4, in order to fulfill the condition for performing overlap printing, which is that "N/M and k are coprime," not all the nozzles can be used. Therefore, six of the eight nozzles are used to perform overlap printing. Furthermore, because six nozzles are used, the paper S is carried by a carry amount 3·D. As a result, for example a nozzle row with a nozzle pitch of 180 dpi (4·D) is used to form dots on the paper S at a dot pitch of 720 dpi (=D). Furthermore, in a single pass, each nozzle forms dots intermittently in the ejection head movement direction at every other dot. In the figure, the raster lines in which two dots are written in the ejection head movement direction are already completed. For example, in FIG. 9A, the first through the sixth raster lines have already been completed. On the other hand, raster lines in which only one dot is written are raster lines in which dots have been formed intermittently at every other dot. For example, in the seventh and tenth raster lines, dots are formed intermittently at every other dot. It should be noted that the seventh raster line, in which dots have been intermittently formed at every other dot, is completed by having the nozzle #1 fill it up in the ninth pass.

The figures show the manner in which consecutive raster lines are formed, with the first raster line being formed by the nozzle #4 in the third pass and the nozzle #1 in the seventh pass, the second raster line being formed by the nozzle #5 in the second pass and the nozzle #2 in the sixth pass, the third raster line being formed by the nozzle #6 in the first pass and the nozzle #3 in the fifth pass, and the fourth raster line being formed by the nozzle #4 in the fourth pass and the nozzle #1 in the eighth pass. It should be noted that in the first to sixth passes, some of the nozzles #1 to #6 do not eject ink. The reason for this is that if ink were ejected from all of the nozzles in the first to sixth pass, it would not be possible to form consecutive raster lines on the paper S. From the seventh pass on, the six nozzles (#1 to #6) eject ink and the paper S is carried by a constant carry amount F (=3·D), forming consecutive raster lines at the dot pitch D.

TABLE 1

| pass | first pass | second pass | third pass | fourth pass | fifth pass | sixth pass | seventh pass | eighth pass |
|---|---|---|---|---|---|---|---|---|
| recorded pixel | odd | even | odd | even | even | odd | even | odd |

Table 1 describes the positions in the ejection head movement direction where dots are formed in each pass. In the table, "odd" means that dots are formed at odd-numbered pixels of the pixels lined up in the ejection head movement direction (pixels in a raster line). Moreover, "even" in the table means that dots are formed at even-numbered pixels of the pixels lined up in the ejection head movement direction. For example, in the third pass, the nozzles form dots at odd-numbered pixels. When a single raster line is formed by M nozzles, k×M passes are required in order to complete a number of raster lines corresponding to the nozzle pitch. For example, in this embodiment, a single raster line is formed by two nozzles, so that 8 (4×2) passes are required in order to complete four raster lines. As can be seen from Table 1, in the four passes during the first half, dots are formed in the order of odd-even-odd-even. Consequently, when the four passes during the first half have been finished, dots are formed at even-numbered pixels in raster lines adjacent to raster lines in which dots are formed at odd-numbered pixels. In the four passes during the second half, dots are formed in the order of even-odd-even-odd. In other words, in the four passes during the second half, dots are formed in reverse order with respect to the four passes during the first half. Consequently, dots are formed so as to fill up gaps between the dots that have been formed in the passes during the first half.

Borderless Printing

"Borderless printing" is described below. "Borderless printing" is a method of printing in which no margins are formed at the edge portions of the print paper S. In the inkjet printer 1 according to this embodiment, by selecting the print mode it is possible to execute either "borderless printing" or "regular printing."

Figure 10:
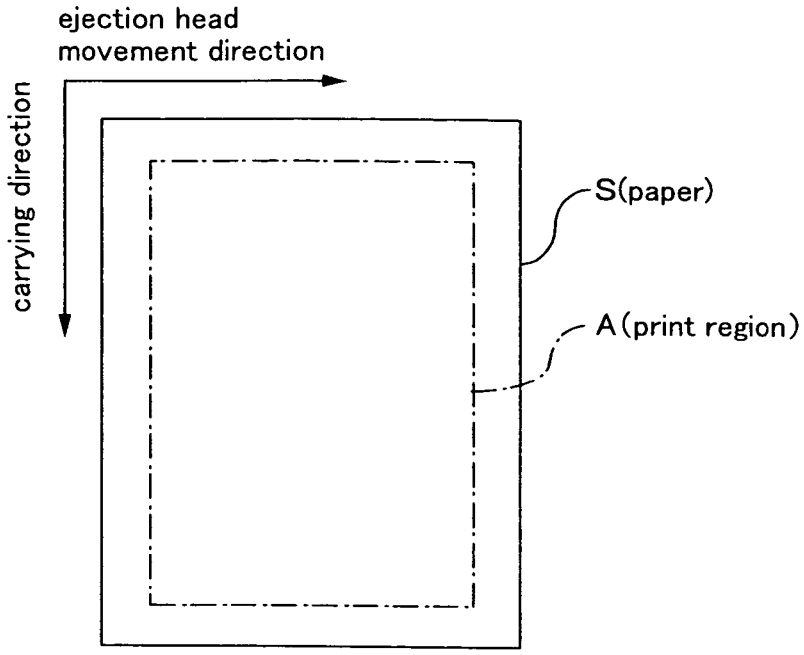
FIG. 10 is an explanatory diagram illustrating the relationship between the size of the print region A and the paper S during ordinary printing.

In "regular printing," printing is performed in such a manner that the print region A, which is the region onto which ink droplets are ejected, fits on the print paper S. FIG. 10 shows the relationship between the sizes of the print region A and the paper S during "regular printing." The print region A is set such that it fits on the paper S, and margins are formed at the upper and lower edges as well as at the left and right edges of the paper S.

When "regular print mode" is set as the print mode in order to perform "regular printing," the printer driver 96 generates print data PD so that the print region A fits on the paper S based on image data received from the application program. For example, when processing image data in which the print region A does not fit within the paper S, a portion of the image that is expressed by the image data is disregarded when printing or the image is shrunken, for example, so that the print region A fits on the paper S.

Figure 11:
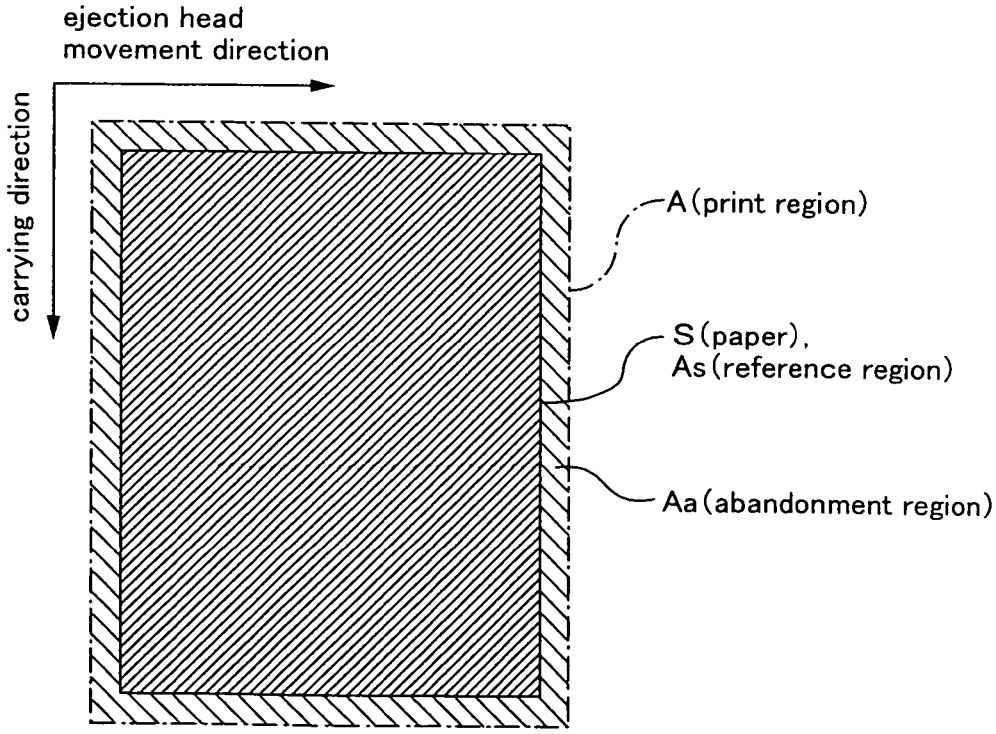
FIG. 11 is an explanatory diagram illustrating the relationship between the size of the print region A and the paper S during borderless printing.

FIG. 11 shows the relationship between the sizes of the print region A and the paper S during "borderless printing." The print region A is also set with respect to a region that extends beyond the top and bottom edges and the left and right edges of the paper S (hereinafter, referred to as the abandonment region Aa), and ink droplets are ejected onto this region as well. Thus, even when the position of the paper S is somewhat shifted with respect to the ejection head 21 as a result of the positioning accuracy when the paper is carried, for example, ink droplets can be reliably ejected toward the edge portions of the paper S to form dots thereon, thereby preventing margins from being formed at the edge portions. It should be noted that "borderless printing" does not always have to be performed with respect to all of the top and bottom edge portions and the left and right edge portions of the paper S as shown in FIG. 11, and sometimes it may also be performed for only one of these edge portions.

When the "borderless print mode" has been set as the print mode in order to perform "borderless printing," the printer driver 96 generates print data PD in which the print region A extends beyond the paper S by a predetermined width, based on the image data. For example, when processing image data in which the print region A is smaller than the paper S, the image is enlarged so that the print region A covers the entire paper S and extends beyond the paper S by the predetermined amount. Conversely, when processing image data in which the print region A extends significantly beyond the paper S, the image is shrunken so that the amount by which the print region extends beyond the paper S becomes the predetermined width. It should be noted that when performing scaling adjustment through enlarging or shrinking in order to ensure the predetermined width, if the aspect ratio of the image is changed from that of the original image and the image is distorted, a portion of the image may be eliminated from the printing target after the scaling adjustment so that the predetermined width is secured while maintaining the aspect ratio of the original image.

Describing this adjustment by scaling in more detail, the printer driver 96 stores a region having the same size as the standard size of the paper S in the memory 65 as a reference region As. The printer driver 96 references the reference region As to generate print data PD by expanding the image data to a size where it extends outside the reference region As by the predetermined width in the ejection head movement direction and the carrying direction. The portion corresponding to this predetermined width is the region that is determined to be outside of the paper S, and is the abandonment region Aa in which ink droplets are abandoned.

The reference region As and the predetermined width are stored in the memory 65 for each paper size, such as postcard size and A4 size, and are read individually based on the paper size information that is input by the user and then used for the above-described scaling adjustment.

Incidentally, if paper carrying is performed correctly and the paper S is precisely positioned in a predetermined design position, then the reference region As will match the paper S and the image in the reference region As will be printed on the paper S. However, if there is a positional shift, then the image of the abandonment region Aa will be printed onto the edge portions of the paper S.

Processing the Abandoned Ink

In "borderless printing," abandoned ink droplets that land outside the paper S can have negative effects, such as adhering to the platen 14 and making it dirty. For this reason, the platen 14 of the printer 1 according to this embodiment is provided with an ink collection section 80 for collecting ink droplets that have missed the paper S.

Figure 12:
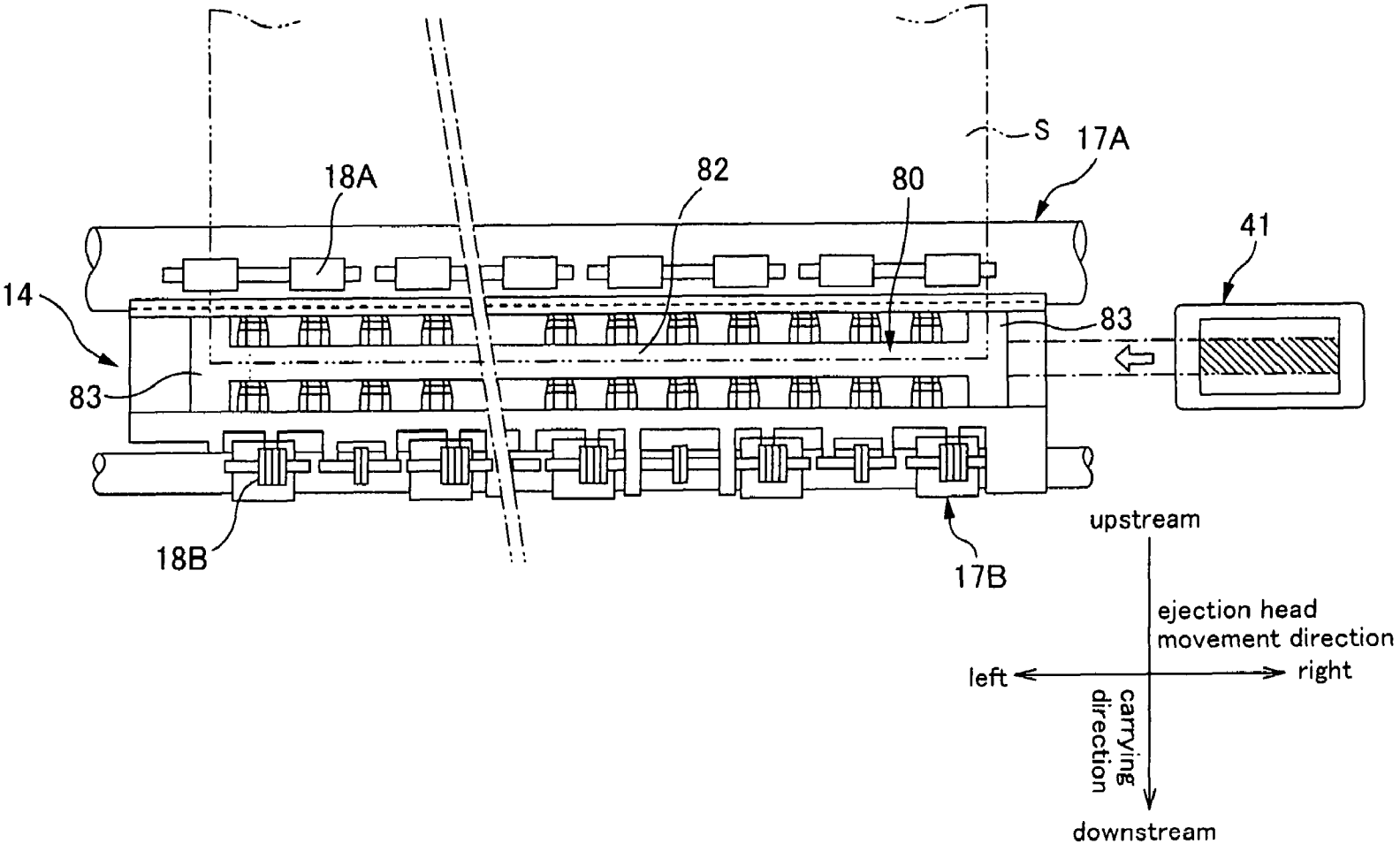
FIG. 12 is a plan view showing an ink collection section 80.

FIG. 12 is a plan view of the ink collection section 80. The ink collection section 80 is broadly divided into two sections, these being a first ink collection section 82 shown in the cross-sectional views of FIGS. 13A and 13B and a second ink collection section 83 shown in the cross-sectional view of FIG. 14. The first ink collection section 82 is used when performing borderless printing with respect to the top and bottom edge portions of the paper S, and the second ink collection section 83 is used when performing borderless printing with respect to the left and right edges of the paper S.

Figure 13A:
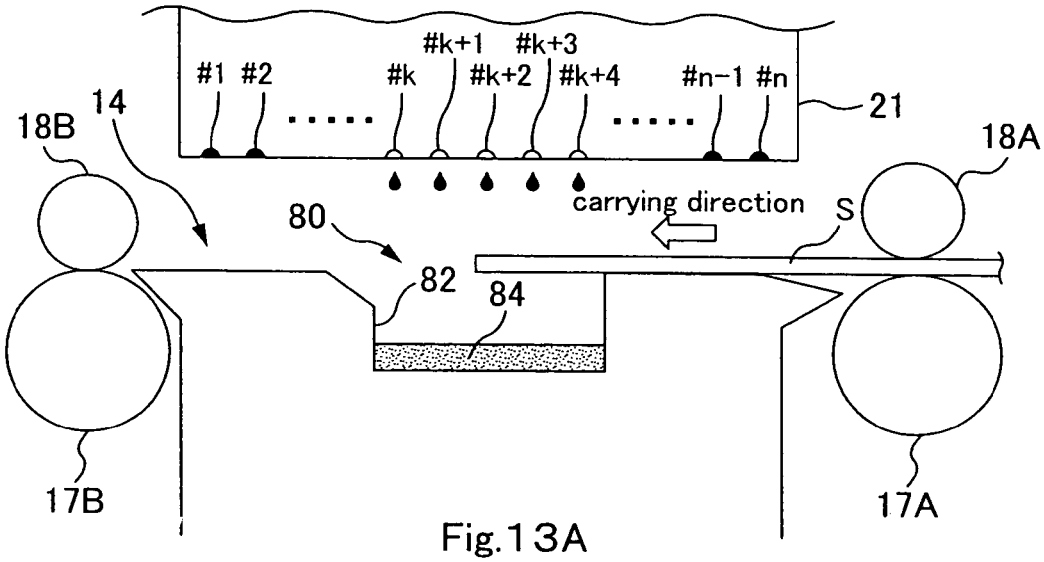
FIG. 13A is a cross-sectional view showing a first ink collection section 82.
Figure 13B:
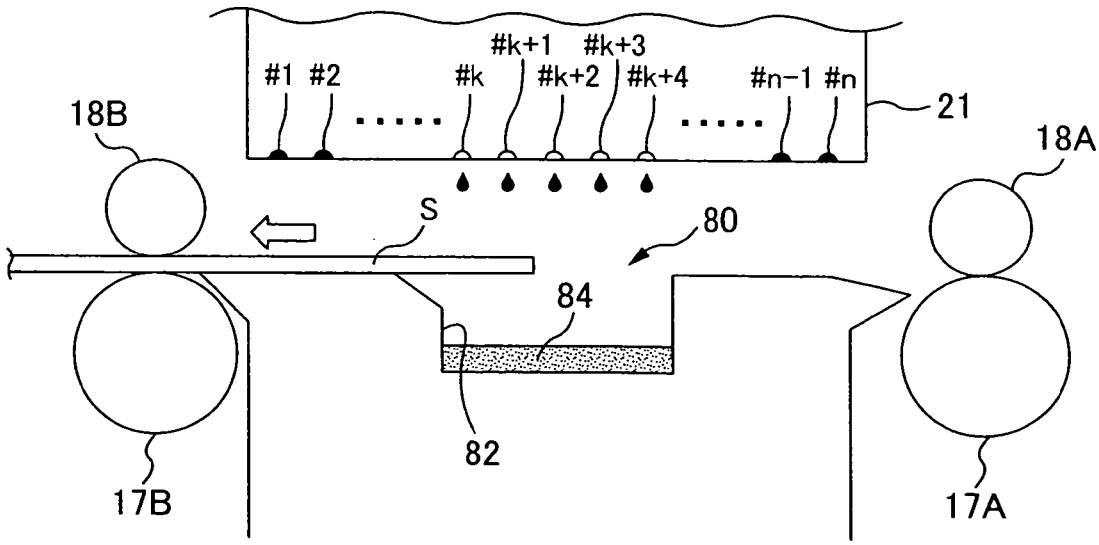
FIG. 13B is a cross-sectional view showing a first ink collection section 82.
Figure 14:
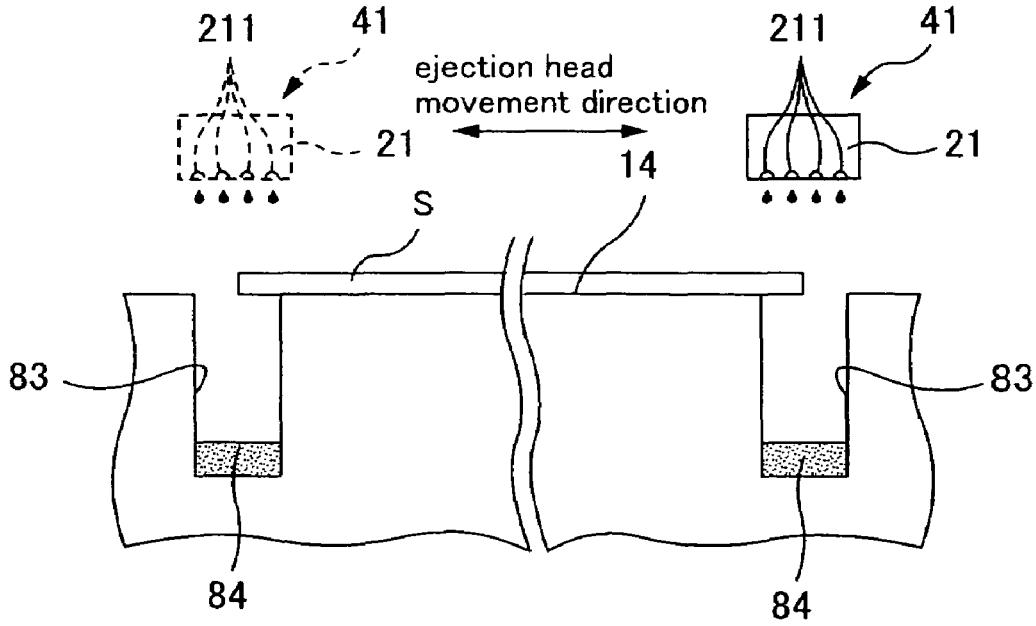
FIG. 14 is a cross-sectional view showing a second ink collection section 83.

As shown in FIGS. 12 to 14, both of the first and second ink collection sections 82 and 83 are formed in the platen 14 as grooves having a depressed cross-sectional shape. An absorbing member 84 such as a sponge for absorbing ink droplets is arranged in the grove portions. The abandoned ink droplets reach the top of the absorbing member 84 and are absorbed by the absorbing member 84.

The groove portion of the first ink collection section 82 shown in FIGS. 12, 13A and 13B is arranged in a straight line along the movement direction of the carriage 41 (ejection head movement direction), and the position of the groove in the carrying direction is in opposition to substantially the middle of the ejection head 21, that is, it is in opposition to nozzles #k to #k+4. Consequently, when borderless printing is performed with respect to the top edge portion as shown in FIG. 13A, ink droplets are ejected only from the nozzles #k to #k+4 prior to the top edge of the paper S arriving at the first ink collection section 82. On the other hand, when borderless printing is performed with respect to the bottom edge portion, then as shown in FIG. 13B, ink droplets are ejected only from the nozzles #k to #k+4 after the bottom edge portion of the paper S has passed over the first ink collection section 82. Then, while printing these top and bottom edge portions, ink droplets ejected from the nozzles #k to #k+4 that have not landed on the paper S land on the absorbing member 84 in the first ink collection section 82, and thus the upper surface of the platen 14 will not become dirty due to these abandoned ink droplets.

The groove portions of the second ink collection section 83 shown in FIGS. 12 and 14 are provided at positions where they are in opposition to the left and right edge portions of the paper S, and both of these groove portions are formed in straight lines in the carrying direction of the paper S. When borderless printing is performed with respect to the left and right edge portions, ink droplets are ejected from nozzles during movement of the carriage 41 not only when the carriage 41 is moving over the print paper S but also when it is moving over the abandonment region Aa outside the lateral edge portions of the paper S. Here, ink droplets ejected onto the abandonment region Aa land on the absorbing member 84 in the second ink collection sections 83, so that the platen 14 will not become dirty due to these abandoned ink droplets.

Regarding the Process of Thinning Out Ink Droplets During Borderless Printing

As mentioned above, it is necessary to set the aforementioned abandonment region Aa in order to perform "borderless printing", but most of the ink droplets ejected toward this abandonment region Aa do not contribute to the formation of the image and are wasted, so that it is desirable to make the number of ink droplets ejected toward the abandonment region as small as possible. Also, these abandoned ink droplets are ejected with the goal of not forming a margin at the edges of the paper S, and considering this aspect, it seems to be sufficient if the number of ink droplets is decreased by thinning the number of ink droplets to an extent that no empty portions that can be perceived as a margin at the edges are formed in the image, that is, to an extent that does not become conspicuous.

Consequently, in accordance with the present invention, ejection is performed after a suitable number of ink droplets is thinned out from the ink droplets to be ejected toward the abandonment region Aa, that is, the region that is determined to be outside the paper S, to an extent that does not become readily apparent.

FIGS. 15A and 15B are plan views schematically showing the thinned state at this abandonment region Aa, and show the print region A based on the print data PD overlaid over the reference region As that corresponds to the paper S. It should be noted that in these figures, pixels onto which ink droplets are ejected are marked as black circles, whereas thinned out pixels onto which no ink droplets are ejected are marked as white circles. Also, for the sake of explanation, the uppermost raster line in the figures is referred to as the first raster line R1. Thereafter, in downward direction, the raster lines are successively referred to as the second raster line R2, the third raster line R3, etc.

In the example shown in FIG. 15A, the ink droplets ejected onto the abandonment region are thinned out at every other line of the raster lines R1, R2, etc. lined up in the carrying direction. That is to say, ink droplets are not ejected onto the abandonment region Aa at raster lines (for example R2 and R4) that sandwich, with respect to the carrying direction, a raster line in which ink droplets are ejected onto the abandonment region Aa (for example R3).

In the example shown in FIG. 15B, there is no thinning in the first raster line R1. In the second raster line R2 below that, one pixel each is thinned out from both edges, and in the third raster line R3 further below, two pixels each are thinned out from both edges. This pattern is repeated in that order in the following raster lines R4, R5 . . . . A plurality of thinning regions of triangular shape when viewed from above are formed along the carrying direction in the thusly thinned out abandonment region Aa.

It should be noted that in both of these two examples, the ratio of thinned out ink droplets with respect to a unit surface area of the abandonment region Aa is the same. That is to say, one out of every two pixels is thinned out. However, if ink droplets are thinned out at the same ratio, then it is preferable that the ratio by which ink droplets are thinned out is increased toward the edges in the raster line direction, as shown in FIG. 15B. Describing this in more detail, when the abandonment regions Aa shown in FIG. 15A and FIG. 15B are viewed along the carrying direction, there are two pixels rows L1 and L2 extending along the carrying direction formed in the abandonment region Aa. In the example of FIG. 15A, one out of every two pixels is thinned out in both the pixel row L1 on the inner side and in the pixel row L2 outward of this pixel row L1. On the other hand, in the example of FIG. 15B, one out of every three pixels is thinned out in the pixel row L1 on the inner side, whereas two out of every three pixels are thinned out in the pixel row L2 on the outer side. Thus, in this FIG. 15B, the ratio by which ink droplets are thinned out increases away from the edge in the raster line direction.

The reason why the example in FIG. 15B is preferable is because, the farther the position is from the reference region As, which corresponds to the size of the paper S, the lower the possibility that the position of the paper S will shift to such a far position, and the lower the possibility that the effect of thinning the ink droplets will become visible as empty portions in the image on the paper S.

The selection of whether this thinning process is carried out or not can be made for example with the user interface display module 101. That is to say, a button for instructing execution and a button for instructing non-execution of the thinning process are selectably displayed in a window for the printer driver of the user interface display module 101, and the user can choose whether or not to carry out the thinning process with these buttons.

Figure 15C:
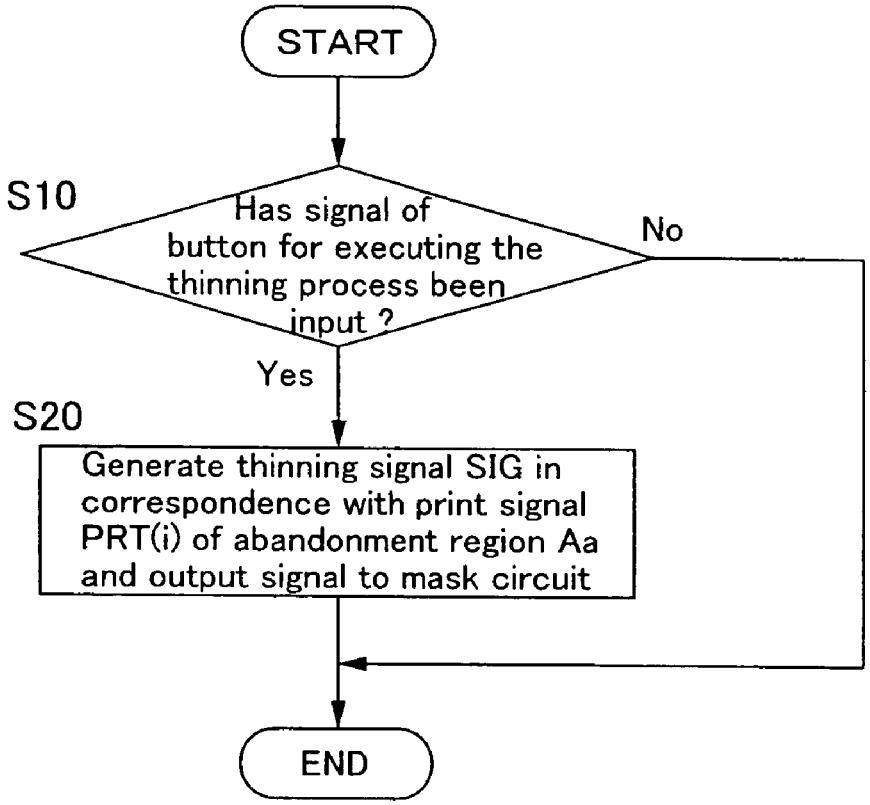
FIG. 15C is a flowchart of the thinning processing section 224.

It should be noted that a signal for the selected button is output to the printer 1, in association with the print data PD that is generated by the printer driver. Then, as shown in the flowchart in FIG. 15C, if the signal of the non-execution button has been associated, the thinning processing section 224 of FIG. 6 in the head driver 22 does nothing, whereas if the signal of the execution button has been associated, the thinning processing section 224 generates a thinning signal SIG so as to achieve the above-described thinned-out state, and sends this thinning signal SIG to the mask circuits 222 in correspondence with the print signals PRT(i) entered into the mask circuits 222 (see Steps S10 and S20). That is to say, the thinning signal SIG is given into the mask circuits 222 in addition to the print signals PRT(i), and whether ink droplets are ejected toward the pixels corresponding to the print signals PRT(i) is determined by the logical product (so-called AND) of the print signal PRT(i) and the thinning signal SIG. The thinning signal SIG is set for each pixel of the abandonment region Aa, and it is set to level 0 for the pixels in this region Aa onto which no ink droplets are ejected, whereas it is set to level 1 for the pixels onto which ink droplets are ejected.

Incidentally, to simplify explanations, it is assumed that the print data PD in the examples of FIG. 15A and FIG. 15B is data for a solid image in which ink droplets are ejected over the entire surface of the print region Aa, that is, the print signals PRT(i) of the entire print data PD are at level 1. On the other hand, in the actual print data PD, there may be pixels in which the print signal PRT(i) is at level 0; therefore, the actual thinned-out state that is apparent on an actually-printed paper S is a cross of the two, that is, also pixels marked by black circles in the abandonment region Aa may become white circles, depending on the print signal PRT(i). It should be noted that also in the following explanations, it is assumed that the print data PD is data for recording solid images.

Examples of the Thinning Process

As an example of the thinning process, an example is explained in which borderless printing is performed at the right edge of the paper S. As for the print mode, explanations are given for interlaced printing and for overlap printing, respectively.

FIGS. 16 to 31 are diagrams showing by which nozzle and in which pass the raster lines in the vicinity of the right edge of the print paper S are formed. The portion on the left side (referred to as left diagram in the following) in the figures indicates the relative position of the nozzle row with respect to the paper S in each pass. It should be noted that in the left diagrams, for illustrative reasons, the nozzle row is shown moving downward in increments of the carry amount F for each pass, but in actuality the paper S is moved in the carrying direction. The nozzle numbers in the nozzle row are shown as circled numbers.

To the right of the left diagram it is shown how ink droplets are ejected toward the reference region As and the abandonment region Aa (referred to as right diagram in the following). The square boxes in the right diagram each represent one pixel, and the numbers written into these boxes indicate the number of the nozzle ejecting ink droplets toward that pixel. Also, pixels into which no nozzle number is written are pixels onto which no ink droplet is ejected, that is, pixels that are thinned out by the thinning process. It should be noted that the thin-out numbers shown below the left diagram indicate the number of pixels that are thinned out from the abandonment region Aa in each pass.

On the right-hand side of the right diagram, there is the lateral edge of the reference region As, and even further to the right, an abandonment region Aa whose width in the ejection head movement direction is eight pixels (FIGS. 16 through 23) or 32 pixels (FIGS. 24 through 31) is set, and the edges of the raster lines are located at the outer border of the abandonment region Aa.

For the sake of explanation, the uppermost raster line in the figures is referred to as the first raster line R1. Thereafter, in downward direction, the raster lines are successively referred to as the second raster line R2, the third raster line R3, and so forth. Also, the right diagram selectively shows only a portion with respect to the carrying direction, but needless to say, raster lines are formed consecutively also above the uppermost first raster line R1 and below the lowermost twenty-fifth raster line R25 in the figure.

The thinning processing section 224 according to the present embodiment forms the thinning signal SIG in accordance with the following four rules, and inputs the thinning signal SIG into the mask circuits 222 in correspondence with the print signals PRT(i), thus thinning the number of ink droplets in the abandonment region Aa.

Rule 1:

The thin-out number, which is the number of pixels onto which no ink droplets are ejected, is set for every single pass (for every movement of the ejection head). This thin-out number is set as a common value for all nozzles, and in that pass, the positions of the thinned out pixels in the ejection head movement direction are the same for all nozzles.

Figure 16:
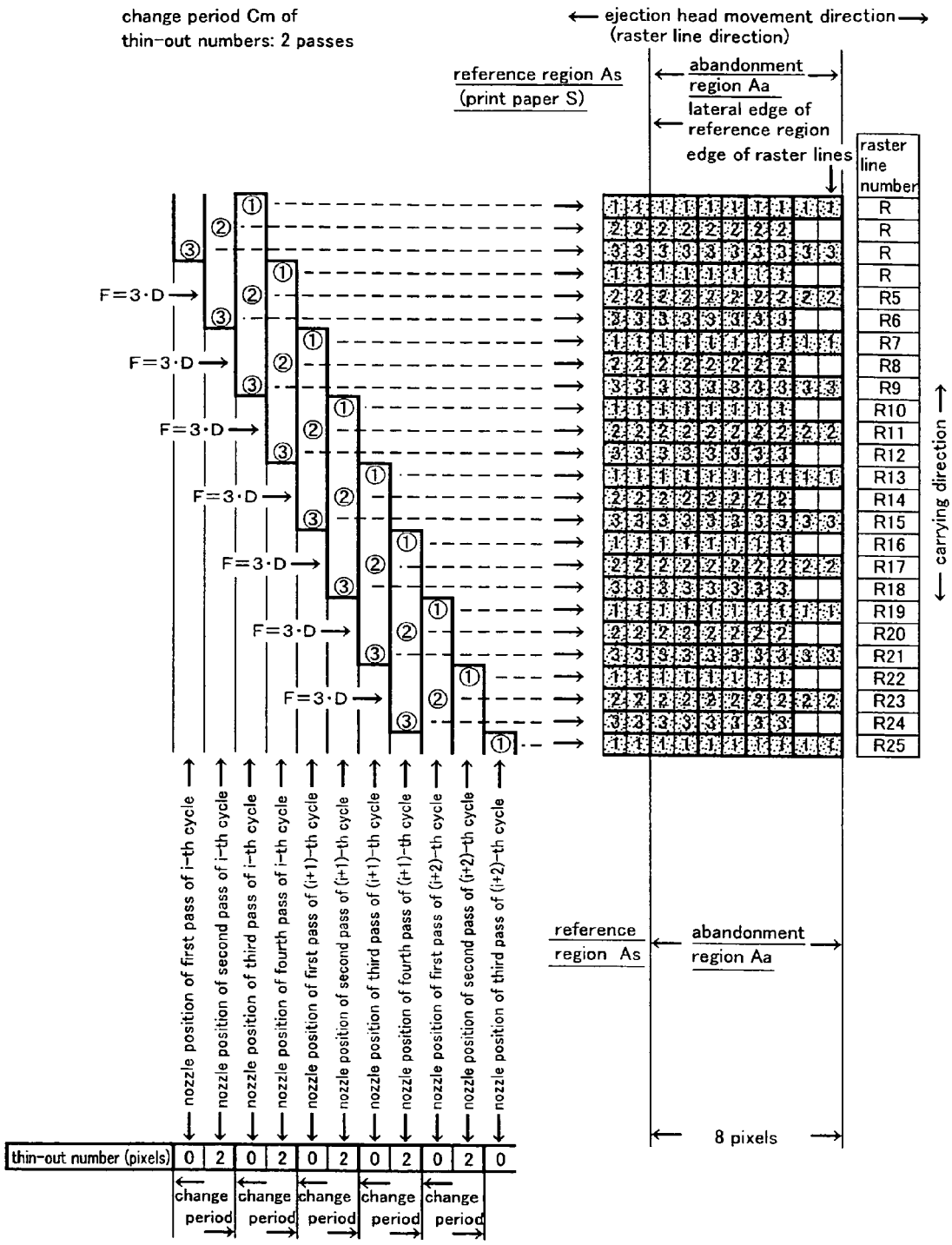
FIG. 16 is an explanatory diagram showing an example of the thinning process during interlaced printing.

This Rule 1 is explained with the example of interlaced printing shown in FIG. 16. In the fourth pass shown in the left diagram, the fourth, the eighth and the twelfth raster lines R4, R8 and R12 are respectively formed by the nozzles #1, #2 and #3, and in this fourth pass, the thin-out number is set to 2, as shown below the left diagram. Consequently, none of the three nozzles #1, #2 and #3 eject ink droplets onto two of the pixels in the raster lines that they form. Moreover, the position of those pixels in the ejection head movement direction is the same for all three nozzles #1, #2 and #3, and in the example shown in the figure, the first and the second pixel from the edge are thinned out from the raster lines R4, R8 and R12.

Rule 2:

The positions of the thinned out pixels in the ejection head movement direction in each pass are selected from the positions onto which ink droplets can be ejected in that single pass, and the pixels at the positions that are candidates for selection are set by counting up to the thin-out number from the edges of the raster lines.

Figure 25:
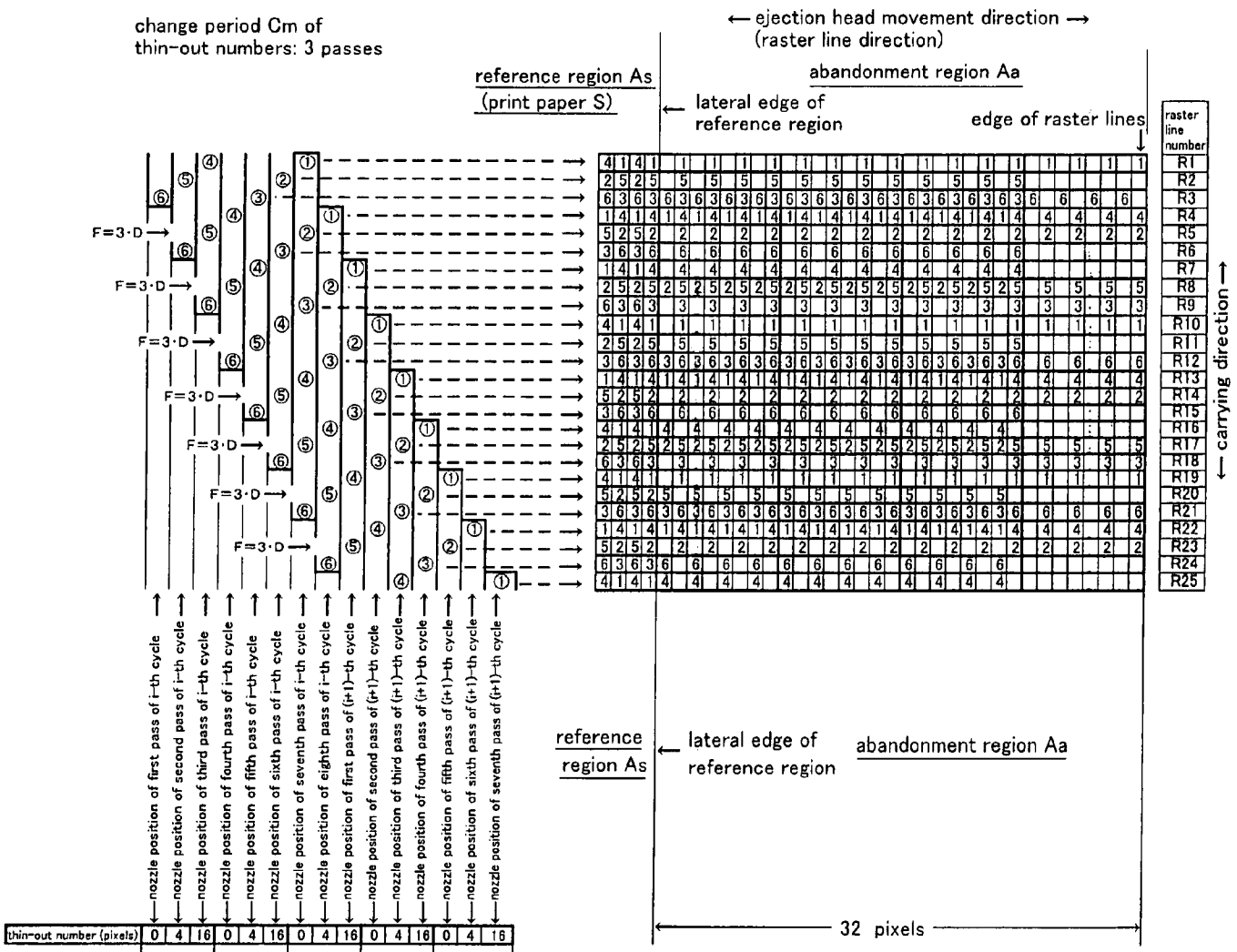
FIG. 25 is an explanatory diagram showing an example of the thinning process during overlap printing.

Explaining this Rule 2 in more detail with reference to FIGS. 16 and 25, in the case of interlaced printing shown in FIG. 16, ink droplets can be ejected onto all pixels lined up in the raster line direction in a single pass. Consequently, the positions of the thinned out pixels in the ejection head movement direction in the fourth pass in the left diagram are designated by counting the pixels up to the thin-out number 2 for the fourth pass from the edge of each of the raster lines R4, R8 and R12 as shown in the right diagram, thus designating two consecutive pixels from the edge.

On the other hand, in the case of overlap printing as shown in FIG. 25, ink droplets can be ejected only intermittently in a single pass at every M−1 pixels onto the pixels lined up in the raster line direction. For example, if the overlap number M is 2, then ink droplets can be ejected only onto odd-numbered pixels in the raster line direction in a given single pass, whereas the ink droplets for the even-numbered pixels between these odd-numbered pixels can only be ejected in another single pass. Consequently, in the case of overlap printing, the thinned out pixels in each pass are designated by counting every (M−1)-th one of the pixels making up the raster line up to the thin-out number from the edge. This is explained in further detail with reference to the example in FIG. 25. In the third pass in this example, ink droplets can be ejected onto the odd-numbered pixels of the first, fifth and ninth raster lines R1, R5 and R9, and the thin-out number of this third pass is set to 16, as shown below the left diagram. Consequently, the designation is performed by counting 16 of the odd-numbered pixels from the edge of each of the raster lines R1, R5 and R9, and no ink droplets are ejected onto these designated 16 pixels. It should be noted that since the 16 pixels are designated for every other pixel, the result is that pixels located up to the $32^{rd}$ pixel from the edge of the raster lines are designated.

Rule 3:

The thin-out number changes for each pass, in accordance with a predetermined change pattern. The pass number Cm through which the thin-out numbers cycle in accordance with the change pattern is referred to as the change period Cm of the thin-out numbers.

This Rule 3 is explained in more detail with reference to FIG. 16. Below the left diagram, the thin-out number corresponding to each pass is shown. In the example of this figure, the change pattern is such a pattern that repeats the thin-out numbers 0 and 2 in each pass, and the change period Cm, which is the number of passes through which this change pattern cycles, is 2 passes. That is to say, in this example, the thin-out number of the first pass is 0, and the thin-out number of the second pass is 2, and in the following passes, this is repeated in this order.

Rule 4:

The change pattern of the thin-out number is as follows. Here, j is an integer of 1 or greater.

TABLE 2

| pass | first pass | second pass | third pass | fourth pass | fifth pass | sixth pass | seventh pass | eighth pass | ninth pass |
|---|---|---|---|---|---|---|---|---|---|
| thin-out number (pixels) | 0 | j | 4j | 2j | 0 | 3j | 2j | 4j | 0 |

j is an integer of 1 or greater.

It should be noted that if a number smaller than nine passes is set as the change period Cm, then the thin-out number of the passes until that set number is repeated. For example, if the change period Cm is set to 3 passes, then 0, j and 4j (where j is an integer of 1 or greater), which are the thin-out numbers of the first to third passes in Table 2, are repeated in that order. Incidentally, the change pattern shown in Table 2 is the pattern that is most preferable with regard to scattering the thinned-out state, and has been found through the "discussion of preferable change patterns" further below.

Example of the Thinning Process for Interlaced Printing

FIGS. 16 through 23 show an example of the thinning process for the case of interlaced printing. In FIGS. 16 to 23, the change period Cm of the thin-out numbers is different in each drawing, thus illustrating the influence of the change period Cm on the thinned-out state. However, the conditions for interlaced printing are the same in all figures. That is to say, the nozzle number N ejecting ink droplets is N=3, the nozzle pitch is k·D=4·D, and the carry amount is F(=N·D) =3·D.

First, the raster line formation process with interlaced printing is explained with reference to FIG. 16. It should be noted that since interlaced printing has been explained before, only the aspects that are necessary for the understanding of the present example are explained here.

As shown in FIG. 16, in the third pass, the first raster line R1 is formed by the nozzle #1, the fifth raster line R5 is formed by the nozzle #2, and the ninth raster line R9 is formed by the nozzle #3. The second, third and fourth raster lines R2, R3 and R4 that lie between the first raster line R1 and the fifth raster line R5 are formed by the nozzle #2 in the second pass, the nozzle #3 in the first pass and the nozzle #1 in the fourth pass, respectively. This means that in order to consecutively form the first to fifth raster lines, a total of four passes from the first pass to the fourth pass are necessary. In other words, in the interlaced printing according to the present example, four passes form one cycle, and raster lines are formed consecutively at a dot pitch D in the carrying direction by repeating this cycle. In the following, this one cycle is referred to as "interlacing cycle." In the figures, the first interlacing cycle, which is made of four passes, is taken to be the i-th cycle, and the interlacing cycle made of the next four passes is taken to be the (i+1)-th cycle.

The following is an explanation of the thinning process in the abandonment region Aa.

As shown in FIG. 16, an abandonment region Aa with a width of eight pixels in the ejection head movement direction is set to the right of the reference region As, and the edges of the raster lines are located at the outer border of this abandonment region Aa. Moreover, in each pass, a thinning process based on the thin-out number corresponding to that pass is performed, so that when forming the raster lines of each pass, a number of pixels corresponding to the thin-out number is counted from the edge of each raster line and designated, and no ink droplets are ejected onto the designated pixels. It should be noted that to facilitate the drawings, the number of pixels in the ejection head movement direction constituting the abandonment region Aa has been set to eight, but there is no limitation to this.

As shown below the left diagram in FIGS. 16 to 23, the change period Cm of the thin-out number is changed from two to nine passes from FIG. 16 to FIG. 23, respectively. The change pattern of the thin-out number for these examples is obtained by setting the value j in Table 2 to "2". For example, in the case of FIG. 16 where the change period Cm is 2 passes, the thin-out number for each pass repeats the cycle of 0 and 2. Further, in the case of FIG. 16 where the change period Cm is 3 passes, the thin-out number repeats the cycle of 0, 2, and 8. As for the four to nine passes in FIGS. 18 to 23, every time the change period Cm increases by one, one of the numbers 4, 0, 6, 4, 8 and 0 is added in this order as the thin-out number of the corresponding fourth and further passes.

Figure 17:
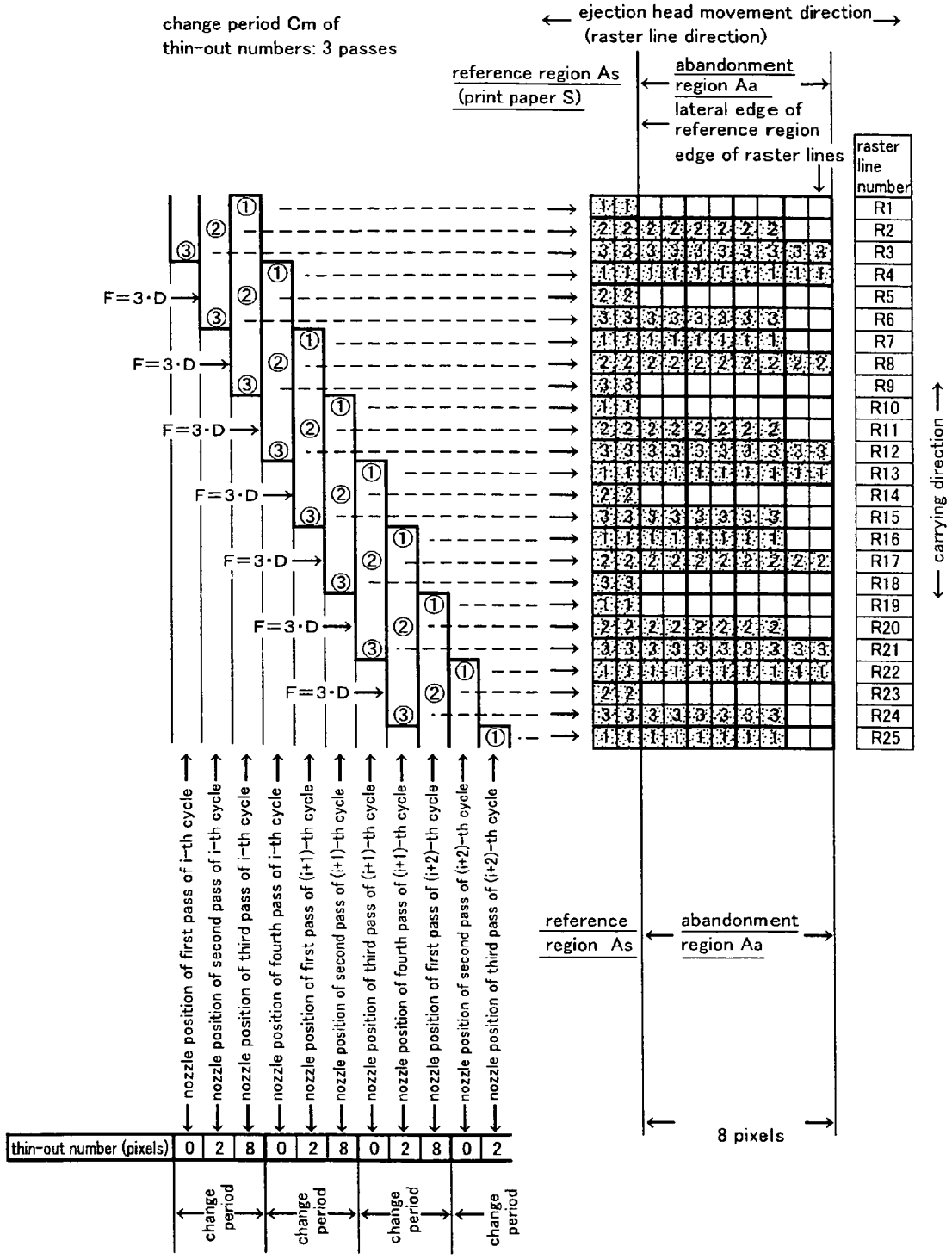
FIG. 17 is an explanatory diagram showing an example of the thinning process during interlaced printing.
Figure 18:
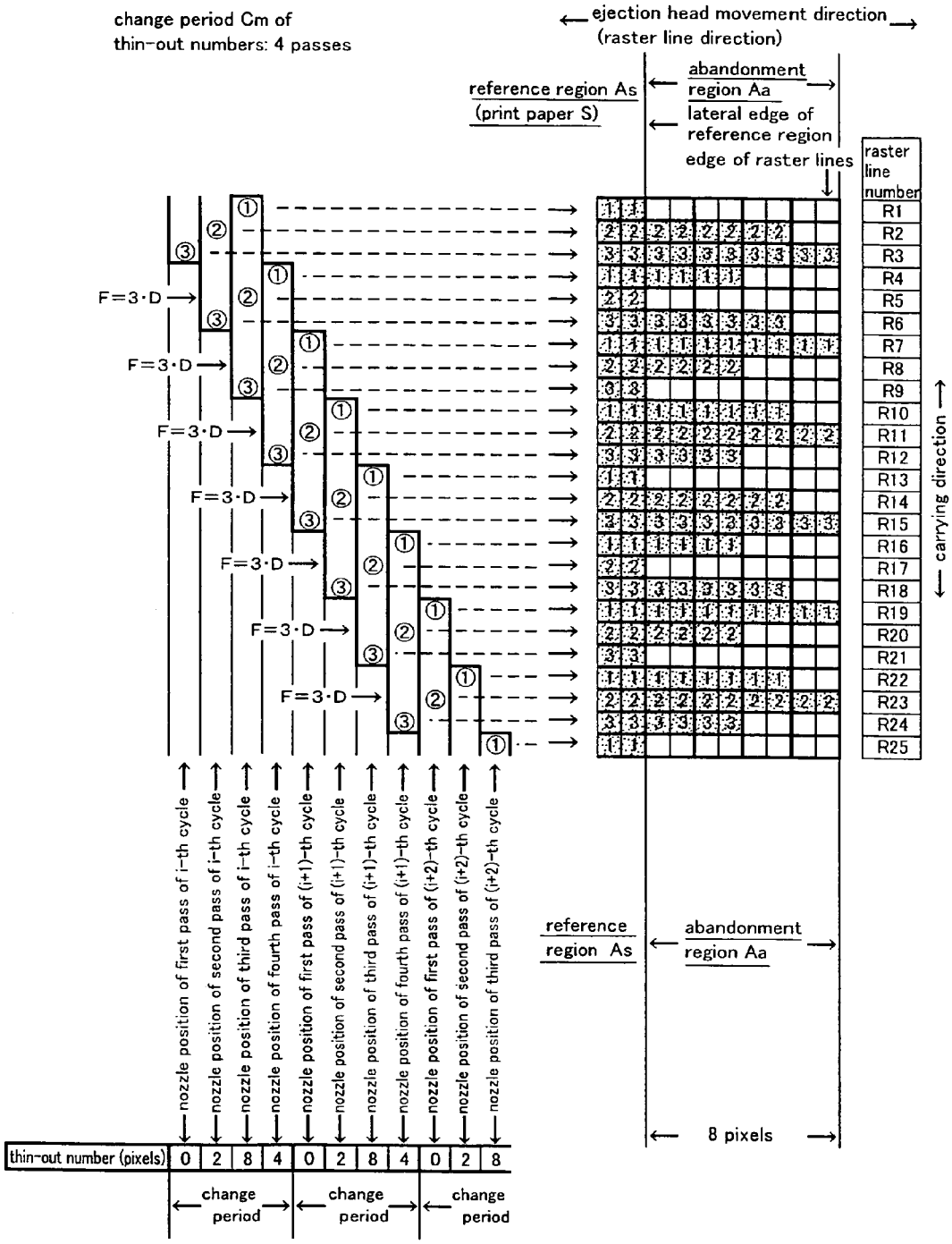
FIG. 18 is an explanatory diagram showing an example of the thinning process during interlaced printing.
Figure 19:
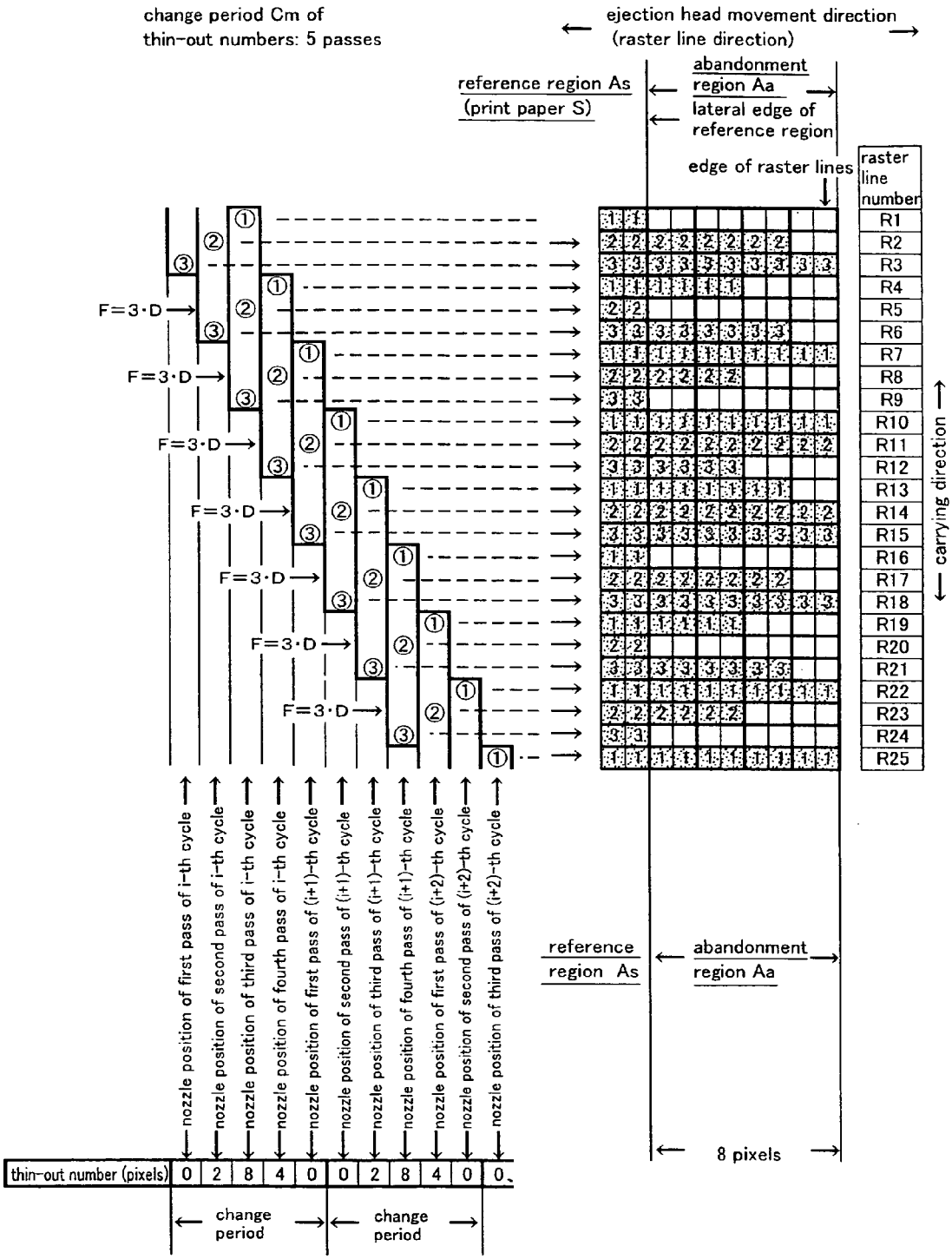
FIG. 19 is an explanatory diagram showing an example of the thinning process during interlaced printing.
Figure 20:
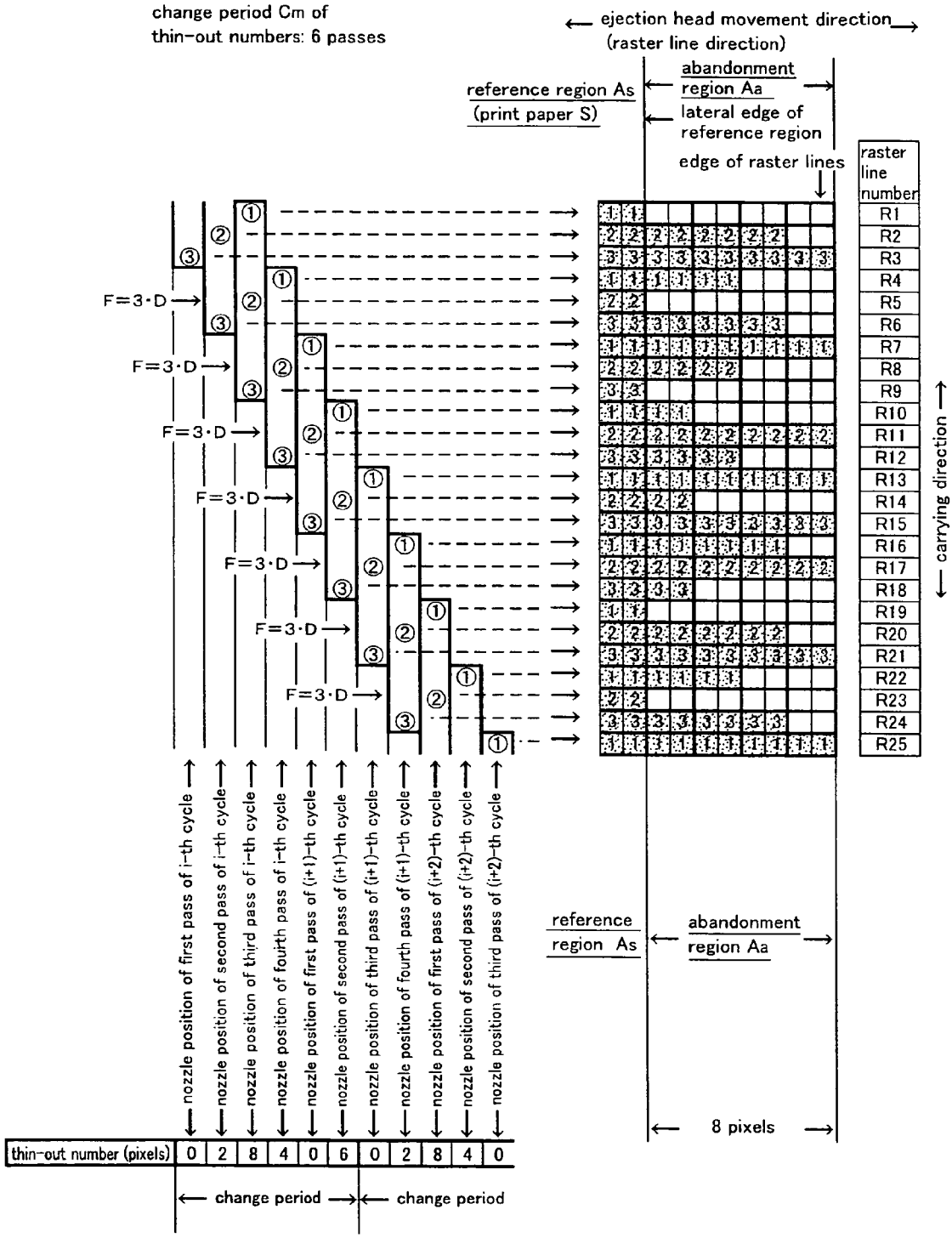
FIG. 20 is an explanatory diagram showing an example of the thinning process during interlaced printing.
Figure 21:
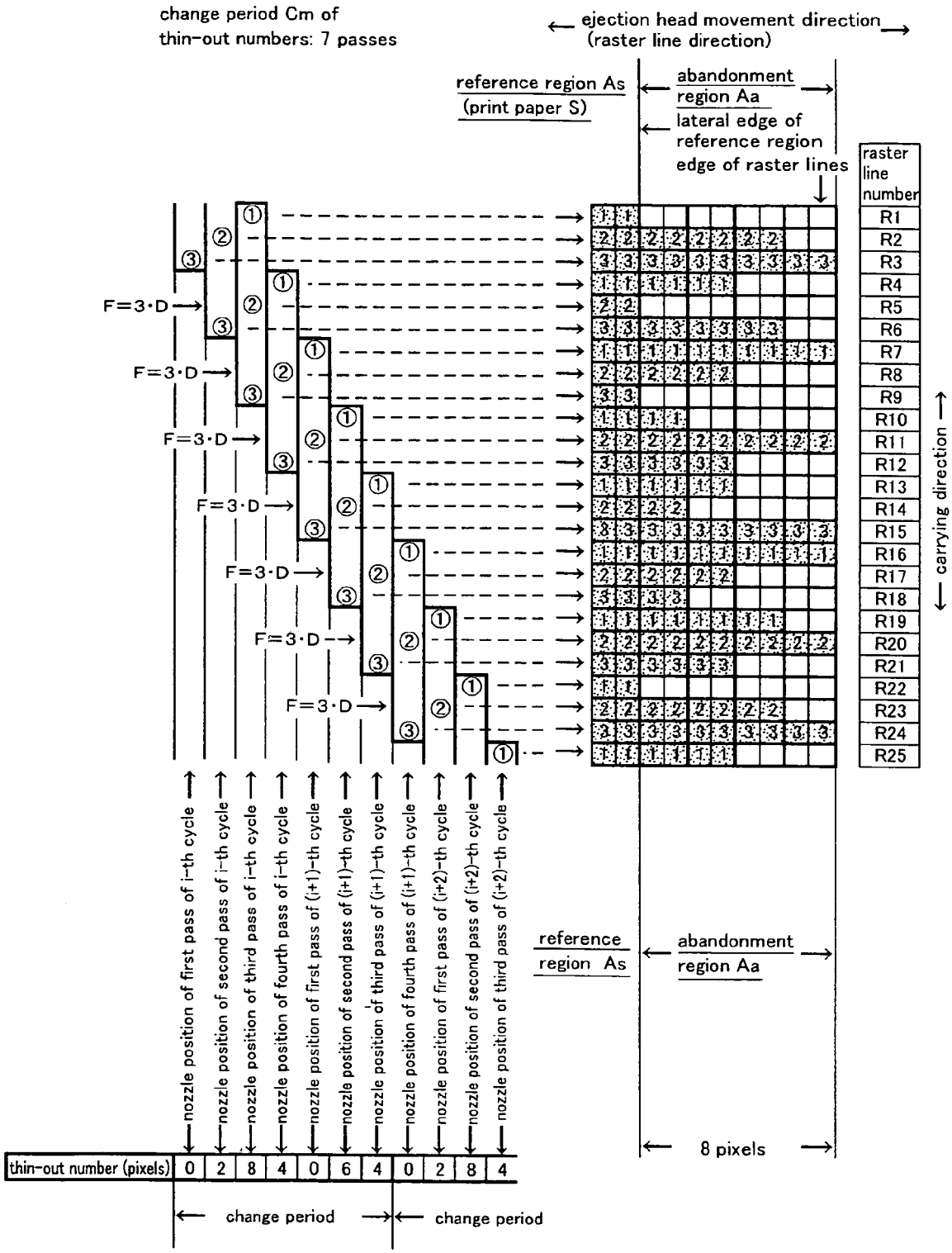
FIG. 21 is an explanatory diagram showing an example of the thinning process during interlaced printing.
Figure 22:
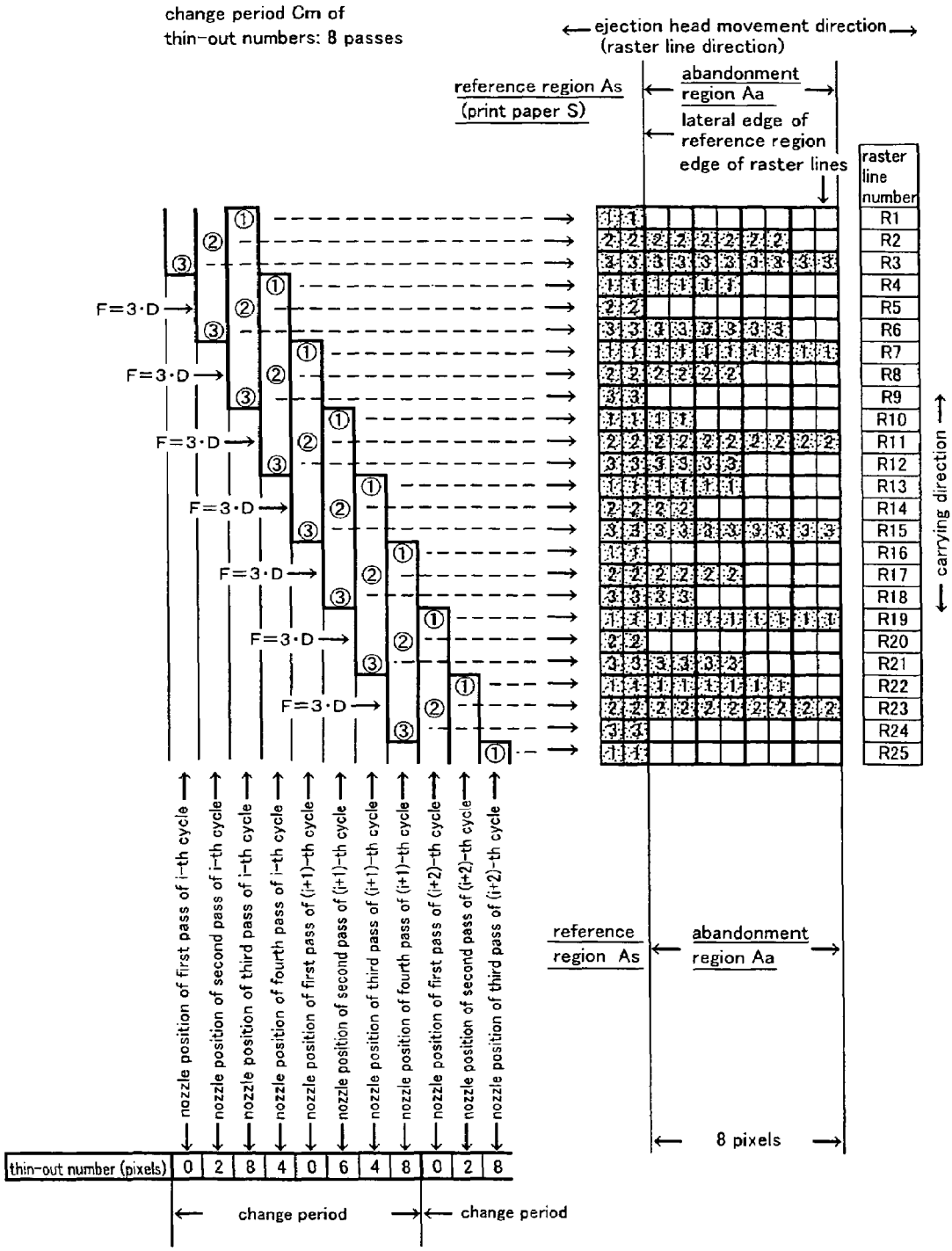
FIG. 22 is an explanatory diagram showing an example of the thinning process during interlaced printing.
Figure 23:
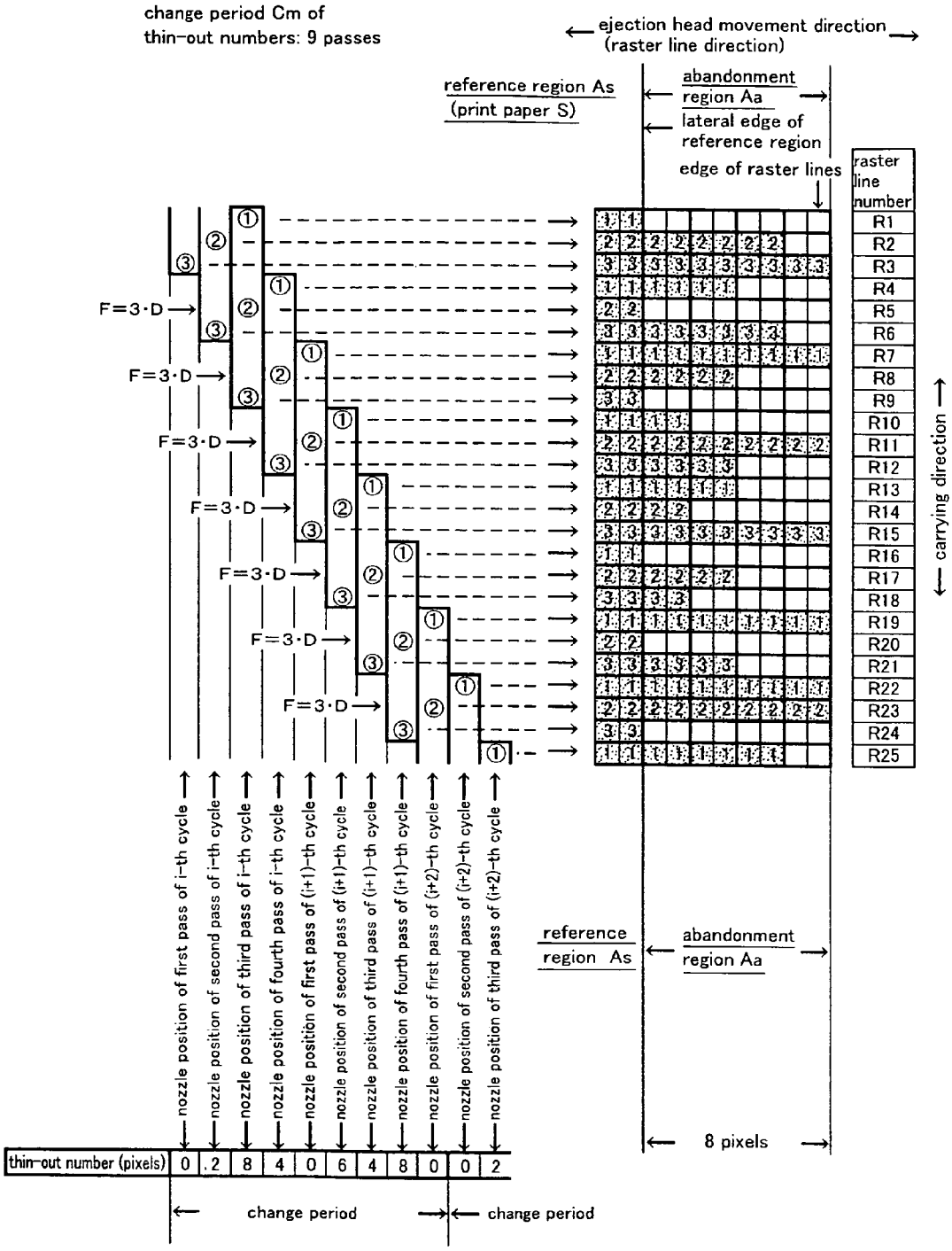
FIG. 23 is an explanatory diagram showing an example of the thinning process during interlaced printing.

This is explained taking FIG. 17, in which the change period Cm is 3 passes, as a representative example of all figures. As shown below the left diagram, the thin-out number changes at each pass in the order of 0-2-8. This change pattern is repeated for all passes of the interlaced printing.

For example, the thin-out number of the first pass of the i-th cycle is 0, so that there is no thinning in the third raster line R3 formed in this first pass, and the ink droplets are ejected by the nozzle #3 onto the eight pixels up to the edge of the raster line. In the following second pass, the thin-out number is 2, so that two pixels from the edge of the raster lines are thinned out from the second raster line R2 and the sixth raster line R6 formed in this second pass, and ink droplets are ejected from the nozzles #2 and #3 onto the remaining six pixels. In the following third pass, the thin-out number is 8, so that eight pixels from the edge of the raster lines are thinned out from the first, fifth and ninth raster lines R1, R5 and R9 formed in this third pass, that is, no ink droplets are ejected from the nozzles #1, #2 and #3 onto the abandonment region Aa. Furthermore, in the following fourth pass, the change pattern completes the cycle and returns to a thin-out number of 0, so that the fourth, eighth and twelfth raster lines R4, R8 and R12 formed in this fourth pass are formed without thinning, as in the first pass, that is, ink droplets are ejected onto the eight pixels up to the edge of the raster lines.

Here, when looking at the abandonment regions Aa from FIG. 16 to FIG. 23 macroscopically, the thinning ratio becomes larger when approaching the edges of the raster lines. This is because the thinned out pixels are designated by counting the thin-out number from the edges of the raster lines. It should be noted that the reason why the thinning ratio is increased when approaching the edges is that, as noted above, the chances that ink droplets land on the paper S become lower toward the edges, so that the influence of thinning the ink droplets ejected toward the vicinity of the edges is less prone to show up as empty portions in the image. Consequently, it is possible to increase the number of ink droplets that can be saved as much as possible, while suppressing deterioration in the image quality due to thinning.

Moreover, it can be seen that when the change period Cm becomes large, there is less regularity in the thinned-out state, and the thinned-out state tends to be better dispersed. Consequently, it is preferable that the change period Cm is set to be large, so that the empty portions in the image that may become conspicuous at the edge of the paper S can be made to be less readily apparent.

Example of the Thinning Process for Overlap Printing

FIGS. 24 through 31 show an example of the thinning process for the case of overlap printing. In FIGS. 24 to 31, the change period Cm of the thin-out numbers is different in each drawing, thus illustrating the influence of the change period Cm on the thinned-out state. However, the conditions for overlap printing are set to the same conditions for all figures. That is to say, the nozzle number N ejecting ink droplets is N=6, the nozzle pitch is k·D=4·D, the overlap number is M=2, and the carry amount is F(=(N/M)·D)=3·D.

First, the raster line formation process with overlap printing is explained with reference to FIG. 24. It should be noted that since overlap printing has been explained before, only the aspects that are necessary for the understanding of the present example are explained here.

Since the overlap number M of the present example is 2, ink droplets are ejected from different nozzles in different passes onto the odd-numbered and the even-numbered pixels of the raster lines, forming the raster lines.

For example, in the second pass, ink droplets are ejected by the nozzle #5 onto the even-numbered pixels of the second raster line R2, and ink droplets are ejected by the nozzle #6 onto the even-numbered pixels of the sixth raster line R6, whereas the ink droplets for the odd-numbered pixels of these second and sixth raster lines R2 and R6 are ejected by the nozzle #2 and the nozzle #3 in the sixth pass. Thus, the second and the sixth raster lines R2 and R6 are completed.

Also, the third, fourth and fifth raster lines R3, R4 and R5 are formed as follows between the second raster line R2 and the sixth raster line R6. In the third raster line R3, ink droplets are ejected onto the odd-numbered pixels by the nozzle #6 in the first pass, and the third raster line R3 is completed by ejecting ink droplets onto the even-numbered pixels from the nozzle #3 in the fifth pass. In the fourth raster line R4, ink droplets are ejected onto the odd-numbered pixels by the nozzle #1 in the eighth pass, and the fourth raster line R4 is completed by ejecting ink droplets onto the even-numbered pixels from the nozzle #4 in the fourth pass. In the fifth raster line R5, ink droplets are ejected onto the odd-numbered pixels by the nozzle #5 in the third pass, and the fifth raster line R5 is completed by ejecting ink droplets onto the even-numbered pixels from the nozzle #2 in the seventh pass.

This means that, in order to consecutively form the second to sixth raster lines, a total of eight passes from the first pass to the eighth pass are necessary. In other words, in the overlap printing according to the present example, eight passes form one cycle, and raster lines are formed consecutively at a dot pitch D in the carrying direction by repeating this cycle. In the following this one cycle is referred to as "overlap cycle", and in the figures, the first cycle is referred to as "i-th cycle", whereas the next cycles is referred to as the "(i+1)-th cycle". Moreover, the pass number Co constituting this one cycle is called the overlap cycle number Co.

The following is an explanation of the thinning process in the abandonment region Aa.

Figure 24:
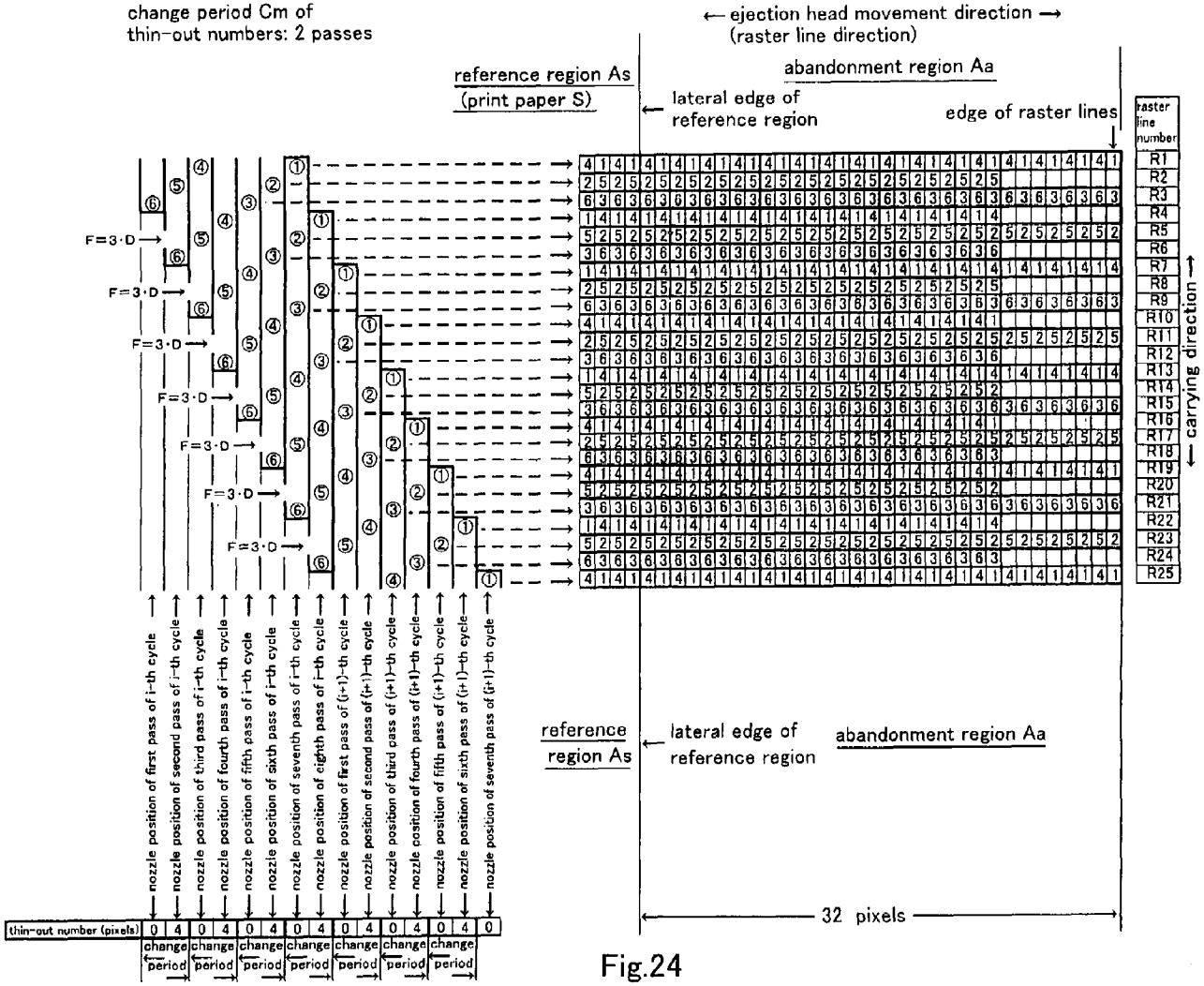
FIG. 24 is an explanatory diagram showing an example of the thinning process during overlap printing.

As shown in FIG. 24, an abandonment region Aa with a width of 32 pixels in the ejection head movement direction is set to the right of the reference region Aa, and the edges of the raster lines are located at the outer border of this abandonment region Aa. Moreover, in each pass, a thinning process based on the thin-out number corresponding to that pass is performed, whereby a number of pixels corresponding to the thin-out number is counted from the edge of each raster line formed in each pass and designated, and no ink droplets are ejected onto the designated pixels. It should be noted that to facilitate the drawings, the number of pixels in ejection head movement direction constituting the abandonment region has been set to 32, but there is no limitation to this.

As shown below the left diagram in FIGS. 24 to 31, the change period Cm of the thin-out number is changed from two to nine passes from FIG. 24 to FIG. 31, respectively. The change pattern of the thin-out number for these examples is obtained by setting the value j in Table 2 to "4". For example, in the case of FIG. 24 where the change period Cm is 2 passes, the thin-out number for each pass repeats the cycle of 0 and 4. Further, in the case of FIG. 25 where the change period Cm is 3 passes, the thin-out number repeats the cycle of 0, 4, and 16. As for the four to nine passes in FIGS. 26 to 31, every time the change period Cm increases by one, one of the numbers 8, 0, 12, 16, and 0 is added in this order as the thin-out number of the corresponding fourth and further passes.

This is explained taking FIG. 25, in which the change period Cm is 3 passes, as a representative example of all figures. As shown below the left diagram, the thin-out number changes at each pass in the order of 0 dots-4 dots-16 dots. This change pattern is repeated for all passes of the overlap printing.

It should be noted that as mentioned above, in the case of overlap printing with an overlap number M of 2, ink droplets can be ejected in a single pass only onto either the odd-numbered pixels or the even-numbered pixels lined up in the raster line direction. Consequently, the pixels that are thinned out in a single pass are designated by counting either the odd-numbered pixels or the even-numbered pixels, from the edge of the raster line to the thin-out number corresponding to that pass. Moreover, the thinned-out state of the raster line is determined depending on which of the thin-out number of the pass in which ink droplets are ejected onto even-numbered pixels and the thin-out number of the pass in which ink droplets are ejected onto odd-numbered pixels is larger. That is to say, this determines whether intermittently-ejected portions are formed by ejecting ink droplets onto every other pixel in the raster line direction, or whether a consecutive ejection portion is formed by ejecting consecutively in that direction, or whether a consecutive non-ejection portion is formed in which no ink droplets are ejected consecutively in that direction.

For example, as shown in FIG. 25, the thin-out number of the first pass of the i-th cycle is 0, so that there is no thinning of odd-numbered pixels of the third raster line R3, which are formed by the nozzle #6 of the first pass, and thus ink droplets are ejected by the nozzle #6 onto the odd-numbered pixels of that raster line R3 all the way to the edge of the raster line, as shown in the right diagram. On the other hand, ink droplets are ejected in a complementary manner by the nozzle #3 in the fifth pass onto the even-numbered pixels between these odd-numbered pixels. At this time, the thin-out number of the fifth pass is 4, so that no ink droplets are ejected onto a total of four even-numbered pixels counting from the edge of the raster line R3, but ink droplets are ejected onto even-numbered pixels that are located further inward. As a result of these two passes, an intermittently-ejected portion in which ink droplets are ejected onto every other pixel is formed in a portion extending over eight pixels from the edge of the third raster line R3, as shown in the right diagram, whereas a consecutive ejection portion onto which ink droplets are ejected consecutively is formed in a portion extending over the 24 pixels further inward therefrom.

Also, as can be seen in the right diagram, there is a consecutive non-ejection portion at the edge portion of the second raster line R2, and it is formed as follows. The thin-out number of the sixth pass of the i-th cycle is 16, so that no ink droplets are ejected onto a total of 16 odd-numbered pixels counting from the edge of the raster line R2. As a result, no ink droplets are ejected onto any of the odd-numbered pixels of the raster line R2 in the abandonment region Aa. On the other hand, the thin-out number of the second pass in this cycle is 4, so that in this second pass, no ink droplets are ejected onto a total of four even-numbered pixels counting from the edge of the raster line R2, whereas ink droplets are ejected by the nozzle #5 onto the even-numbered pixels that are located further inward. As a result, a consecutive non-ejection portion onto which ink droplets are consecutively not ejected is formed in a portion extending over eight pixels from the edge of the second raster line R2, and an intermittently-ejected portion in which ink droplets are ejected onto every other pixel is formed in a portion extending over 24 pixels further inward therefrom, as shown in the right diagram.

Also in the other raster lines besides the raster lines R2 and R3 described above, whether an intermittently-ejected portion, a consecutive ejection portion or a consecutive non-ejection portion is formed depends on which of the thin-out number of the pass in which ink droplets are ejected toward the odd-numbered pixels and the thin-out number of the pass in which ink droplets are ejected toward the even-numbered pixels is larger, as in these raster lines R2 and R3, and as a result, the thinned-out state of the raster lines is determined.

Influence of the Change Period Cm on the Thinned-out State

Figure 26:
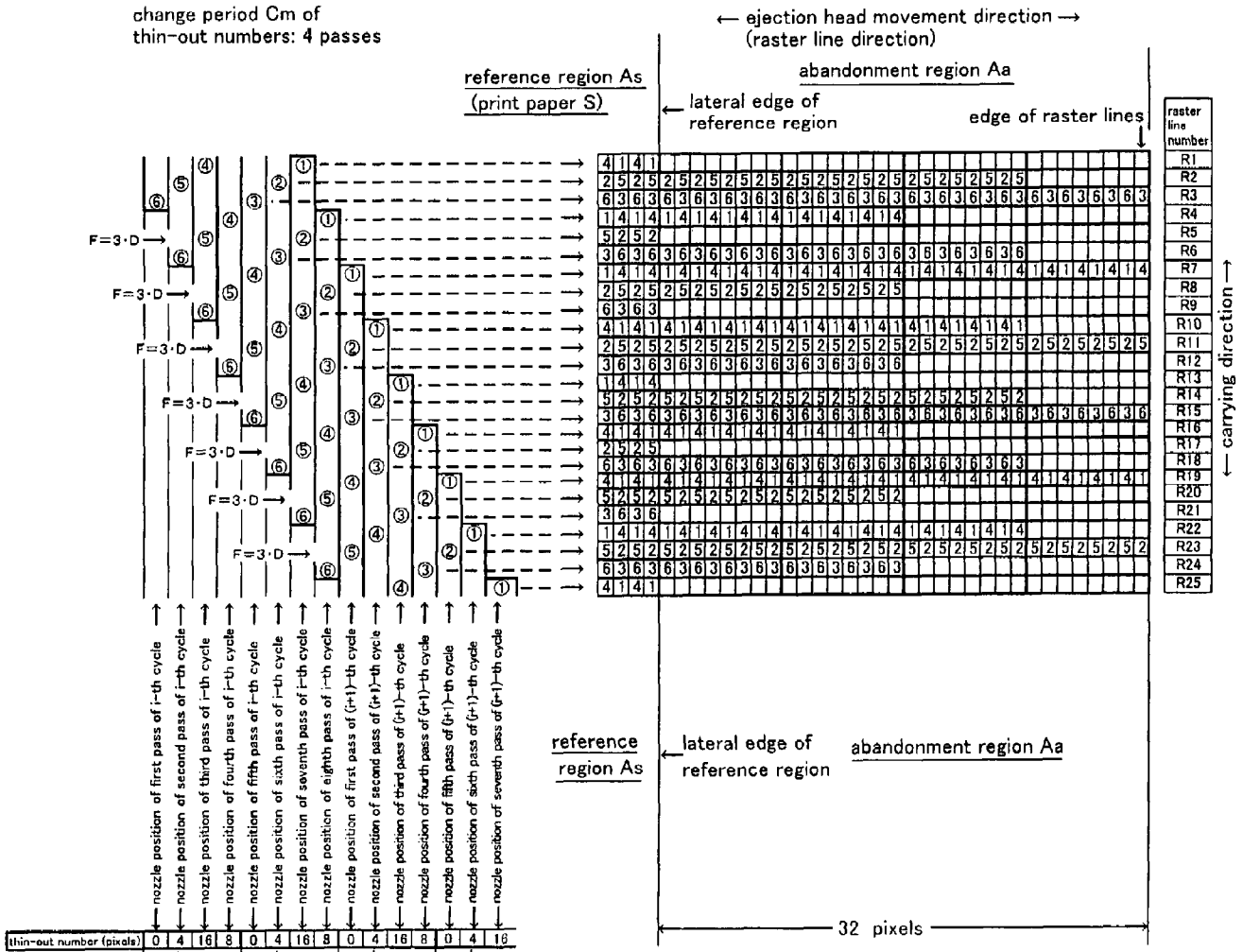
FIG. 26 is an explanatory diagram showing an example of the thinning process during overlap printing.
Figure 27:
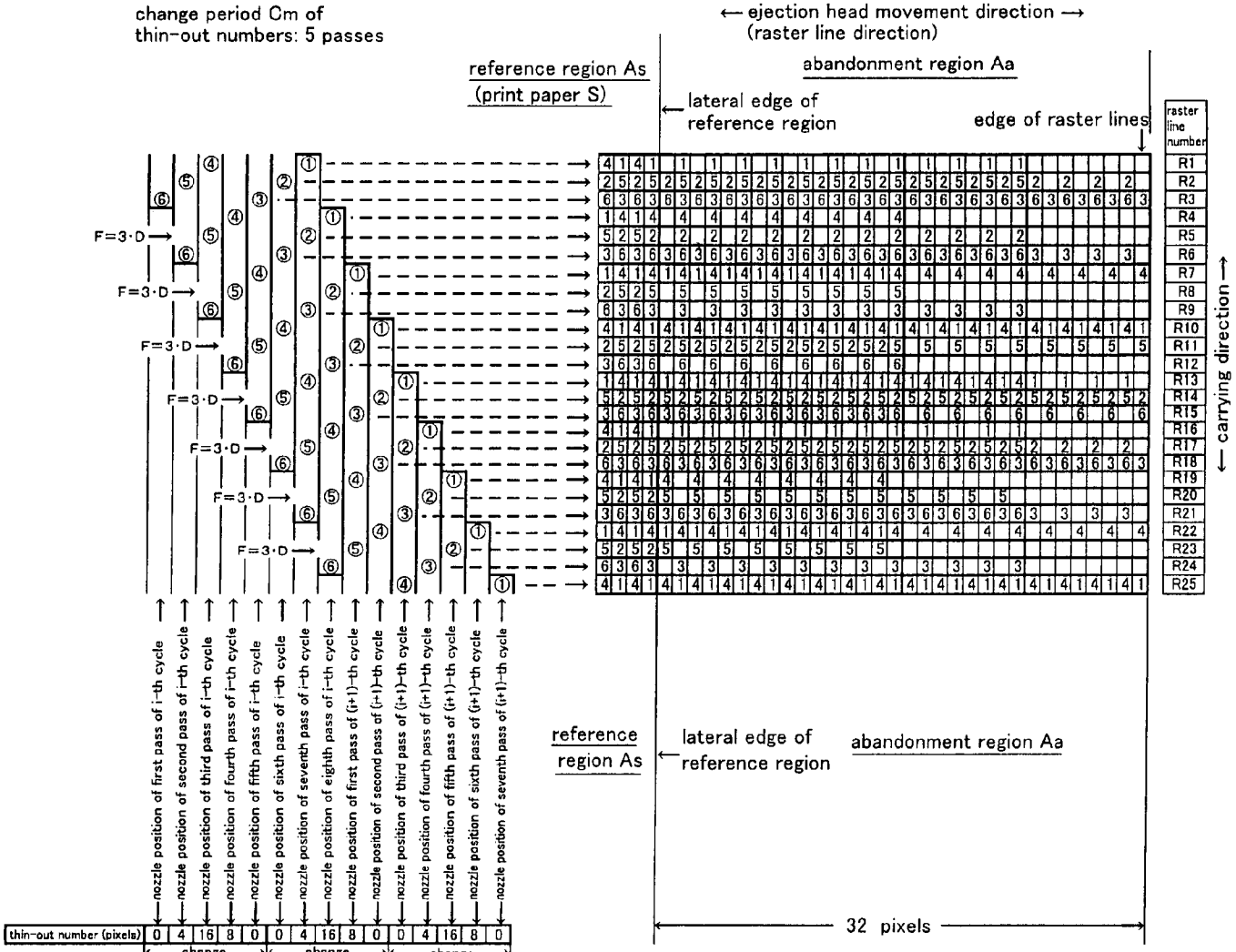
FIG. 27 is an explanatory diagram showing an example of the thinning process during overlap printing.
Figure 28:
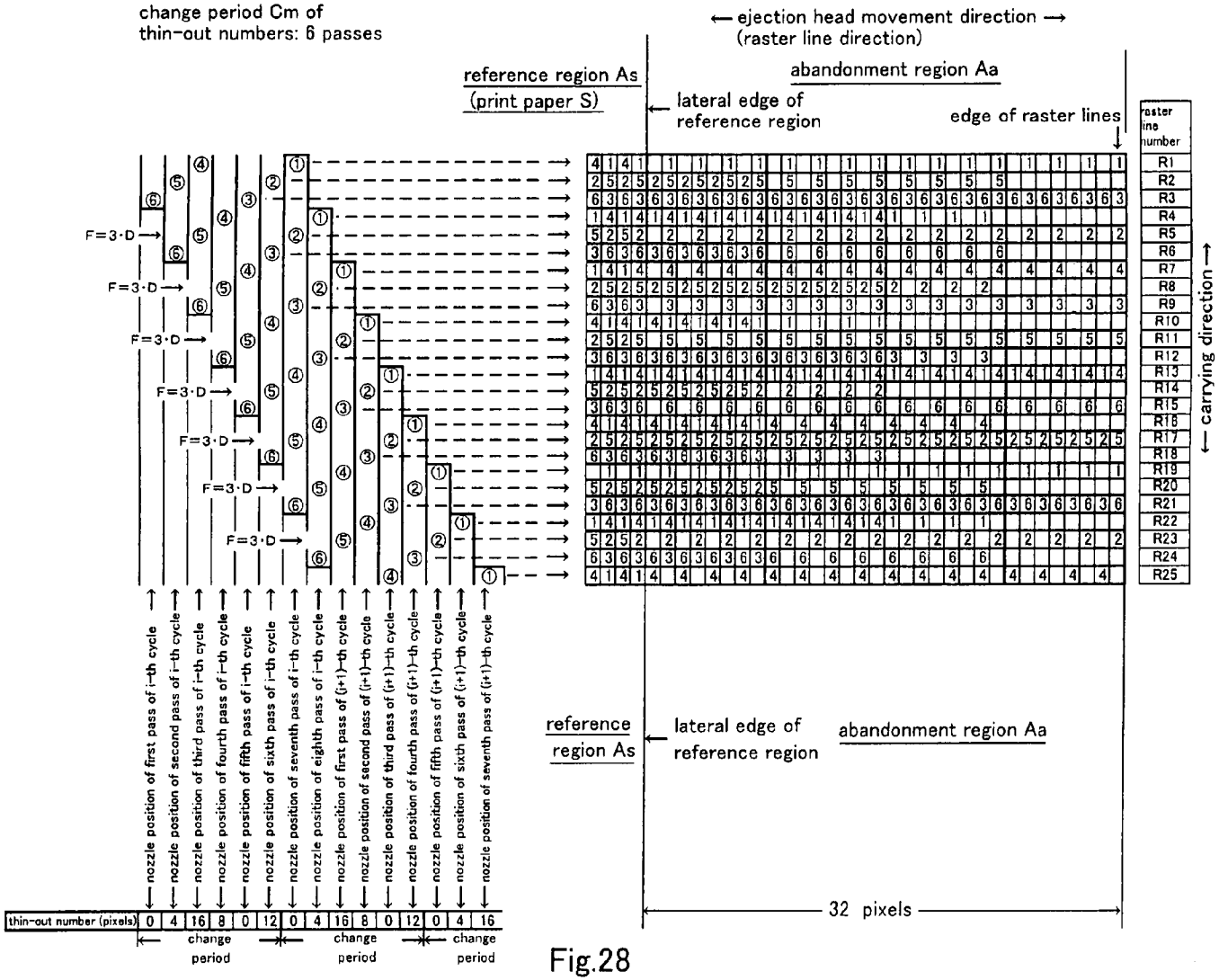
FIG. 28 is an explanatory diagram showing an example of the thinning process during overlap printing.

Referring to the FIGS. 24 to 31, the following is a discussion of the influence that the change period Cm has on the thinned-out state. What can be seen immediately is that if intermittently-ejected portions are formed as shown in FIG. 25 and FIGS. 27 to 31, then the thinned-out state looks dispersed, and in particular the greater the intermittently-ejected portions is, the more dispersed it looks. Conversely, if no intermittently-ejected portion is formed in any of the raster lines as shown in FIGS. 24 and 26, then the thinned-out state does not look dispersed, which is not preferable.

Accordingly, the conditions under which no intermittently-ejected portions are formed at all, as in FIGS. 24 and 26, have been examined in two steps. In the first step of this examination, the conditions under which no intermittently-ejected portion is formed in a predetermined raster line were examined. In the second step, the conditions under which the conditions of the first step apply to all raster lines were examined.

First, the conclusion of the first step, namely the "conditions under which no intermittently-ejected portion is formed in a predetermined raster line", is as follows: This is the condition that "the pass for ejecting droplets onto the even-numbered pixels of a raster line and the pass for ejecting droplets onto the odd-numbered pixels of that raster line have the same thin-out number." Or putting it more generally, this is the condition that "the thin-out numbers of the pair of passes for forming the same raster line are the same."

This is explained in more detail. The thin-out number stipulates the number of pixels that are thinned out, and at the same time also stipulates the range from the edge of a raster line inward over which pixels are thinned out. Consequently, if the thin-out number corresponding to the pass of the odd-numbered pixels is the same number as the thin-out number corresponding to the pass of the even-numbered pixels, then the thinned out range matches, so that both are thinned out over the same range and no intermittently-ejected portion is formed. Conversely, if the thin-out numbers are different, then the thinned out ranges are also different, so that in these different ranges there is a portion in which only the pixels of one type are thinned out and the pixels of the other type are not thinned out, thus forming an intermittently-ejected portion.

Figure 29:
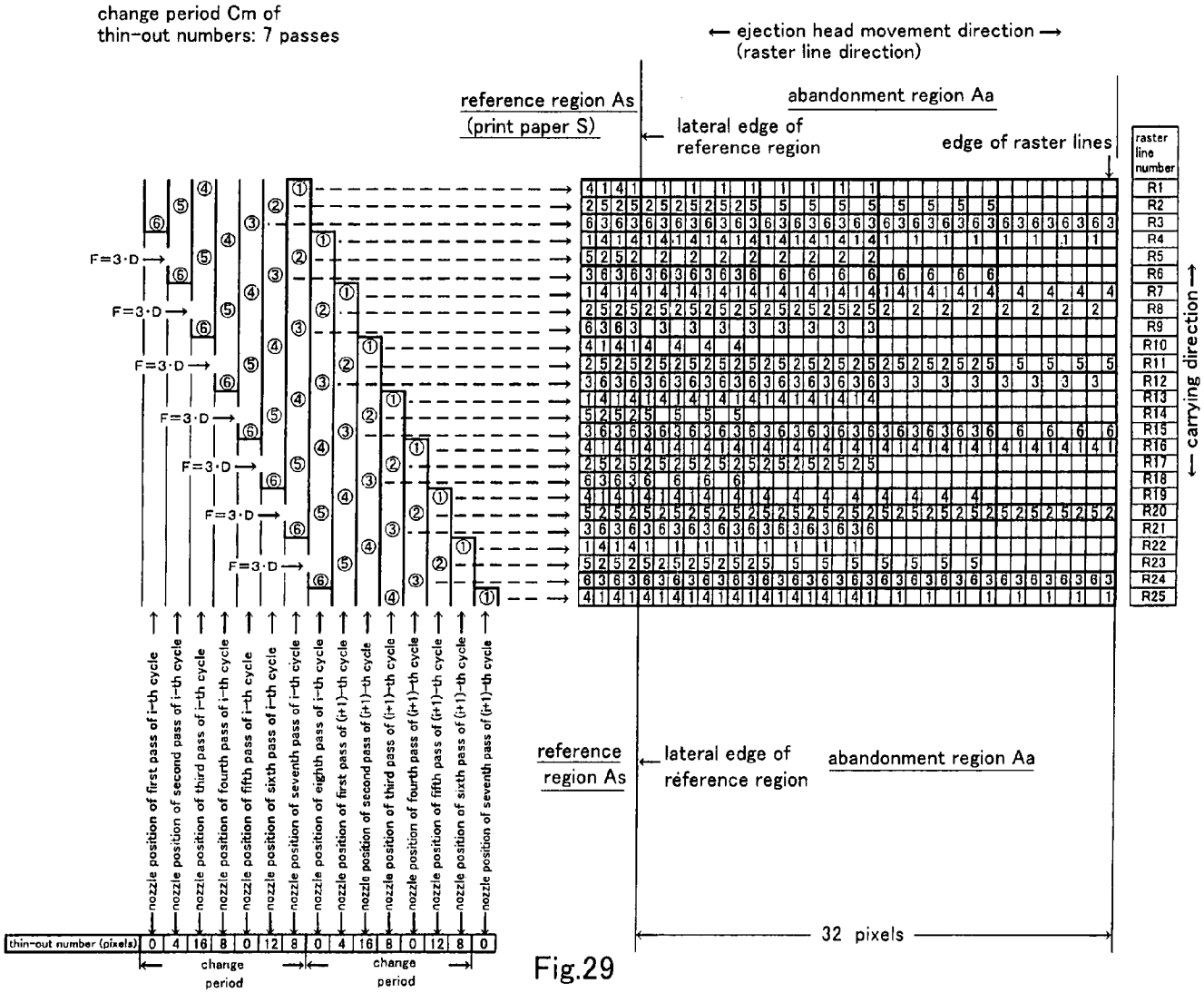
FIG. 29 is an explanatory diagram showing an example of the thinning process during overlap printing.
Figure 30:
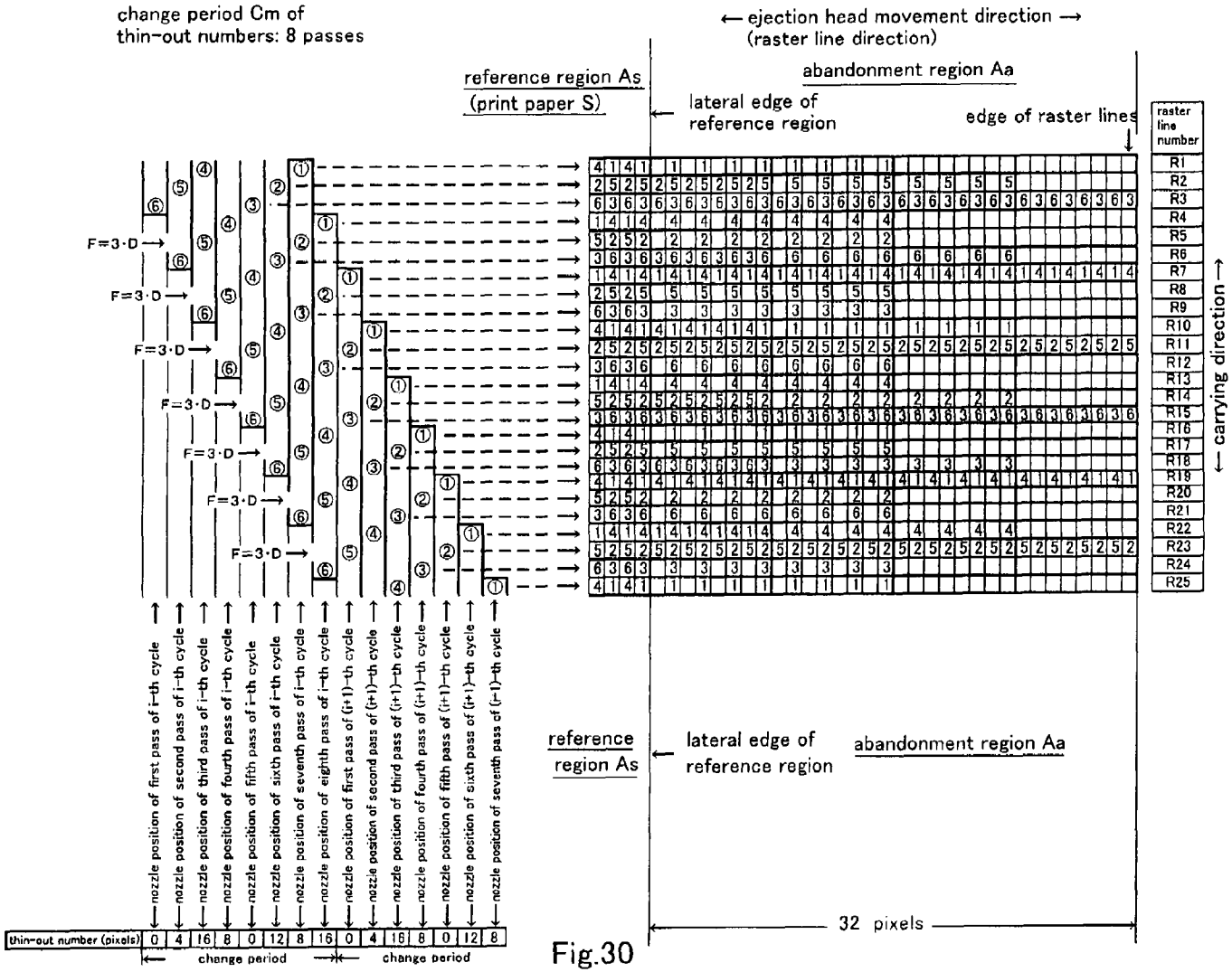
FIG. 30 is an explanatory diagram showing an example of the thinning process during overlap printing.
Figure 31:
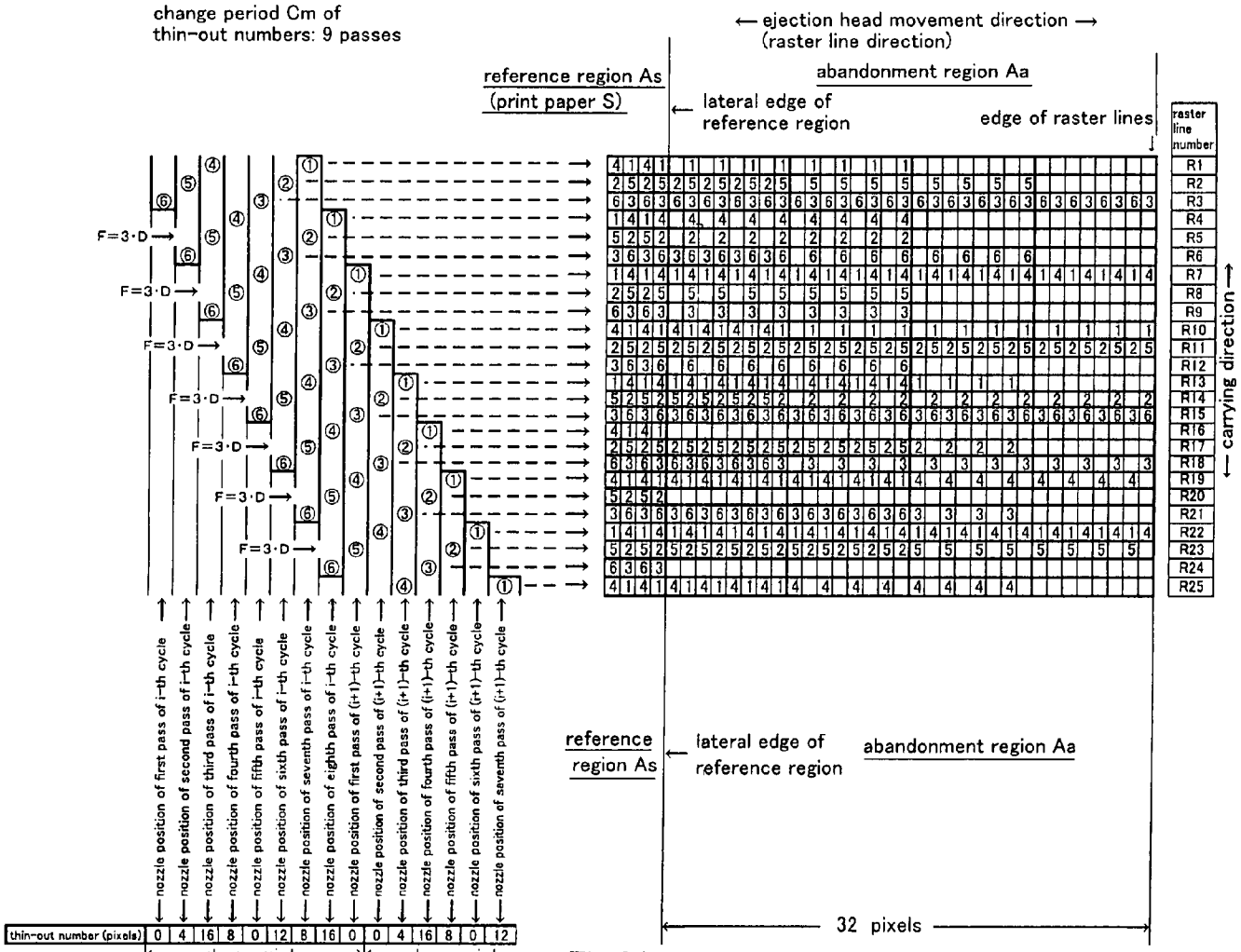
FIG. 31 is an explanatory diagram showing an example of the thinning process during overlap printing.

For example, in the nineteenth raster line R19 in the example in FIG. 29, no intermittently-ejected portion is formed, because the thin-out number of the first pass in the (i+1)-th cycle, which is the pass of the odd-numbered pixels of the nineteenth raster line R19, is the same number, namely 4, as the thin-out number of the fifth pass in that cycle, in which ink droplets are ejected onto the even-numbered pixels of that raster line R19. That is to say, a thin-out number of 4 is associated with both the first pass of the (i+1)-th cycle in which there is ejection from the nozzle #4 toward the odd-numbered pixels of the first raster line R1, and the same thin-out number of 4 is associated also with the fifth pass in which there is of ejection from the nozzle #1 toward the even-numbered pixels. In this case, four odd-numbered pixels as well as four even-numbered pixels are designated. Thus, the thinning range of the even-numbered pixels and the odd-numbered pixels extends for eight pixels from the edge of the raster line. Consequently, in a range of eight pixels from the edge, both the odd-numbered and the even-numbered pixels are thinned out, thus forming a consecutive non-ejection portion, whereas in the range further inward, neither the odd-numbered and the even-numbered pixels are thinned out, forming a consecutive ejection portion. As a result, no intermittently-ejected portion is formed in this first raster line R1.

On the other hand, the first raster line R1, which includes an intermittently-ejected portion, is formed as follows. The third pass, in which there is ejection from the nozzle #4 toward the odd-numbered pixels of the first raster line R1, is associated with the thin-out number 16, whereas the seventh pass, in which there is ejection from the nozzle #1 toward the even-numbered pixels, is associated with the thin-out number 8. Thus, in this case, 16 odd-numbered pixels (i.e. every other pixel) are designated, and as a result the thinned out range extends over 32 pixels from the edge of the raster line. On the other hand, 8 even-numbered pixels (i.e. every other pixel) are designated, and as a result the thinned out range extends over 16 pixels from the edge of the raster line. Consequently, both odd-numbered and even-numbered pixels are thinned out in a range of 16 pixels from the edge, thus forming a consecutive non-ejection portion, whereas in the range further inward, only odd-numbered pixels are thinned out, so that an intermittently-ejected portion is formed as a result.

The following is a discussion of the second step regarding "the conditions under which the conditions of the first step apply to all raster lines" are examined. That is to say, the "conditions under which the thin-out numbers of the pair of passes for forming the same raster line are the same in all raster lines" are examined.

The conclusion is as follows: This is the condition that "the quotient Co/M of the overlap cycle number Co divided by the overlap number M is a multiple (i.e. an integer other than 1) of the change period Cm of the thin-out numbers."

This is explained in more detail. Ordinarily, the two pass numbers for forming the same raster line are spaced apart by a pass number that can be expressed as the quotient Co/M of the overlap cycle number Co divided by the overlap number M. In the present example, Co/M=8/2, so that they are spaced apart by four passes. For example, as shown in the left diagram of FIG. 26, the pair of passes for forming the third raster line R3 are the first pass and the fifth pass, the pair of passes for forming the second raster line are the second pass and the sixth pass, and the pair of passes for forming the first raster line are the third pass and the seventh pass, so that those passes are respectively spaced apart by four passes. Moreover, this relation is true for all passes.

Therefore, when this interval of passes is a multiple of the change period Cm of the thin-out numbers, then both of the passes will inevitably be associated with the same thin-out number, so that there will be no intermittently-ejected portion in any of the raster lines.

For example, in the example in the figure, the change period Cm is four passes, which means that the same thin-out numbers are repeated every four passes. Moreover, also the interval of the pair of passes forming the same raster line is four passes, so that passes forming a pair will inevitably correspond to the same thin-out number. That is to say, the first pass and the fifth pass for forming the third raster line R3 are both associated with the thin-out number 0, the second pass and the sixth pass for forming the second raster line R2 are both associated with the thin-out number 4, and the third pass and the seventh pass for forming the first raster line R1 are both associated with the thin-out number 16. And since this relation is true for all raster lines, no intermittently-ejected portion is formed in the whole abandonment region Aa, as shown in the right diagram.

Note that, in the examples of FIGS. 24 through 31 used to illustrated overlap printing, the change period Cm corresponding to this relation is two passes in FIG. 24 and four passes in FIG. 26, and no intermittently-ejected portion is formed in the abandonment region Aa in neither of them. It should be noted that the value of Co/M is the same as the value of k mentioned above.

Note further that the above-stated condition is the condition that no intermittently-ejected portion is formed at all. Therefore, the preferable condition is the opposite condition in which intermittently-ejected portions are formed: "the quotient Co/M of the overlap cycle number Co divided by the overlap number M is not a multiple (an integer other than 1) of the change period Cm of the thin-out numbers." It is preferable that Co, Cm and M are selected such that this condition is satisfied.

It is even more preferable that the following condition is satisfied: "the overlap cycle Co is coprime to the change period Cm of the thin-out numbers." In this case, the above-noted condition that "intermittently-ejected portions are formed" is of course satisfied, and it can be ensured that the overlap cycle number Co and the change period Cm of the thin-out numbers differ. Consequently, it is possible to make the periodicity of the thinned-out state in the carrying direction more intricate, and thus empty portions in the image, when the thinned-out state appears at the edges of the medium, can be made even less conspicuous.

Regarding the Preferable Dot Shape Formed by Ink Droplets

The following is an explanation of the preferable dot shape formed by the ink droplets. The dot shape of the ink droplets is the shape that remains after the ink droplets have landed on the paper S. It is preferable that this shape is substantially that of an ellipse whose major axis is oriented in the raster line direction. The reason for this is that, in the above-noted intermittently-ejected portion, blank portions are formed at every other pixel in the raster line direction, but if the dot shape is substantially elliptical, then these blank portions tend to be filled up, so that it is possible to make these blank portions non-conspicuous.

Discussion of Preferable Change Patterns

With the goal of finding preferable examples of change patterns as shown in Table 2 above, the change of the thinned-out state was examined for various different change patterns as shown in Table 3. It should be noted that the print mode is overlap printing with the conditions listed in Table 4.

TABLE 3

| | pass | first pass | second pass | third pass | fourth pass | fifth pass | sixth pass | seventh pass | eighth pass | ninth pass |
|---|---|---|---|---|---|---|---|---|---|---|
| thin-out number (pixels) | change pattern 1 (change period of 7 passes) | 0 | 8 | 0 | 16 | 0 | 24 | 0 | — | — |
| | change pattern 2 (change period of 9 passes) | 0 | 8 | 0 | 16 | 0 | 24 | 0 | 32 | 0 |
| | change pattern 3 (change period of 9 passes) | 0 | 8 | 16 | 24 | 32 | 24 | 16 | 8 | 0 |
| | change pattern 4 (change period of 9 passes) | 0 | 8 | 32 | 16 | 0 | 24 | 0 | 32 | 0 |
| | change pattern 5 (change period of 9 passes) | 0 | 8 | 32 | 16 | 0 | 24 | 16 | 32 | 0 |

TABLE 4

| nozzle pitch (=k · D) | nozzle number N ejecting ink droplets | carry amount F | overlap number M |
|---|---|---|---|
| 16 · D | 90 | 43 · D | 2 or 3 (1 out of 16 raster lines has M = 3) |

FIGS. 32 through 36 are plan views showing the thinned-out state in the abandonment region Aa. It should be noted that these diagrams are drawn in the same form as the right diagrams in FIGS. 16 through 31. However, the pixels onto which ink droplets are ejected are shown in black, and conversely the pixels onto which no ink droplets are ejected are shown in white.

Firstly, the overlap printing used for this discussion is outlined. When overlap printing is performed in accordance with the overlap conditions in Table 4, one out of every sixteen raster lines is formed with an overlap number of 3, and the remaining fifteen of the sixteen raster lines are formed with an overlap number of 2. That is to say, one raster line is formed by ejecting ink droplets onto the pixels alternately from three nozzles, whereas fifteen raster lines are formed by ejecting ink droplets onto the pixels alternately from two nozzles.

Figure 32:
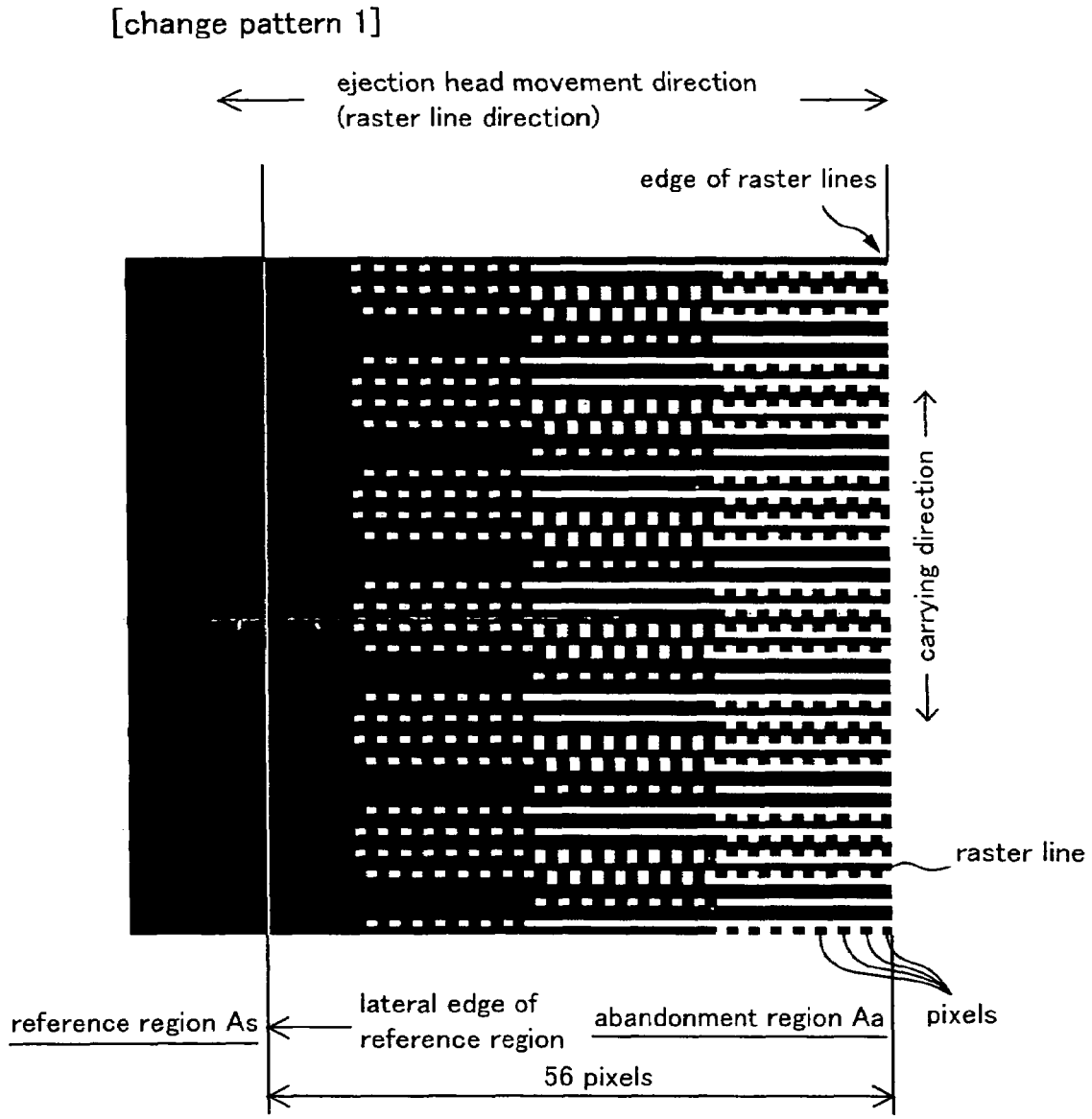
FIG. 32 is a diagram used to find a preferable example of the change pattern.
Figure 33:
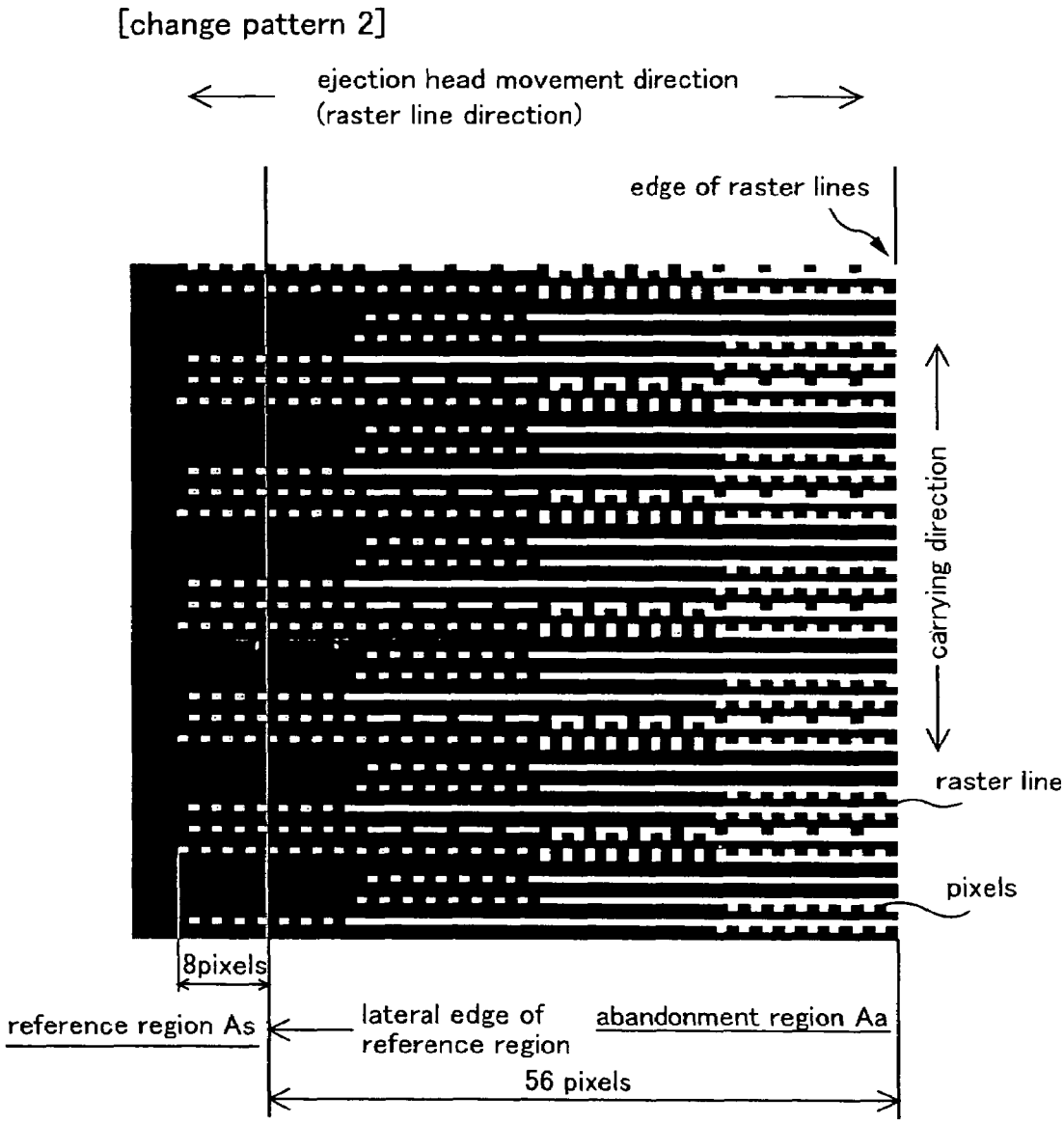
FIG. 33 is a diagram used to find a preferable example of the change pattern.
Figure 34:
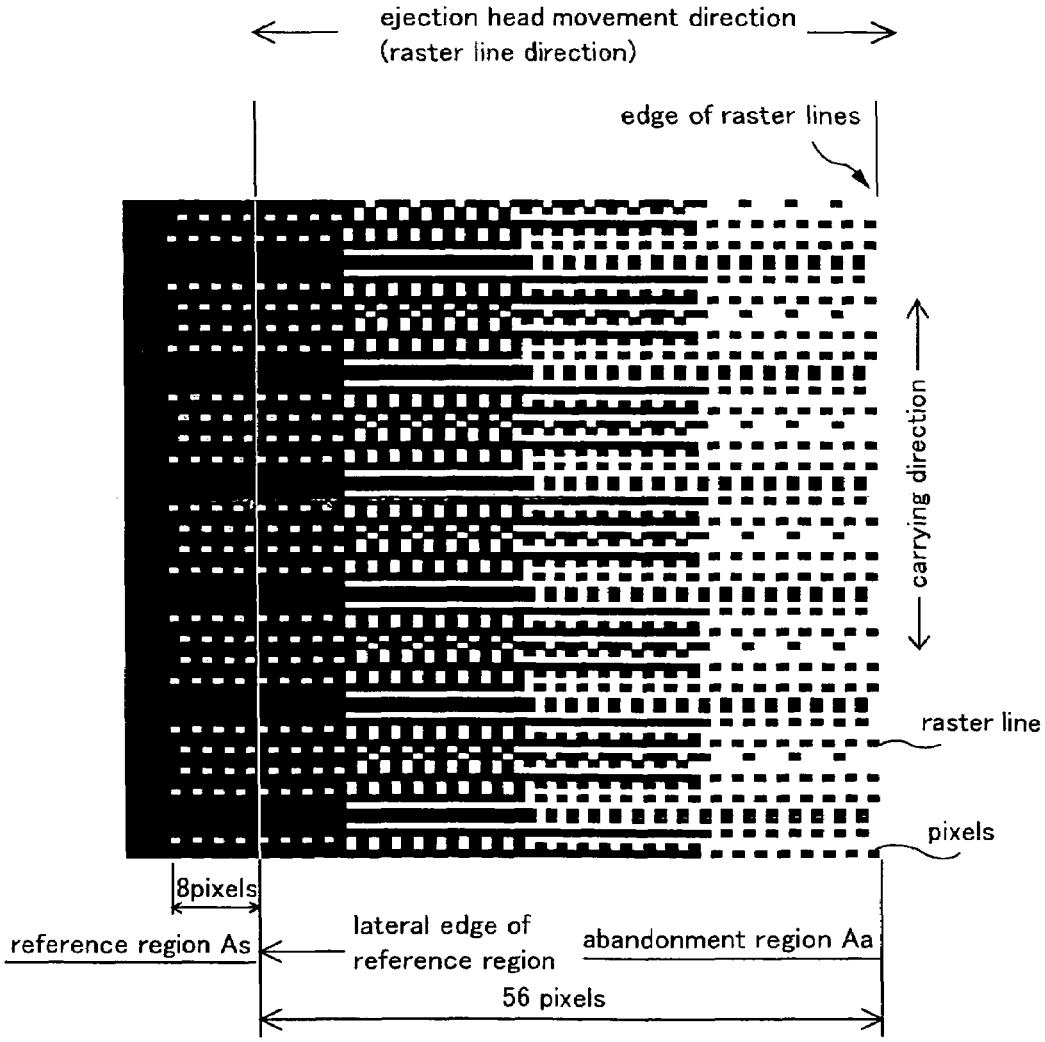
FIG. 34 is a diagram used to find a preferable example of the change pattern.
Figure 35:
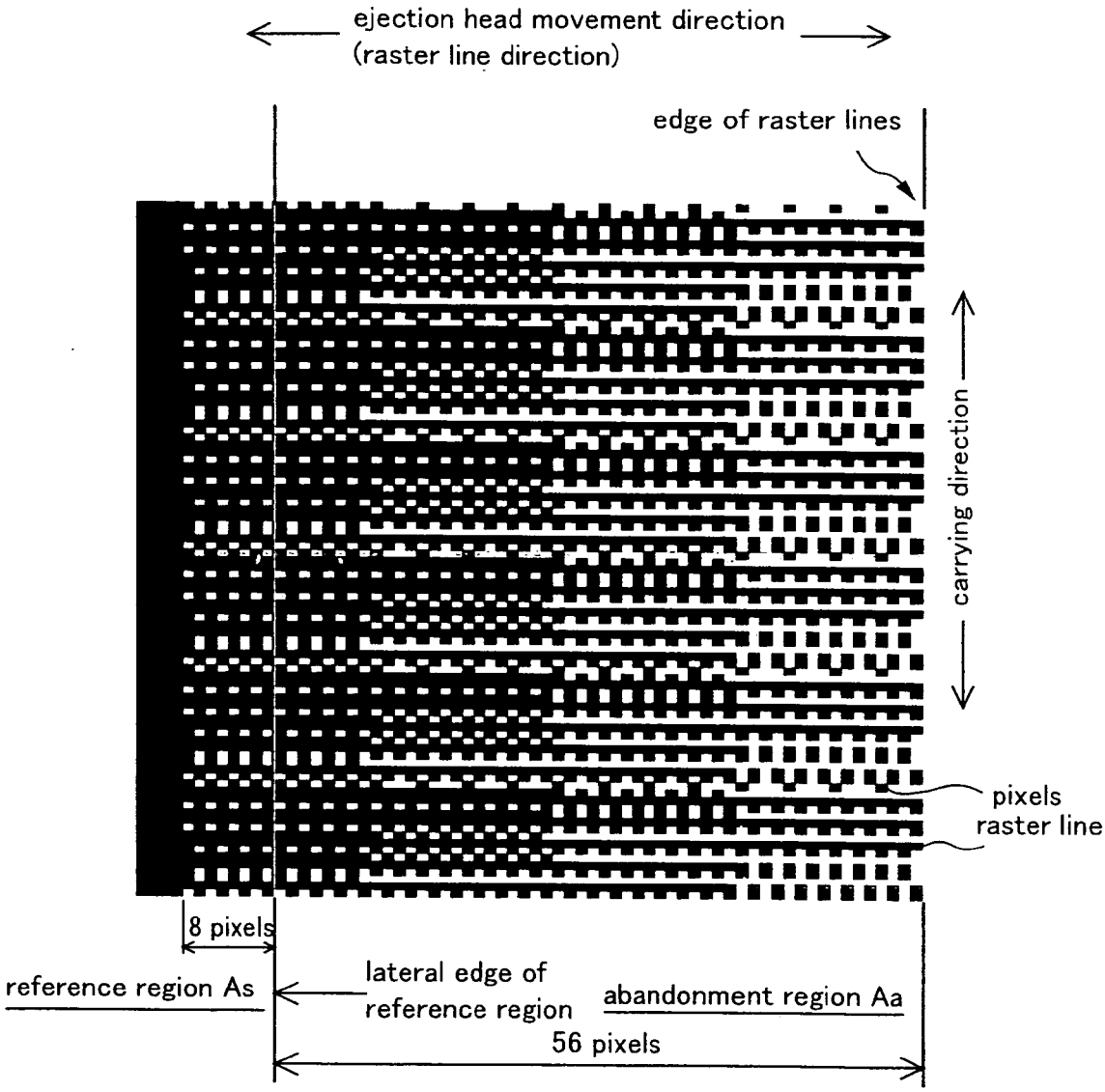
FIG. 35 is a diagram used to find a preferable example of the change pattern.
Figure 36:
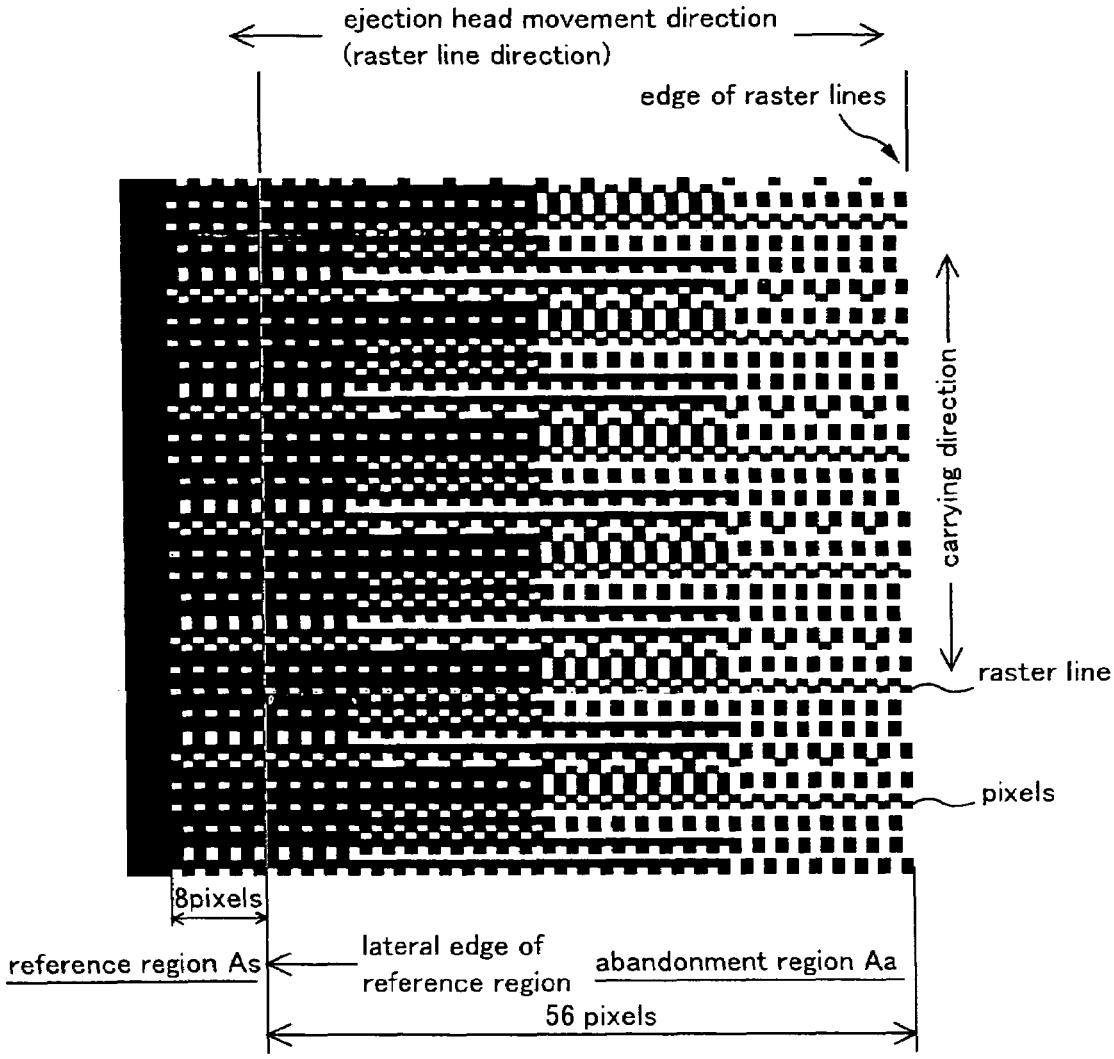
FIG. 36 is a diagram used to find a preferable example of the change pattern.

As shown in FIG. 32, the abandonment region Aa is set to a width of 56 pixels in the ejection head movement direction, and the edges of the raster lines are located at the outer border of this abandonment region Aa. Note that in FIGS. 33 through 36, in a portion in the carrying direction, the pixels onto which no ink droplets are ejected reach all the way to the inner side of the reference region; these raster lines are formed in passes associated with a thin-out number of 32. That is to say, the overlap number of these raster lines is 2, so that if the thin-out number is 32, then there are a maximum of 64 pixels from the edge of the raster line in which the pixels on the inner side are thinned out.

Here, in the FIGS. 32 through 36, the change patterns 1 through 5 all have a large intermittently-ejected portion, and there is a lot of variation in the thinned-out state, which is preferable. However, since the thinned-out state of the change pattern 5 looks the most varied, it seems to be the most preferable. When this change pattern 5 is generalized, it can be expressed as in the above-noted Table 2. In other words, if the value j of the change pattern in Table 2 is set to "4", then it becomes the change pattern 5.

OTHER EMBODIMENTS

In the foregoing, the liquid ejection apparatus of this embodiment was described taking an inkjet printer as an example. However, the foregoing embodiment is for the purpose of elucidating the present invention and is not to be interpreted as limiting the present invention. The invention can of course be altered and improved without departing from the gist thereof and includes equivalents. In particular, the embodiments described below are also included in the liquid ejection apparatus according to the present invention.

In embodiments of the present invention, some or all of the configurations achieved by hardware may be replaced by software, and conversely, some of the configurations that are achieved by software can be replaced by hardware.

The medium also may be cloth and film, for example, instead of the print paper S.

It is possible to perform some of the processes that are performed on the liquid ejection apparatus side on the host side instead, and it is also possible to provide a dedicated processing device between the liquid ejection apparatus and the host and perform some of the processes using this processing device.

Moreover, in the embodiments of the present invention, in order to perform borderless printing, the abandonment region Aa that is determined to be outside the print paper S is set outside the paper S and ink droplets are thinned out with respect to this region Aa, as shown in FIG. 11. However, there is no limitation to this.

For example, by setting the print region A in FIG. 11 to substantially the same size as the paper S, the invention can also be adopted for a case in which borderless printing is performed without providing an abandonment region Aa. That is, if the position of the paper S does not deviate from a set design position when the paper is carried, then all the ink droplets land on the paper S without any ink droplets being abandoned, but if its position has deviated, then there are ink droplets that miss the paper S without landing on it, and these droplets are abandoned. In this case, it is also possible to thin out a suitable number of ink droplets that are abandoned at this time. It should be noted that in this case, ink droplets that are ejected toward portions more inward than the edges of the paper S will be thinned out, but this concept is also encompassed within the scope of the invention according to claim 1. That is to say, the concept of "toward the vicinity of the edge of the medium" in claim 1 includes both the inner side and the outer side of the medium (the paper S).

Also, embodiments of the present invention were explained in detail for the case that the thinning process is performed at the lateral edges of the print paper S, but needless to say, it can also be performed at the upper and lower edges of the print paper S.

Moreover, in the embodiments of the present invention, the thinning processing section 224 is provided in the drive circuit inside the head driver 22, but there is no limitation to this. For example, it is also possible to provide a module for performing the thinning process inside the printer driver 96, and to perform the thinning process on the print data PD that is transferred from the rasterizer 100. It should be noted that in this case, the thinning signal SIG will already be reflected in the print signals PRT(i) of the print data that has been subjected to the thinning process by this module, so that there is no need to input the thinning signal SIG into the mask circuit 222 in the drive circuit, as in the above-described embodiments.

Regarding the Liquid Ejection Apparatus

The liquid ejection apparatus of the present invention can be adopted for printing apparatuses such as an inkjet printer as described above, and in addition to these it also can be adopted for color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices, for example.

Regarding the Liquid

The liquid of the present invention is not limited to inks, such as dye ink or pigment ink, as described above, and it is also possible to adopt liquids (including water) including metallic material, organic material (particularly macromolecular material), magnetic material, conductive material, wiring material, film-formation material, electric ink, processed liquid, and genetic solutions, for example. Moreover, as regards the constituents of the liquid, the liquid can also be made of solvents such as water and dissolving agents.

Regarding the Medium

As for the medium, it is possible to use regular paper, matte paper, cut paper, glossy paper, roll paper, paper used for a specific purpose, photographic paper, and rolled photographic paper, for example, as the paper S described above. In addition to these, it is also possible to use film material such as OHP film or glossy film, cloth material, and sheet metal material, for example. In other words, any medium may be used, as long as liquid can be ejected onto it.

Regarding the Nozzle Rows

The nozzle rows provided in the ejection head are not limited to the above-described four rows of black (K), cyan (C), magenta (M), and yellow (Y), and it is also possible to provide nozzle rows for ejecting ink of other colors than these. For example, a nozzle row for ejecting clear ink, which is transparent ink, may also be provided.

Regarding the Change of the Thin-Nut number in Each Pass

As for the change of the thin-out number in each pass, there is no limitation to changing the thin-out number in accordance with a predetermined change pattern as explained above, and it is also possible to associate random numbers generated by a random number generator with each pass, and to change the thin-out number in accordance with these random numbers.

INDUSTRIAL APPLICABILITY

According to the present invention, a liquid ejection apparatus and a liquid ejection method are achieved with which the number of liquid droplets ejected onto a region outside the medium, which becomes a necessary evil when forming dots all the way to the edges of the medium by ejecting ink droplets, can be decreased without greatly impairing the formation of dots at the edges.

The invention claimed is:

1. A liquid ejection apparatus for ejecting a liquid, comprising:

a liquid ejection section for ejecting liquid droplets toward a medium in order to form dots on said medium;

wherein said liquid ejection section ejects, toward a vicinity of an edge of said medium, said liquid droplets of a number that has been thinned out by a suitable number;

wherein at least a portion of the liquid droplets ejected after thinning does not land on said medium;

wherein an image formed on said medium is constituted by raster lines that are arranged in parallel to one another at a predetermined interval in a direction intersecting the direction of said raster lines, each of said raster lines being made of a multitude of dots arranged on a straight line;

wherein the liquid droplets are thinned out by a predetermined thin-out number from an edge of said raster line; and wherein said thin-out number of the liquid droplets is changed in the direction intersecting the direction of said raster lines based on a predetermined change pattern, and said thin-out number is periodically changed in the direction intersecting the direction of said raster lines.

2. A liquid ejection apparatus according to claim 1, wherein, when ejecting said liquid droplets from said liquid ejection section toward a region that is determined to be outside said medium, said liquid droplets are ejected after thinning a suitable number of the liquid droplets that are to be ejected toward that region.

3. A liquid ejection apparatus according to claim 2, wherein said liquid droplets are ejected based on image data formed to a size that is larger than said medium, and a reference region corresponding to the size of said medium is stored; and wherein the region that is determined to be outside said medium is a region that is outside said reference region.

4. A liquid ejection apparatus according to claim 2, wherein said liquid ejection apparatus further comprises an input section into which a command is input that indicates whether or not to eject the liquid droplets after thinning; and wherein, if a command to eject the liquid droplets after thinning is input, then said liquid droplets are ejected after thinning a suitable number of the liquid droplets that are to be ejected toward said region.

5. A liquid ejection apparatus for ejecting a liquid, comprising:

a liquid ejection section for ejecting liquid droplets toward a medium in order to form dots on said medium;

wherein said liquid ejection section ejects, toward a vicinity of an edge of said medium, said liquid droplets of a number that has been thinned out by a suitable number;

wherein at least a portion of the liquid droplets ejected after thinning does not land on said medium;

wherein, when ejecting said liquid droplets from said liquid ejection section toward a region that is determined to be outside said medium, said liquid droplets are ejected after thinning a suitable number of the liquid droplets that are to be ejected toward that region;

wherein said liquid droplets are ejected based on image data formed to a size that is larger than said medium, and a reference region corresponding to the size of said medium is stored;

wherein the region that is determined to be outside said medium is a region that is outside said reference region;

wherein said liquid ejection section comprises nozzles ejecting said liquid droplets;

wherein an image formed on said medium based on said image data is constituted by raster lines that are arranged in parallel to one another at a predetermined interval in a direction intersecting the direction of said raster lines, each of said raster lines being made of a multitude of dots arranged on a straight line;

wherein said raster lines are formed by ejecting said liquid droplets while moving said nozzles in the raster line direction;

wherein said nozzles constitute a nozzle row in which said nozzles are arranged at a predetermined nozzle pitch in a direction intersecting with said raster line direction;

wherein said medium is intermittently carried by a predetermined carry amount in said intersecting direction;

wherein, in between the intermittent carries, said nozzle row forms the raster lines while moving in said raster line direction;

wherein, for a single movement operation of said nozzle row in said raster line direction, the liquid droplets are thinned out by a predetermined thin-out number consecutively from the edge in said raster line direction and said thin-out number is the same number for all of the nozzles constituting said nozzle row; and wherein said thin-out number is changed for every said movement operation of said nozzle row.

6. A liquid ejection apparatus according to claim 5, wherein said thin-out number of the liquid droplets is changed for every said movement operation based on a predetermined change pattern, and the thin-out numbers based on this change pattern form a cycle that makes a round every time a predetermined number Cm of said movement operations are repeated.

7. A liquid ejection apparatus for ejecting a liquid, comprising:

a liquid ejection section for ejecting liquid droplets toward a medium in order to form dots on said medium;

wherein said liquid ejection section ejects, toward a vicinity of an edge of said medium, said liquid droplets of a number that has been thinned out by a suitable number;

wherein at least a portion of the liquid droplets ejected after thinning does not land on said medium;

wherein, when ejecting said liquid droplets from said liquid ejection section toward a region that is determined to be outside said medium, said liquid droplets are ejected after thinning a suitable number of the liquid droplets that are to be ejected toward that region;

wherein said liquid droplets are ejected based on image data formed to a size that is larger than said medium, and a reference region corresponding to the size of said medium is stored;

wherein the region that is determined to be outside said medium is a region that is outside said reference region;

wherein said liquid ejection section comprises nozzles ejecting said liquid droplets;

wherein an image formed on said medium based on said image data is constituted by raster lines that are arranged in parallel to one another at a predetermined interval in a direction intersecting the direction of said raster lines, each of said raster lines being made of a multitude of dots arranged on a straight line;

wherein said raster lines are formed by ejecting said liquid droplets while moving said nozzles in the raster line direction;

wherein said nozzles constitute a nozzle row in which said nozzles are arranged at a predetermined nozzle pitch in a direction intersecting with said raster line direction;

wherein said medium is intermittently carried by a predetermined carry amount in said intersecting direction;

wherein, in between the intermittent carries, said nozzle row forms the raster lines while moving in said raster line direction;

wherein said nozzle pitch of said nozzle row is wider than the interval between the raster lines formed on said medium; and wherein there is an unformed raster line between raster lines that are formed by said nozzle row in a single movement operation in said raster line direction.

8. A liquid ejection apparatus according to claim 7, wherein, when the interval between the raster lines formed on said medium is D, said nozzle pitch is k·D, the number of said nozzles ejecting said liquid is N, and said carry amount is F, then:

N is coprime with k; and $$F=N\cdot D.$$

9. A liquid ejection apparatus according to claim 7, wherein each of said raster lines formed on said medium is formed using a plurality of nozzles.

10. A liquid ejection apparatus according to claim 9, wherein said raster line includes an intermittently-ejected portion that is formed by ejecting the liquid droplets after performing intermittent thinning.

11. A liquid ejection apparatus according to claim , wherein a predetermined number Co of movement operations of said nozzle row is required to form raster lines at said interval D on said medium; and wherein said predetermined number Co is coprime to said predetermined number Cm regarding the change pattern of said thin-out numbers.

12. A liquid ejection apparatus according to claim 10, wherein the shape of said dots is substantially the shape of an ellipse whose major axis is oriented in said raster line direction.

13. A liquid ejection apparatus according to claim 9, wherein, when each raster line is formed by M nozzles, and when the interval between the raster lines formed on said medium and the interval between the dots in said raster line direction are both D, said nozzle pitch is k·D, the number of said nozzles ejecting said liquid droplets is N, and said carry amount is F, then:

N/M is an integer;

N/M is coprime to k; and $$F=(N/M)\cdot D.$$

14. A liquid ejection apparatus according to claim 13, wherein said k is not a multiple (an integer multiple other than 1) of said predetermined number Cm.

15. A liquid ejection apparatus for ejecting a liquid, comprising:

a liquid ejection section for ejecting liquid droplets toward a medium in order to form dots on said medium;

wherein a mode for ejecting the liquid droplets without forming a margin at an edge of said medium can be set; and wherein, if said mode has been set, then:

said liquid ejection section ejects, toward a vicinity of said edge of said medium, said liquid droplets of a number that has been thinned out by a suitable number; and at least a portion of the liquid droplets ejected after thinning does not land on said medium; and wherein an image formed on said medium is constituted by raster lines that are arranged in parallel to one another at a predetermined interval in a direction intersecting the direction of said raster lines, each of said raster lines being made of a multitude of dots arranged on a straight line;

wherein the liquid droplets are thinned out by a predetermined thin-out number from an edge of said raster line; and wherein said thin-out number of the liquid droplets is changed in the direction intersecting the direction of said raster lines based on a predetermined change pattern, and said thin-out number is periodically changed in the direction intersecting the direction of said raster lines.

16. A liquid ejection apparatus for ejecting a liquid, comprising:

a liquid ejection section for ejecting liquid droplets toward a medium in order to form dots on said medium; and an input section into which a command is input that indicates whether or not to eject the liquid droplets after thinning;

wherein, if a command to eject the liquid droplets after thinning is input, then when ejecting said liquid droplets from said liquid ejection section toward a region that is determined to be outside said medium, said liquid droplets are ejected after thinning a suitable number of the liquid droplets that are to be ejected toward that region;

wherein said liquid droplets are ejected based on image data formed to a size that is larger than said medium, a reference region corresponding to the size of said medium is stored, and the region that is determined to be outside said medium is a region that is outside said reference region;

wherein said liquid ejection section comprises nozzles ejecting said liquid droplets;

wherein an image formed on said medium based on said image data is constituted by raster lines that are arranged in parallel to one another at a predetermined interval in a direction intersecting the direction of said raster lines, each of said raster lines being made of a multitude of dots arranged on a straight line;

wherein said raster lines are formed by ejecting said liquid droplets while moving said nozzles in the raster line direction;

wherein a ratio at which said liquid droplets are thinned out in the region that is determined to be outside said medium increases toward the edge in said raster line direction;

wherein said nozzles constitute a nozzle row in which said nozzles are arranged at a predetermined nozzle pitch in a direction intersecting with said raster line direction;

wherein said medium is intermittently carried by a predetermined carry amount in said intersecting direction;

wherein, in between the intermittent carries, said nozzle row forms the raster lines while moving in said raster line direction;

wherein said nozzle pitch of said nozzle row is wider than the interval between the raster lines formed on said medium;

wherein there is an unformed raster line between raster lines that are formed by said nozzle row in a single movement operation in said raster line direction;

wherein each of said raster lines formed on said medium is formed using a plurality of nozzles;

wherein, for a single movement operation of said nozzle row in said raster line direction, the liquid droplets are thinned out by a predetermined thin-out number consecutively from the edge in said raster line direction and said thin-out number is the same number for all of the nozzles constituting said nozzle row;

wherein said thin-out number is changed for every said movement operation of said nozzle row;

wherein said thin-out number of the liquid droplets is changed for every said movement operation based on a predetermined change pattern, and the thin-out numbers based on this change pattern form a cycle that makes a round every time a predetermined number Cm of said movement operations are repeated;

wherein a predetermined number Co of movement operations of said nozzle row is required to form raster lines at said interval D on said medium; and wherein said predetermined number Co is coprime to said predetermined number Cm regarding the change pattern of said thin-out numbers.

17. A liquid ejection method for ejecting liquid droplets toward a medium in order to form dots on said medium, said method comprising:

a step of thinning out a suitable number of liquid droplets to be ejected; and a step of ejecting, toward a vicinity of an edge of said medium, said liquid droplets of a number that has been thinned out by said suitable number;

wherein at least a portion of the liquid droplets ejected after thinning does not land on said medium;

wherein an image formed on said medium is constituted by raster lines that are arranged in parallel to one another at a predetermined interval in a direction intersecting the direction of said raster lines, each of said raster lines being made of a multitude of dots arranged on a straight line;

wherein the liquid droplets are thinned out by a predetermined thin-out number from an edge of said raster line; and wherein said thin-out number of the liquid droplets is changed in the direction intersecting the direction of said raster lines based on a predetermined change pattern and said thin-out number is periodically changed in the direction intersecting the direction of said raster lines.

18. A liquid ejection apparatus for ejecting a liquid, comprising:

a liquid ejection section for ejecting liquid droplets toward a medium in order to form dots on said medium;

wherein said liquid ejection section ejects, toward a vicinity of an edge of said medium, said liquid droplets of a number that has been thinned out by a suitable number;

wherein at least a portion of the liquid droplets ejected after thinning does not land on said medium;

wherein, when ejecting said liquid droplets from said liquid ejection section toward a region that is determined to be outside said medium, said liquid droplets are ejected after thinning a suitable number of the liquid droplets that are to be ejected toward that region;

wherein said liquid droplets are ejected based on image data formed to a size that is larger than said medium, and a reference region corresponding to the size of said medium is stored;

wherein the region that is determined to be outside said medium is a region that is outside said reference region;

wherein said liquid ejection section comprises nozzles ejecting said liquid droplets;

wherein an image formed on said medium based on said image data is constituted by raster lines that are arranged in parallel to one another at a predetermined interval in a direction intersecting the direction of said raster lines, each of said raster lines being made of a multitude of dots arranged on a straight line;

wherein said raster lines are formed by ejecting said liquid droplets while moving said nozzles in the raster line direction;

wherein a ratio at which said liquid droplets are thinned out, in the region that is determined to be outside said medium, increases in a direction away from the edge of said medium;

wherein said nozzles constitute a nozzle row in which said nozzles are arranged at a predetermined nozzle pitch in a direction intersecting with said raster line direction;

wherein said medium is intermittently carried by a predetermined carry amount in said intersecting direction;

wherein, in between the intermittent carries, said nozzle row forms the raster lines while moving in said raster line direction;

wherein, for a single movement operation of said nozzle row in said raster line direction, the liquid droplets are thinned out by a predetermined thin-out number consecutively from the edge in said raster line direction and said thin-out number is the same number for all of the nozzles constituting said nozzle row; and wherein said thin-out number is changed for every said movement operation of said nozzle row.

19. A liquid ejection apparatus according to claim 18, wherein said thin-out number of the liquid droplets is changed for every said movement operation based on a predetermined change pattern, and the thin-out numbers based on this change pattern form a cycle that makes a round every time a predetermined number Cm of said movement operations are repeated.

20. A liquid ejection apparatus for ejecting a liquid, comprising:

a liquid ejection section for ejecting liquid droplets toward a medium in order to form dots on said medium;

wherein said liquid ejection section ejects, toward a vicinity of an edge of said medium, said liquid droplets of a number that has been thinned out by a suitable number;

wherein at least a portion of the liquid droplets ejected after thinning does not land on said medium wherein, when ejecting said liquid droplets from said liquid ejection section toward a region that is determined to be outside said medium, said liquid droplets are ejected after thinning a suitable number of the liquid droplets that are to be ejected toward that region;

wherein said liquid droplets are ejected based on image data formed to a size that is larger than said medium, and a reference region corresponding to the size of said medium is stored;

wherein the region that is determined to be outside said medium is a region that is outside said reference region;

wherein said liquid ejection section comprises nozzles ejecting said liquid droplets;

wherein an image formed on said medium based on said image data is constituted by raster lines that are arranged in parallel to one another at a predetermined interval in a direction intersecting the direction of said raster lines, each of said raster lines being made of a multitude of dots arranged on a straight line;

wherein said raster lines are formed by ejecting said liquid droplets while moving said nozzles in the raster line direction;

wherein a ratio at which said liquid droplets are thinned out, in the region that is determined to be outside said medium, increases in a direction away from the edge of said medium;

wherein said nozzles constitute a nozzle row in which said nozzles are arranged at a predetermined nozzle pitch in a direction intersecting with said raster line direction;

wherein said medium is intermittently carried by a predetermined carry amount in said intersecting direction;

wherein, in between the intermittent carries, said nozzle row forms the raster lines while moving in said raster line direction;

wherein said nozzle pitch of said nozzle row is wider than the interval between the raster lines formed on said medium; and wherein there is an unformed raster line between raster lines that are formed by said nozzle row in a single movement operation in said raster line direction.

21. A liquid ejection apparatus according to claim 20, wherein, when the interval between the raster lines formed on said medium is D, said nozzle pitch is k·D, the number of said nozzles ejecting said liquid is N, and said carry amount is F, then:

N is coprime with k; and $$F=N\cdot D.$$

22. A liquid ejection apparatus according to claim 20, wherein each of said raster lines formed on said medium is formed using a plurality of nozzles.

23. A liquid ejection apparatus according to claim 22, wherein said raster line includes an intermittently-ejected portion that is formed by ejecting the liquid droplets after performing intermittent thinning.

24. A liquid ejection apparatus according to claim 23, wherein a predetermined number Co of movement operations of said nozzle row is required to form raster lines at said interval D on said medium; and wherein said predetermined number Co is coprime to said predetermined number Cm regarding the change pattern of said thin-out numbers.

25. A liquid ejection apparatus according to claim 23, wherein the shape of said dots is substantially the shape of a ellipse whose major axis is oriented in said raster line direction.

26. A liquid ejection apparatus according to claim 22, wherein, when each raster line is formed by M nozzles, and when the interval between the raster lines formed on said medium and the interval between the dots in said raster line direction are both D, said nozzle pitch is k·D, the number of said nozzles ejecting said liquid droplets is N, and said carry amount is F, then:

N/M is an integer;

N/M is coprime to k; and $$F=(N/M)D.$$

27. A liquid ejection apparatus according to claim 26, wherein said k is not a multiple (a integer multiple other than 1) of said predetermined number Cm.

* * * * *